US012330044B2

(12) United States Patent
Woods et al.

(10) Patent No.: US 12,330,044 B2
(45) Date of Patent: Jun. 17, 2025

(54) ROLLER SKATE, ASSOCIATED KIT, AND SYSTEM

(71) Applicant: FUNFEATS LLC, Lititz, PA (US)

(72) Inventors: Paul Woods, Dublin (IE); Brian Green, Running Springs, CA (US); Wayne Walsh, Dublin (IE); Darrell Merino, Lititz, PA (US); You Ruijie, Taipei (TW)

(73) Assignee: FUNFEATS LLC, Lititz, PA (US)

( * ) Notice: Subject to any disclaimer, the term of this patent is extended or adjusted under 35 U.S.C. 154(b) by 0 days.

(21) Appl. No.: 18/325,743

(22) Filed: May 30, 2023

(65) Prior Publication Data

US 2024/0181328 A1 Jun. 6, 2024

(30) Foreign Application Priority Data

Dec. 1, 2022 (CN) ..... 202211524417.9

(51) Int. Cl.

| | |
|---|---|
| ***A63C 17/00*** | (2006.01) |
| ***A63C 17/04*** | (2006.01) |
| ***A63C 17/20*** | (2006.01) |
| ***A63C 17/22*** | (2006.01) |

(52) U.S. Cl.

CPC ..... *A63C 17/0086* (2013.01); *A63C 17/04* (2013.01); *A63C 17/20* (2013.01); *A63C 17/226* (2013.01); *A63C 2203/42* (2013.01)

(58) Field of Classification Search

CPC ..... A63C 17/0086; A63C 17/04; A63C 17/20; A63C 2203/42

See application file for complete search history.

(56) References Cited

U.S. PATENT DOCUMENTS

| | | | | |
|---|---|---|---|---|
| 5,484,149 | A * | 1/1996 | Lee | A63C 17/0086 280/11.26 |
| 5,931,478 | A * | 8/1999 | Chang | A63C 17/06 280/11.26 |
| 10,279,238 | B1 * | 5/2019 | Yu | A63C 1/303 |
| 2003/0141679 | A1 * | 7/2003 | Hong | A63C 17/0086 280/11.26 |
| 2008/0265532 | A1 * | 10/2008 | Im | A63C 17/008 280/11.27 |
| 2011/0115174 | A1 * | 5/2011 | Green | A63C 17/04 280/11.19 |
| 2011/0193303 | A1 * | 8/2011 | Green | A63C 17/04 280/11.26 |
| 2012/0187648 | A1 * | 7/2012 | Chen | A63C 17/0033 280/87.042 |

(Continued)

*Primary Examiner* — Brian L Swenson
(74) *Attorney, Agent, or Firm* — Aird & McBurney LP

(57) ABSTRACT

A modular, multi-part roller skate is provided. The multi-part roller skate includes a roller skate body, a front wheel assembly, a rear wheel assembly, a support surface for supporting a footwear of a user, and at least one securing element for securing the footwear to the support surface. The multi-part roller skate is configurable as a modular roller skate with a removable pair of rear wheels, an interchangeable modular roller skate and ice skate, and an interchangeable modular roller skate and cross-country ski/snowshoe. In some embodiments, the multi-part roller skate can also be configured as a length-adjustable skate with a length adjustable skate body that includes separate front and rear foot support structures.

24 Claims, 35 Drawing Sheets

(56) References Cited

U.S. PATENT DOCUMENTS

| | | | | |
|---|---|---|---|---|
| 2013/0282216 | A1* | 10/2013 | Edney | A63C 17/04<br>701/22 |
| 2014/0131962 | A1* | 5/2014 | Green | A63C 17/262<br>280/11.26 |
| 2019/0261729 | A1* | 8/2019 | Whyte | A63C 17/08 |

* cited by examiner

ROLLER SKATE, ASSOCIATED KIT, AND SYSTEM

The present application claims priority to Chinese Patent Application No. 115,591,217, filed Jan. 13, 2023, which claims priority to Chinese Patent Application No. 202211524417.9, filed Dec. 1, 2022.

FIELD OF THE DISCLOSURE

The present disclosure relates generally to modular skate systems. In particular, the disclosure relates to a length adjustable roller skate and a modular skate system.

BACKGROUND OF THE DISCLOSURE

The prior art includes skates and other articles that are worn on the feet of a user to provide alternative modes of transportation in a variety of recreational applications. Roller skates are one such type of skate that is common in recreational activities, such as skating and rollerblading, and ice skating. Roller skates are typically comprised of a roller skate body, two-wheel assemblies (front and rear), and a support surface on which a user's feet are placed. The support surface and wheel assemblies can be configured in a variety of ways to facilitate different types of skating activities. In-line skates, also known as Rollerblades™, are a popular type of roller skate. In-line skates typically include three, four or five small wheels arranged in a single line, and a boot or shoe that fits over the user's foot. This type of roller skate is designed to provide a smooth and efficient ride and is often used for recreational activities such as skating in the park or down a street. In recent years, there has been an increase in the popularity of modular roller skates. These skates can be configured in various ways, allowing the user to customize their experience. Examples of some of these configurations include removable rear wheels, interchangeable modular roller skates and ice skates, and interchangeable modular roller skates and cross-country ski/snowshoe. Length-adjustable roller skates are another type of roller skate that have become popular in recent years. These skates are designed to provide adjustable sizes for users of different feet sizes. One shortcoming of existing length-adjustable skate design is that most of these designs limit the size of the skate to be varied between only a couple of positions. It is also common for these existing length-adjustable design to be formed with a "boot" structure to hold a user's foot. These boot type structures can only vary in size, after which the structure of boot limits the extent to which boot can be made to expand and retract.

SUMMARY OF THE DISCLOSURE

According to an aspect, there is provided a length-adjustable roller skate, comprising: a front foot support structure including a front sole surface, a front wheel assembly and a first connector element, a rear foot support structure including a rear sole surface, a rear wheel assembly, and a second connector element that is shaped to releasably connect to the first connector element for movably connecting the front foot support structure and the rear foot support structure, the first connector element and second connector element movably connecting the front and rear foot support structures such that a distance between the front sole surface and the rear sole surface can be increased by moving the front foot support structure in a first direction relative to the rear foot support structure and such that a distance between the front sole surface and the rear sole surface can be decreased by moving the front foot support structure in a second direction relative to the rear foot support structure, the second direction being opposite the first direction, an adjustment actuator that is movably mounted to one of the front foot support structure and the rear foot support structure for moving between a disengaged position and an engaged position where the adjustment actuator releasably fixes a relative position of the front foot support structure and rear foot support structure, at least one adjustable front securing element that is connected to the front foot support structure, and at least one rear securing element that is connected to the rear foot support structure and is separate from the front securing element, the at least one front and rear securing elements being formed for collectively, releasably holding a footwear of a user against a support surface that is at least in part defined by the front sole surface and the rear sole surface.

In an embodiment, the at least one front securing element of the length-adjustable roller skate includes a plurality of front securing straps that are connected to the front foot support structure and extend over the front sole surface for releasably attaching the footwear of a user to the front sole surface, and wherein the at least one rear securing element includes a plurality of rear securing straps that are connected to the rear foot support structure and extend over the rear sole surface for releasably attaching the footwear of a user to the rear sole surface.

In an embodiment, the first connector element of the length-adjustable roller skate includes first and second parallel bars that extend from a first end of the front foot support structure, substantially parallel to a long axis of the front foot support structure, wherein the second connector element includes a pair of parallel channels that extend from an outer surface of the rear foot support structure along a length thereof, and wherein the pair of parallel channels are shaped to slidably receive the first and second parallel bars therewithin for movably connecting the front and rear foot support structures.

In an embodiment, one of the first and second parallel bars of the length-adjustable roller skate includes a plurality of ratchet teeth formed along a length thereof, the adjustment actuator is movably mounted on the rear foot support structure, and the adjustment actuator is positioned on the rear foot support structure such that when the adjustment actuator is in the engaged position, the adjustment actuator engages at least one of the plurality of ratchet teeth for releasably fixing a position of the front foot support structure relative to the rear foot support structure.

In an embodiment, the front foot support structure, rear foot support structure and plurality of ratchet teeth are formed such that the front foot support structure can be releasably fixed in one of at least four different positions relative to the rear foot support structure.

In an embodiment, one of the pair of receiving channels includes a plurality of ratchet teeth formed along a length thereof, wherein the adjustment actuator is movably mounted on the front foot support structure, and wherein the adjustment actuator is positioned on the front foot support structure such that when the adjustment actuator is in the engaged position, the adjustment actuator engages at least one of the plurality of ratchet teeth for releasably fixing the front foot support structure relative to the rear foot support structure.

In an embodiment, the of the length-adjustable roller skate further comprises a biasing member that is connected to the adjustment actuator and to the one of the front foot support structure and rear foot support structure for biasing the adjustment actuator towards the engaged position.

In an embodiment, each of the plurality of ratchet teeth of the length-adjustable roller skate include a first side that is disposed at a first angle relative to a long axis of the first parallel bar and a second side that is disposed at a second angle relative to the long axis of the first engagement bar, the first angle of the first side being sized such that when the adjustment actuator is in the engaged position, the front foot support structure is prevented from moving in the first direction relative to the rear foot support structure, and the second angle of the second side being sized such that when the adjustment actuator is in the engaged position, the front foot support structure is movable in the second direction relative to the rear foot support structure.

In an embodiment, the second side of each of the plurality of ratchet teeth is located on a rearward side of each of the plurality of teeth.

In an embodiment, each channel of the pair of parallel channels of the length-adjustable roller skate includes a groove that is formed on an interior surface of the channel and that extends along the length of the channel, wherein the first and second bars each include a tenon that is formed on a side wall thereof and that extends along a length thereof, and wherein the tenons of the first and second bars are sized to be received within the grooves of the pair of parallel channels as the first and second bars are slidably inserted into the pair of parallel channels.

According to another aspect of the disclosure, there is provided a modular roller skate, comprising: a skate body including a sole support surface and at least one of adjustable securing element for releasably holding a footwear of a user against the sole support surface, a permanent front wheel assembly including a front wheel support formed on a front wheel support structure of the skate body, and a front wheel that is rotatably mounted to the front wheel support, a removable rear wheel assembly including a rear wheel support, and a pair of rear wheels that are rotatably mounted to the rear wheel support, and which are laterally spaced apart rear wheel support for laterally stabilizing the skate body in a lateral-vertical plane, an engagement structure that is formed for releasably mounting the removable rear wheel assembly to the skate body such that a rotational axis of the pair of rear wheels is parallel to the rotational axis of the at least one front wheel.

In an embodiment, the engagement structure of the modular roller skate includes a receiving cavity that is formed in one of the skate body and the removable rear wheel assembly and that extends inwards from a first outer surface of the one of the skate body and the removable rear wheel assembly, a through-aperture that extends between the receiving cavity and a second outer surface of the one of the skate body and the removable rear wheel assembly, and an engagement projection that is formed in the other of the skate body and the removable rear wheel assembly and that extends out from the other of the skate body and removable rear wheel assembly is sized to be releasably received in the receiving cavity.

In an embodiment, the the at least one adjustable securing element of the modular roller skate includes a plurality of adjustable securing straps, wherein each of the plurality of adjustable securing straps are connected to first and second sections of the skate body that are disposed on opposing sides of the sole support surface such that each of the plurality of adjustable securing straps extends across the sole support surface.

In an embodiment, the engagement projection of the modular roller skate includes an engagement button that is sized to be received in the through-aperture, and that is movable between an unactuated and an actuated position, the engagement button including at least one internal biasing element for internally biasing the engagement button towards the unactuated position, and the at least one internal biasing element being connected within the engagement button such as the engagement projection is inserted in the receiving cavity, the engagement button will be driven towards the actuated position, and such that as the engagement projection is fully inserted in the receiving cavity and the engagement button becomes aligned with the through-aperture, the engagement button will move from the actuated to the unactuated position for releasably locking the engagement projection with the receiving cavity.

In an embodiment, the engagement button of the modular roller skate has a generally cylindrical form, and a top surface of the engagement button includes a first portion that is formed as a flat, semi-cylindrical face, and a second portion that is formed as an angled semi-cylindrical face that extends down at an acute angle relative to the first portion of the top surface.

In an embodiment, the engagement button of the modular roller skate is oriented on the engagement projection such that when the engagement projection is inserted into the receiving cavity, the second portion of the top surface will abut an edge of the receiving cavity for driving the engagement button towards the actuated position.

In an embodiment, the engagement projection of the modular roller skate includes a receiving aperture formed on a surface thereof, and wherein the engagement button is movably retained within the receiving aperture for moving between the actuated and unactuated positions.

In an embodiment, the at least one internal biasing element is connected between the receiving aperture and the engagement button for biasing the engagement button towards the unactuated position.

In an embodiment, the engagement button includes a pair of diametrically opposed tabs that extend radially outward from a radial wall of the engagement button.

In an embodiment, the receiving aperture of the modular roller skate includes a pair of diametrically opposed slots extending along a vertical length of the receiving aperture, wherein each of the pair of diametrically opposed slots includes an upper slot section and a lower slot section, the pair of diametrically opposed slots being formed such that when the engagement button is in the unactuated position, the pair of diametrically opposed tabs are disposed in the lower slot section and when the engagement button is in the actuated position, the pair of diametrically opposed tabs are disposed in the upper slot section, and wherein the upper slot sections of the pair of diametrically opposed slots include a retaining wall for contacting the pair of diametrically opposed tabs so as to prevent any rotation of the engagement button relative to the receiving aperture.

In an embodiment, the receiving aperture of the modular roller skate is formed on a bottom surface of the skate body, and each of the pair of diametrically opposed slots is formed in a side wall of the receiving aperture.

In an embodiment, each of the pair of diametrically opposed slots is formed at a first angle relative to a longitudinal axis of the skate body.

In an embodiment, each slot of the pair of diametrically opposed slots further comprises an insertion slot that is connected to the upper slot section of the slot, wherein each insertion slot extends from the upper slot section of the slot to the bottom surface of the skate body, and where each insertion slot is shaped to receive one of pair of diametrically opposed tabs so as to permit the removal of the engagement button from the receiving aperture.

In an embodiment, each insertion slot of the modular roller skate is formed at a second angle relative to the longitudinal axis of the skate body, the second angle being in a direction opposite the first angle.

In an embodiment, the skate body of the modular roller skate is a multi-part skate body that includes a front foot support structure and a rear foot support structure.

According to an additional aspect of the disclosure, there is provided a modular skate kit for selectably providing a roller skate and an ice skate, the modular skate kit comprising: a skate body including a sole support surface, a plurality of securing elements for releasably attaching a footwear of a user to the sole support surface, a first mounting element, and a front wheel assembly that is formed on a front wheel support structure of the skate body and that includes at least one front wheel, a removable rear wheel assembly including a rear wheel support, a pair of rear wheels that are rotatably mounted on the rear wheel support, and a second mounting element that is formed to be connected to the first mounting element for releasably mounting the rear wheel support to the skate body so as to form a roller skate, a rear ice-skate support including at least one rear ice skate blade connected to one end thereof, and a third mounting element formed on an opposing end thereof, the third mounting element being formed to be releasably connected to the first mounting element for releasably mounting the rear-ice-skate support to the skate body, and a front ice-skate support including at least one front ice skate blade and at least one support frame that is releasably mountable to the front wheel support structure of the skate body, so as to form an ice skate, wherein the first mounting element is formed to interchangeably connect to one of the second mounting element of the rear wheel support and the third mounting element of the rear ice-skate.

In an embodiment, the first mounting element of the skate body includes one of a receiving cavity and an engagement projection, the second mounting element of the rear wheel support including the other of the receiving cavity and the engagement projection, the third mounting element including the other of the receiving cavity and the engagement projection, and the engagement projection being sized to be releasably received in the receiving cavity.

In an embodiment, the first mounting element of the modular skate kit includes the receiving cavity, where the receiving cavity extends inwards from a surface on a rear wheel support structure of the skate body, wherein the second and third mounting elements each include the engagement projection, and wherein the skate body further includes an aperture that extends between the receiving cavity and a surface of the skate body.

In an embodiment, the engagement projection of each of the second and third mounting elements includes an engagement button that is sized to be received in the aperture and that is movable between an unactuated and an actuated position, wherein the engagement button includes at least one internal biasing element for internally biasing the engagement button towards the unactuated position, and wherein the at least one internal biasing element is connected within the engagement button such that as the engagement projection is inserted in the receiving cavity, the engagement button will be driven towards the actuated position, and as the engagement projection is fully inserted in the receiving cavity and the engagement button becomes aligned with the aperture of the skate body, the engagement button will move from the actuated to the unactuated position for releasably locking the engagement projection with the receiving cavity.

In an embodiment, the engagement projection of the modular skate kit includes a receiving aperture formed on a surface thereof, where the engagement button is movably retained within the receiving aperture for moving between the actuated and unactuated positions.

In an embodiment, biasing member of the modular skate kit is connected between the receiving aperture and the engagement button for biasing the engagement button towards the unactuated position.

In an embodiment, the front wheel assembly of the modular skate kit includes a pair of front wheel bores that are formed in the skate body on either side of the at least one front wheel, wherein the support frame includes a pair of projections that are formed to be releasably connected into the pair of front wheel bores on either side of the at least one front wheel.

In an embodiment, the skate body of the modular skate kit is a multi-part skate body that includes a front foot support structure and a rear foot support structure.

According to an additional aspect of the disclosure, there is provided a modular skate system for selectably providing both a rolling and non-rolling manner of travel, and comprising: a skate body including a sole support surface, a plurality of securing elements for releasably attaching the footwear of a user to the sole support surface, a front wheel assembly that is formed on a front wheel support structure of the skate body and includes at least one front wheel, and a first mounting element, the first mounting element being formed to interchangeably connect to one of a rear wheel assembly and a rear support member, the rear wheel assembly including a rear support body, a pair of rear wheels that are rotatably mounted on the rear support body, and a second mounting element that is formed to be releasably connected to the first mounting element for releasably mounting the rear wheel support to the skate body such that a rotational axis of the pair of rear wheels is parallel to a rotational axis of the at least one front wheel, and the rear support member including a first end and a second end that includes a third mounting element, the third mounting element being formed to be releasably connected to the first connector element for releasably mounting the rear support member to the skate body, so as to form a rolling manner of travel, and a secondary travel assembly that is structured for supporting the skate body and providing a non-rolling manner of travel to the multi-functional skate, the secondary travel assembly including: a front connector that is releasably connectable to the at least one front wheel of the skate body for pivotably mounting the skate body on the secondary travel assembly, a rear connector that includes at least one engagement surface for separably supporting the rear support member, the at least one engagement surface being formed to inhibit lateral movement of the rear support member when the second end of the rear support member is supported on the at least one engagement surface, so as to form a non-rolling manner of travel.

In an embodiment, the at least one engagement surface of the modular skate system is positioned for separably supporting the first end of the rear support member such that when the front wheel support structure of the skate body is pivotably mounted to the front connector, the first end of the rear support member can be separated from the at least one engagement surface by pivoting the skate body relative to the secondary travel assembly.

In an embodiment, the front connector of the modular skate system is formed for pivotably mounting the skate body to the secondary travel assembly such that the skate body can pivot about a rotational axis of the at least one front wheel, relative to the secondary travel assembly.

In an embodiment, the first mounting element of the modular skate system includes a receiving cavity, wherein the second mounting element includes a first engagement projection that extends from the rear wheel support and is formed to be releasably secured within the receiving cavity such that a rotational axis of the pair of rear wheels is parallel to the rotational axis of the at least one front wheel, and wherein the third mounting element includes a second engagement projection that extends from the second end of the rear support members is and formed to be releasably secured within the receiving cavity.

In an embodiment, the secondary travel assembly of the modular skate system includes an elongated supporting element having a form of a ski.

In an embodiment, the secondary travel assembly of the modular skate system is formed as a snowshoe.

In an embodiment, the secondary travel assembly of the modular skate system includes a top surface and a substantially planar bottom surface, and wherein the front and rear connectors are formed on the top surface of the secondary travel assembly.

In an embodiment, the secondary travel assembly of the modular skate system includes a support body that extends upwards the top surface of the secondary travel assembly, and wherein the engagement surface is formed on the support body.

In an embodiment, the at least one engagement surface of the support body includes a pair of parallel, partial cylinder members that extend along a longitudinal axis of the secondary travel assembly, and wherein each of the partial cylinder members of the support body is formed as a tapering cylinder member such that a height of each partial cylinder member at a frontmost extent of the partial cylinder members is less than a height of each partial cylinder member at a rearmost extent of the partial cylinder members.

In an embodiment, the second end of the rear support member includes a pair of parallel channels with a shape that is complementary to a shape of the pair of partial cylinder members such that the first end of the rear support member can be slidably engaged upon the pair of partial cylinder members for preventing lateral movement of the rear support member thereon.

In an embodiment, the front wheel assembly of the modular skate system includes a pair of support arms that projects outward from along the front wheel support structure of the skate body, and wherein the at least one front wheel is rotatably mounted between the pair of supports.

In an embodiment, the front wheel assembly of the modular skate system includes a pair of front wheel well bores that are formed in the skate body on either side of the at least one front wheel, and wherein the front connector of the secondary travel assembly includes a pair of projections that are formed to be releasably connected into the pair of front wheel well bores, on either side of the at least one front wheel.

In an embodiment, the front connector of the secondary travel assembly includes a connector body with at least one wheel receiving channel formed therein for receiving the at least one front wheel, and at least one wheel securing strap for releasably fixing the at least one front wheel within the at least one receiving channel.

According to yet another aspect of the disclosure, there is provided a modular skate system for selectably providing both a rolling and non-rolling manner of travel, and comprising: a front foot support structure including a front sole surface, a front wheel assembly and a first connector element, a rear foot support structure including a rear sole surface, a first mounting element, and a second connector element that is shaped to releasably connect to the first connector element for movably connecting the front foot support structure and the rear foot support structure, the first mounting element being formed to interchangeably connect to one of a rear wheel support and a rear support member, the rear wheel support including a truck body, a pair of rear wheels that are rotatably mounted on the truck body, and a second mounting element that is formed to be releasably connected to the first mounting element for releasably mounting the rear wheel support to the skate body, and the rear support member including a first end, and a second end that includes a third mounting element, the third mounting element being releasably connectable to the first mounting element for releasably mounting the rear support member to the skate body, a secondary travel assembly that is structured for supporting the skate body and providing a non-rolling manner of travel to the multi-functional skate, the secondary travel assembly including: a front connector that is releasably connectable to the front wheel support structure of the skate body for mounting the front wheel support structure of the skate body on the secondary travel assembly, and a rear connector that includes at least one engagement surface for supporting the first end of the rear support member thereon, wherein the at least one engagement surface is formed for slidably supporting the first end of the rear support member such that when rear foot support structure is moved relative to the front foot support structure, the first end of the rear support member will move along the at least on engagement surface for supporting the rear foot support structure.

In an embodiment, the at least one engagement surface of the modular skate system is formed to prevent lateral movement of the rear support member when the second end of the rear support member is support on the at least one engagement surface.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1A:
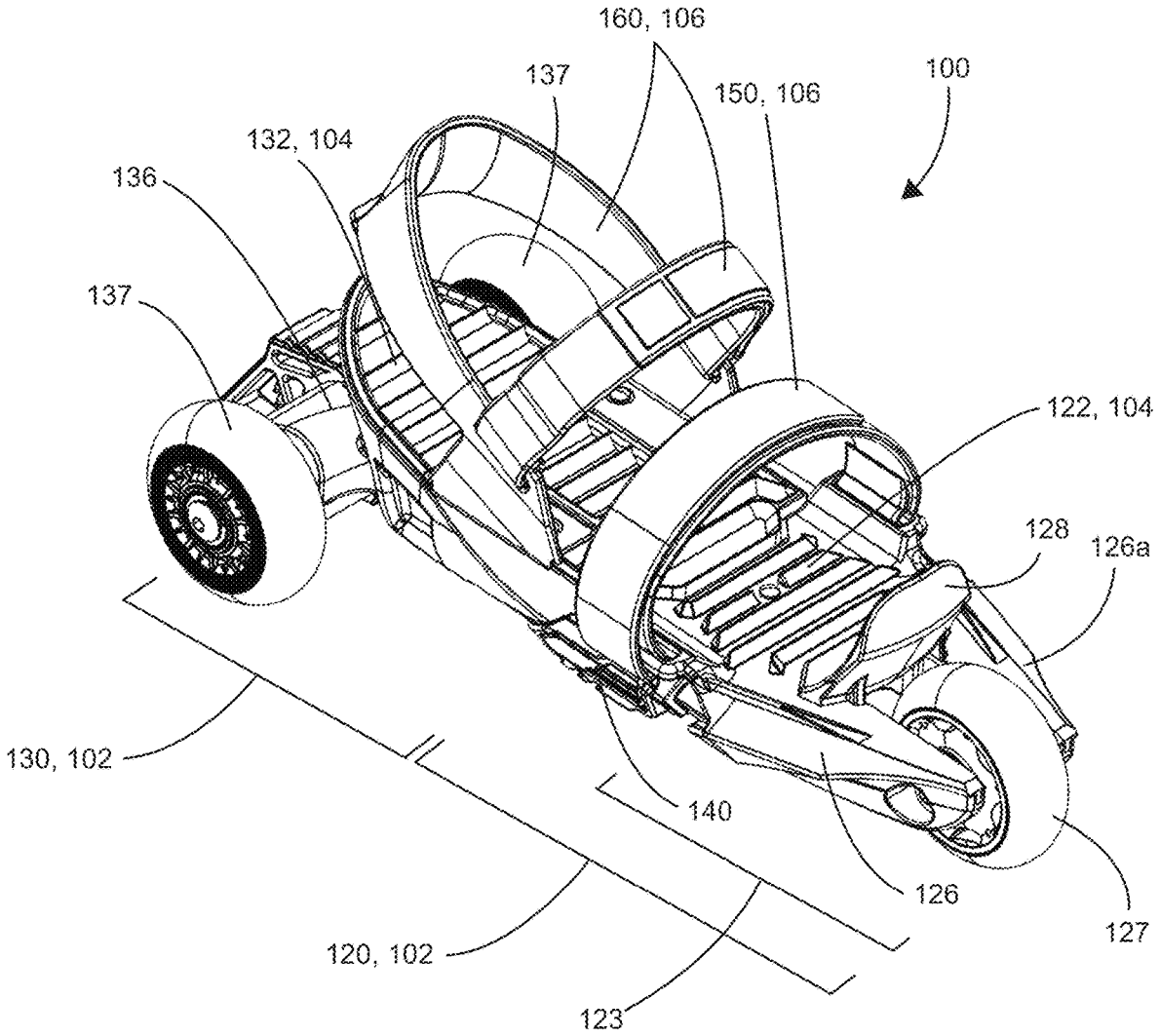
FIG. 1A shows an isometric view of a length-adjustable roller skate in accordance with an embodiment of the disclosure.

For simplicity and clarity of illustration, where considered appropriate, reference numerals may be repeated among the Figures to indicate corresponding or analogous elements. In addition, numerous specific details are set forth to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

The embodiments of the disclosure described herein are exemplary (e.g., in terms of materials, shapes, dimensions, and constructional details) and do not limit by the claims appended hereto and any amendments made thereto. Persons skilled in the art will appreciate that there are yet more alternative implementations and modifications possible, and that the following examples are only illustrations of one or more implementations. The scope of the disclosure, therefore, is only to be limited by the claims appended hereto and any amendments made thereto.

Figure 1B:
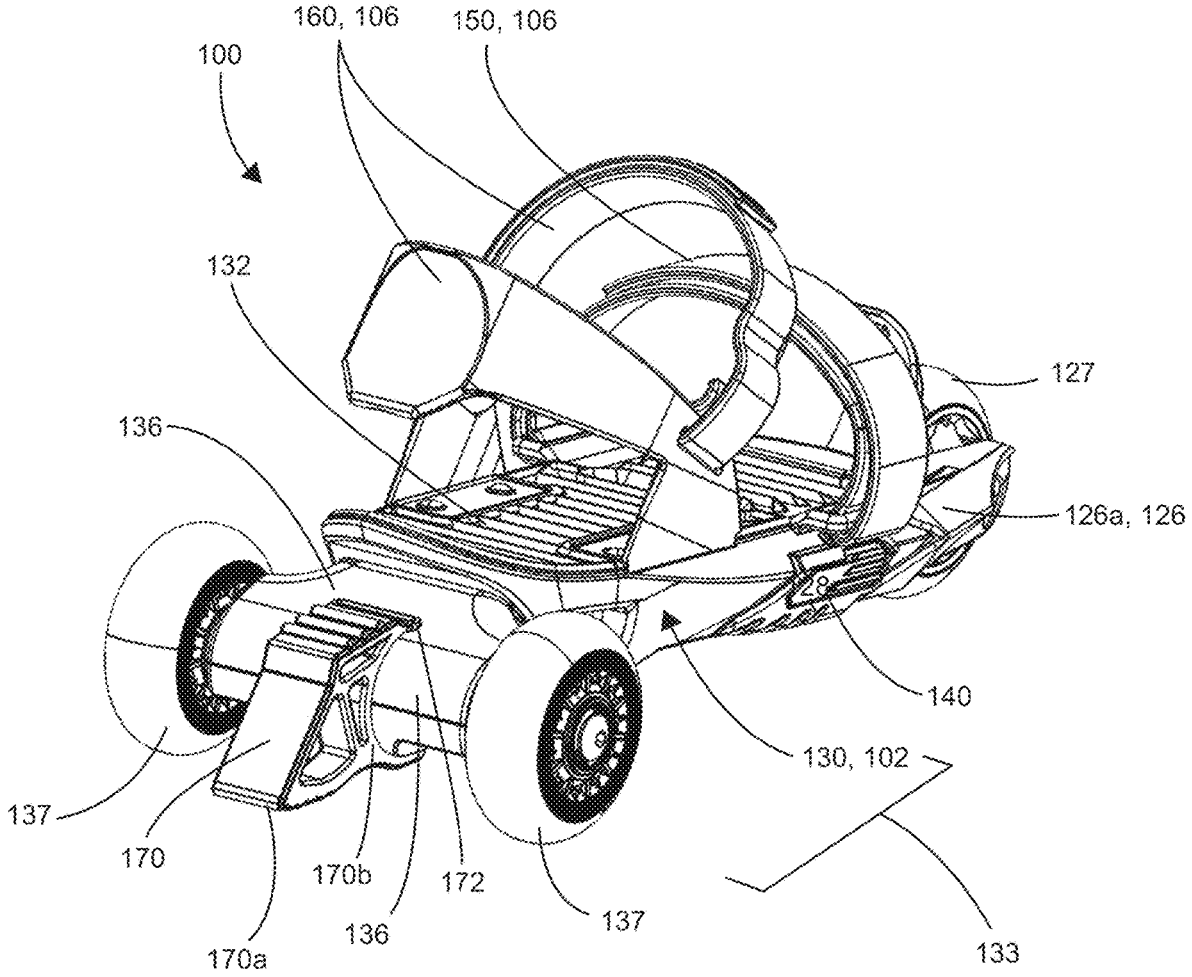
FIG. 1B shows a rear, isometric view of the length-adjustable roller skate of FIG. 1A.
Figure 1C:
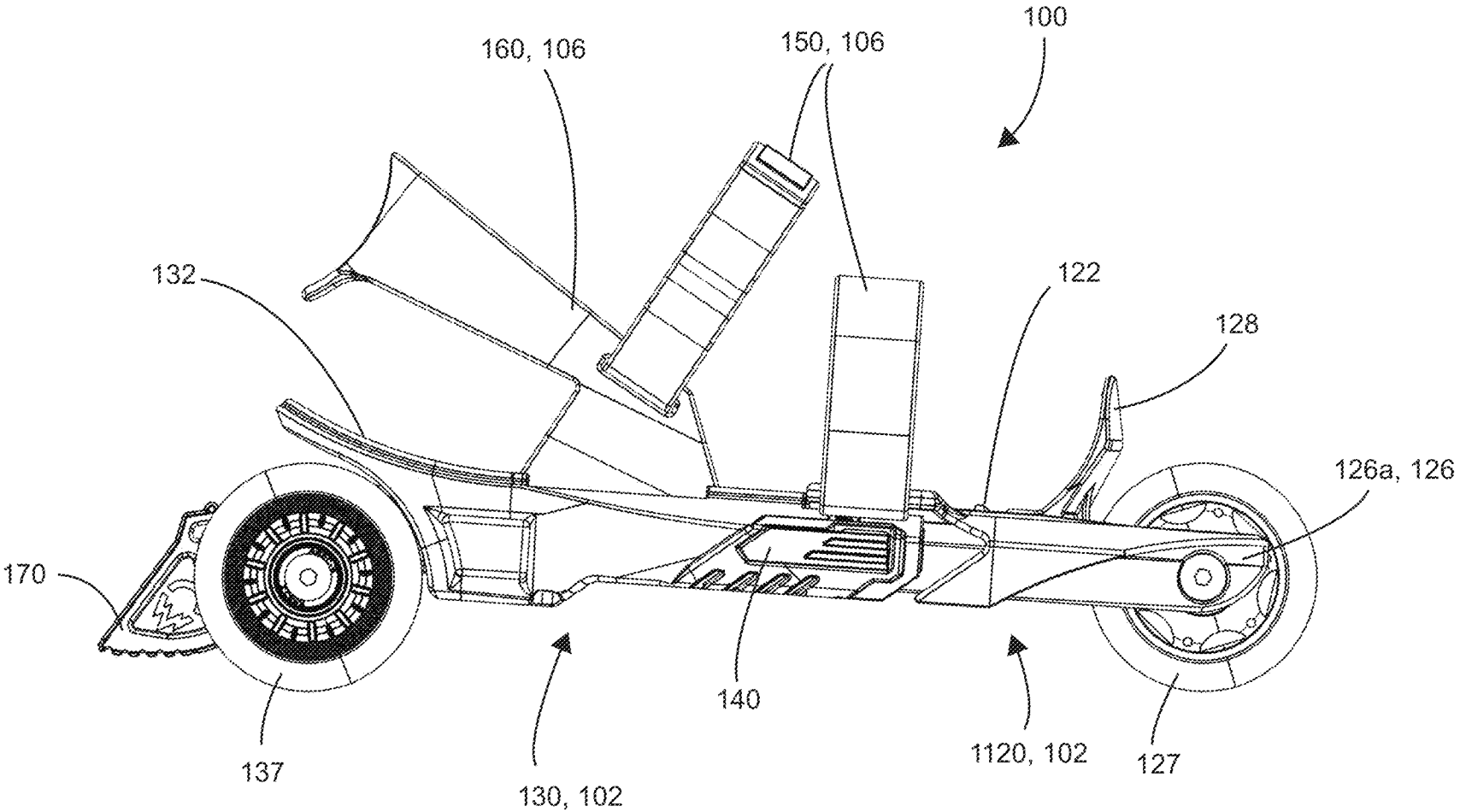
FIG. 1C shows a side-view of the length-adjustable roller skate of FIG. 1A.

Referring to FIGS. 1A to 1C, there is provided a multi-part roller skate 100 according to an aspect of the present disclosure. The multi-part roller skate 100 includes a skate body 102, a front wheel assembly 123, a rear wheel assembly 133, a support surface 104 that is formed on the skate body 102 for supporting a footwear of a user, and at least one securing element 106 that is connected to the skate body 102 for securing the footwear of the user to the support surface 104.

In an embodiment, the at least one securing element 106 includes a plurality of adjustable securing straps. Each of the plurality of adjustable securing straps are connected to first and second sections of the skate body 102, where the first and second section are disposed on opposing sides of the support surface 104 of the skate body 102 such that each of the plurality of adjustable securing straps extends across the support surface 104.

Length-Adjustable Roller Skate

Referring to FIGS. 1A to 4B, there is provided a first embodiment of the multi-part roller skate 100, where the multi-part roller skate 100 is a length-adjustable roller skate. In the various embodiments of the length-adjustable roller skate, the skate body 102 includes a front foot support structure 120 and a rear foot support structure 130, and the at least one securing element 106 includes at least one front securing element 150 and at least one rear securing element 160.

Referring to FIGS. 1A to 4B, the length-adjustable roller skate includes the front foot support structure 120, where the front foot support structure 120 includes a front sole surface 122, the front wheel assembly 123 and a first connector element 224. The length-adjustable roller skate also includes the rear foot support structure 130, where the rear foot support structure 130 includes a rear sole surface 132, the rear wheel assembly 133, and a second connector element 234 that is shaped to releasably connect to the first connector element 224 for movably connecting the front foot support structure 120 and the rear foot support structure 130. The first connector element 224 and second connector element 234 movably connect the front and rear foot support structures 120, 130 such that a distance between the front sole surface 122 and the rear sole surface 132 can be increased by moving the front foot support structure 120 from retracted position (provided in FIG. 4A), in a first direction relative to the rear foot support structure 130, towards at least one extended position (provided in FIG. 4B). Similarly, the distance between the front sole surface 122 and the rear sole surface 132 can be decreased by moving the front foot support structure 120 in a second direction relative to the rear foot support structure 130, where the second direction is opposite the first direction. The length-adjustable roller skate also includes an adjustment actuator 140 that is movably mounted to one of the front foot support structure 120 and the rear foot support structure 130 for moving between a disengaged position, and an engaged position where the adjustment actuator 140 releasably fixes a relative position of the front foot support structure 120 and rear foot support structure 130. The length-adjustable roller skate also includes at least one front securing element 150 which is connected to the front foot support structure 120, and at least one rear securing element 160 which is connected to the rear foot support structure 130 and that is separate from the front securing element 150. The at least one front and at least one rear securing elements 150, 160 are formed for collectively, releasably holding the footwear of a user against the support surface 104, where the support surface 104 is at least in part defined by the front sole surface 122 and the rear sole surface 132.

Front Foot Support Structure

Referring to FIGS. 1 to 6B, the front foot support structure 120 includes the front wheel assembly 123, and first connector element 224. In an embodiment, the front wheel assembly 123 includes a front wheel support frame 126 that is integrally formed from the front foot support structure 120, and at least one front wheel 127 that is rotatably mounted to the front wheel support frame 126.

In the specific embodiment provided in FIGS. 1A to 3, the at least one front wheel 127 is a single front wheel 127, and the front wheel support frame 126 includes a pair of frame arms 126*a* that extend forward from the front foot support structure 120. A gap is defined between the pair of frame arms 126*a*, and each of the pair of frame arms 126*a* includes a frame arm mounting aperture formed therethrough. As provided in FIG. 2, the single front wheel 127 is mounted on a front axle assembly 323, and the front axle assembly 323 is rotatably mounted between the frame arm mounting aperture of each of the pair of frame arms 126*a* such that the single front wheel 127 is disposed in the gap between the pair of frame arms 126*a*. In this embodiment, the front axle assembly 323 includes a front axle 324, and a pair of front wheel bearings 325 that are mounted to opposing ends of the front axle 324 via a pair of front axle fasteners 326. The bearings 325 and opposing ends of the front axle 324 are disposed in the frame arm mounting apertures when the front axle assembly 323 is mounted to the front wheel support frame 126.

In an embodiment such as provided in FIG. 1, the front sole surface 122 is positioned on a top surface of the front foot support structure 120 and extends along a length of the front foot support structure 120. The front sole surface 122 is structure to limit slippage or front-to-back movement of the footwear of the user while it is partially supported on the front sole surface 122.

In the specific embodiments provided in FIGS. 1A to 6B, the front sole surface 122 includes a plurality of laterally extending ridges. The plurality of laterally extending ridges project up from the front sole surface 122 and function to increase a degree of friction between the footwear of a user and the front sole surface 122 to thereby limit slippage of the footwear of the user within the length-adjustable skate.

In an additional embodiment such as provided in FIG. 1A, the front foot support structure 120 includes a toe support member 128 that is positioned on front foot support structure 120 for preventing forward movement of the footwear of the user relative to the front foot support structure 120.

In the specific embodiment provided in FIGS. 1A to 6B, the toe support member 128 projects upwards from the top surface of the front foot support structure 120 and has an at least partially curvilinear shape that corresponds to a curved shape of the front of various types of footwear. The toe support member 128 is positioned at a frontmost extent of the front sole surface 122, between the frame arms 126*a* of the front wheel support frame 126.

Figure 5:
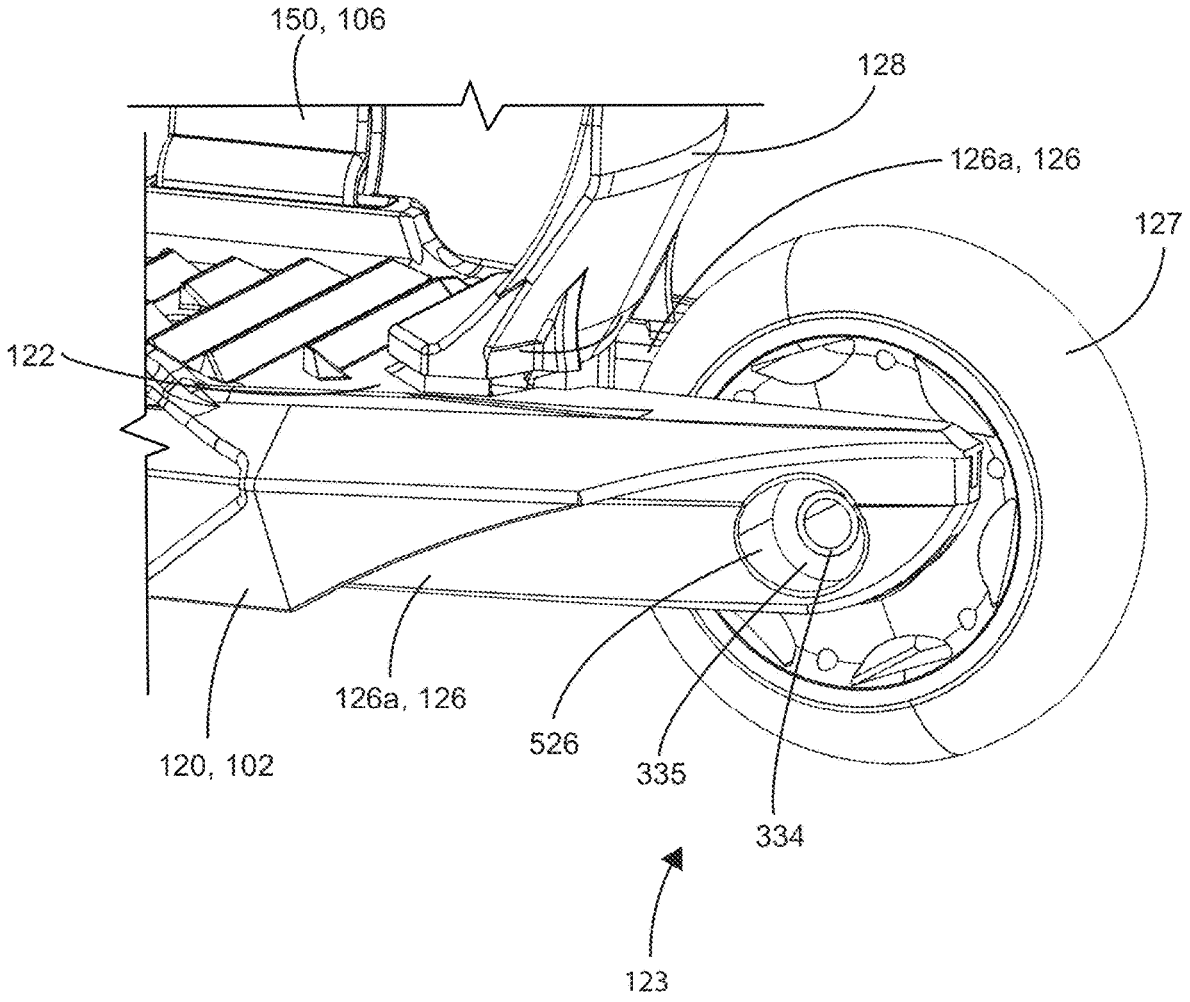
FIG. 5 shows a close-up view of the front wheel assembly of the length-adjustable roller skate of FIG. 1A.

Referring to FIG. 5, an embodiment of the front wheel assembly 123 is provided, where the front wheel support frame 126 includes the pair of frame arms 126*a*. In this embodiment, the frame arm mounting apertures of each of the pair of frame arms 126*a* extends through the width of a respective frame arm 126*a* to define a bore 526 on a laterally outer portion of each of the pair of frame arms 126*a*.

Figure 2:
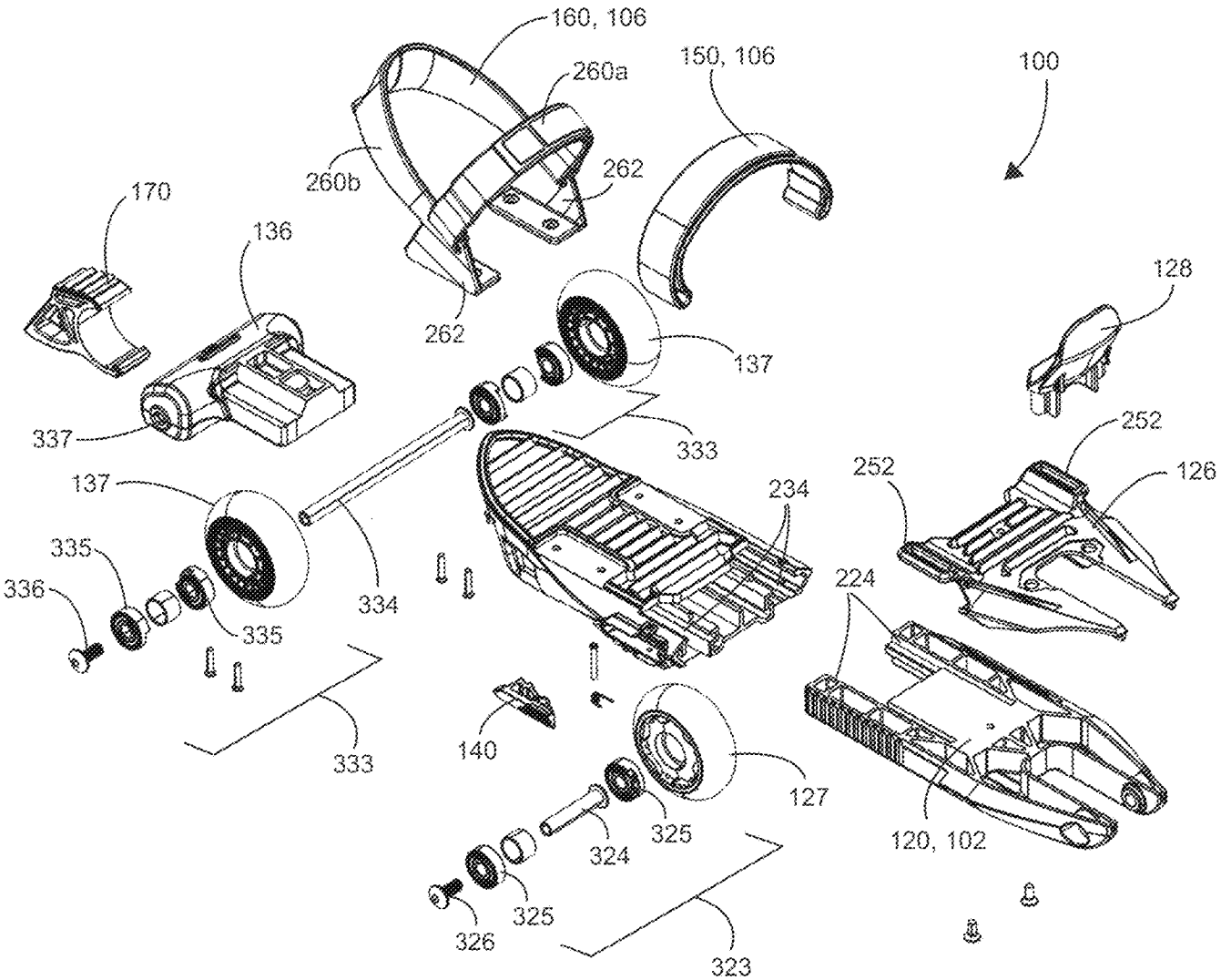
FIG. 2 shows an exploded, perspective view of the length-adjustable roller skate of FIG. 1A.
Figure 3:
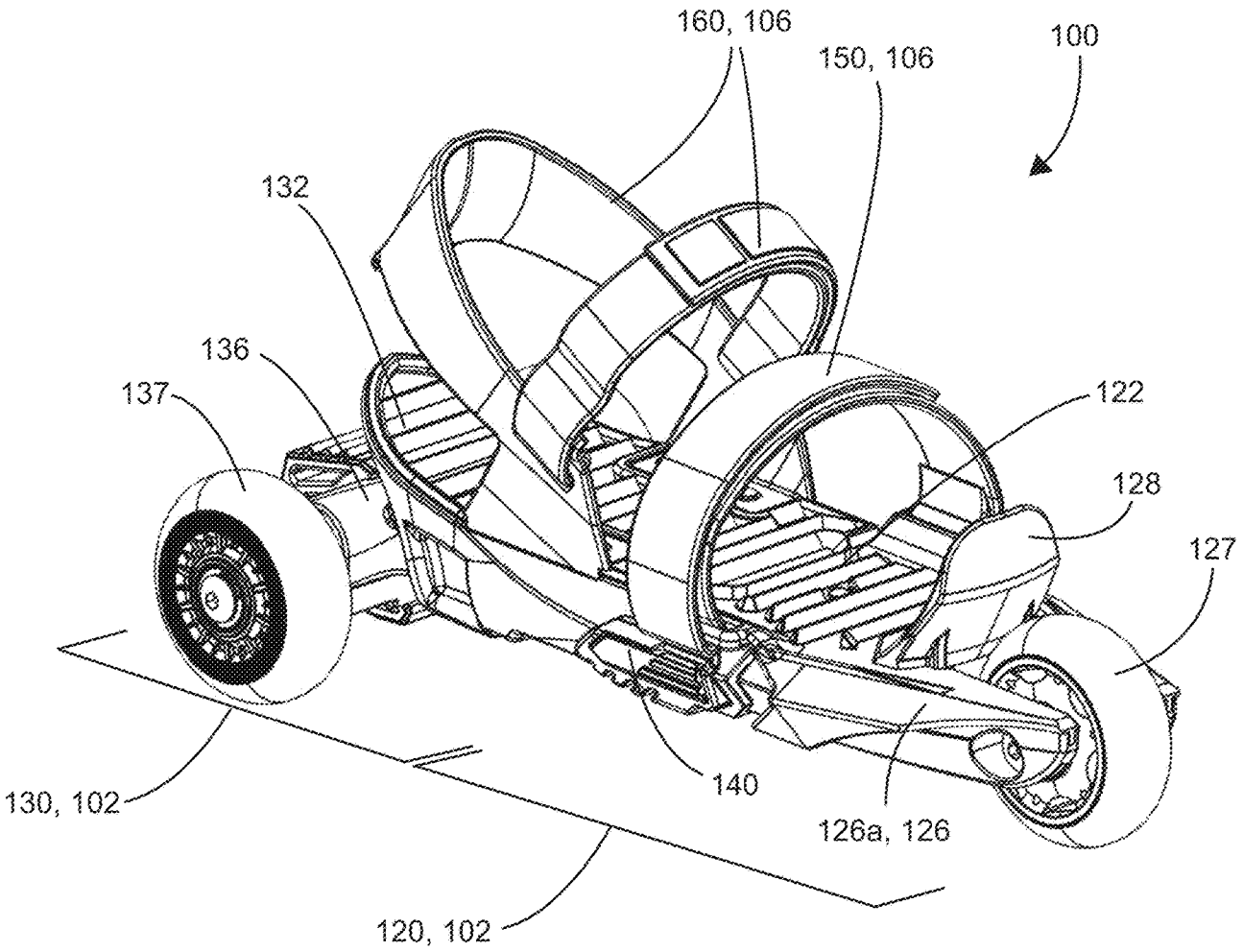
FIG. 3 shows a perspective view of the length-adjustable roller skate of FIG. 1A, where the front foot support structure is in a first position relative to the rear foot support structure.
Figure 4:
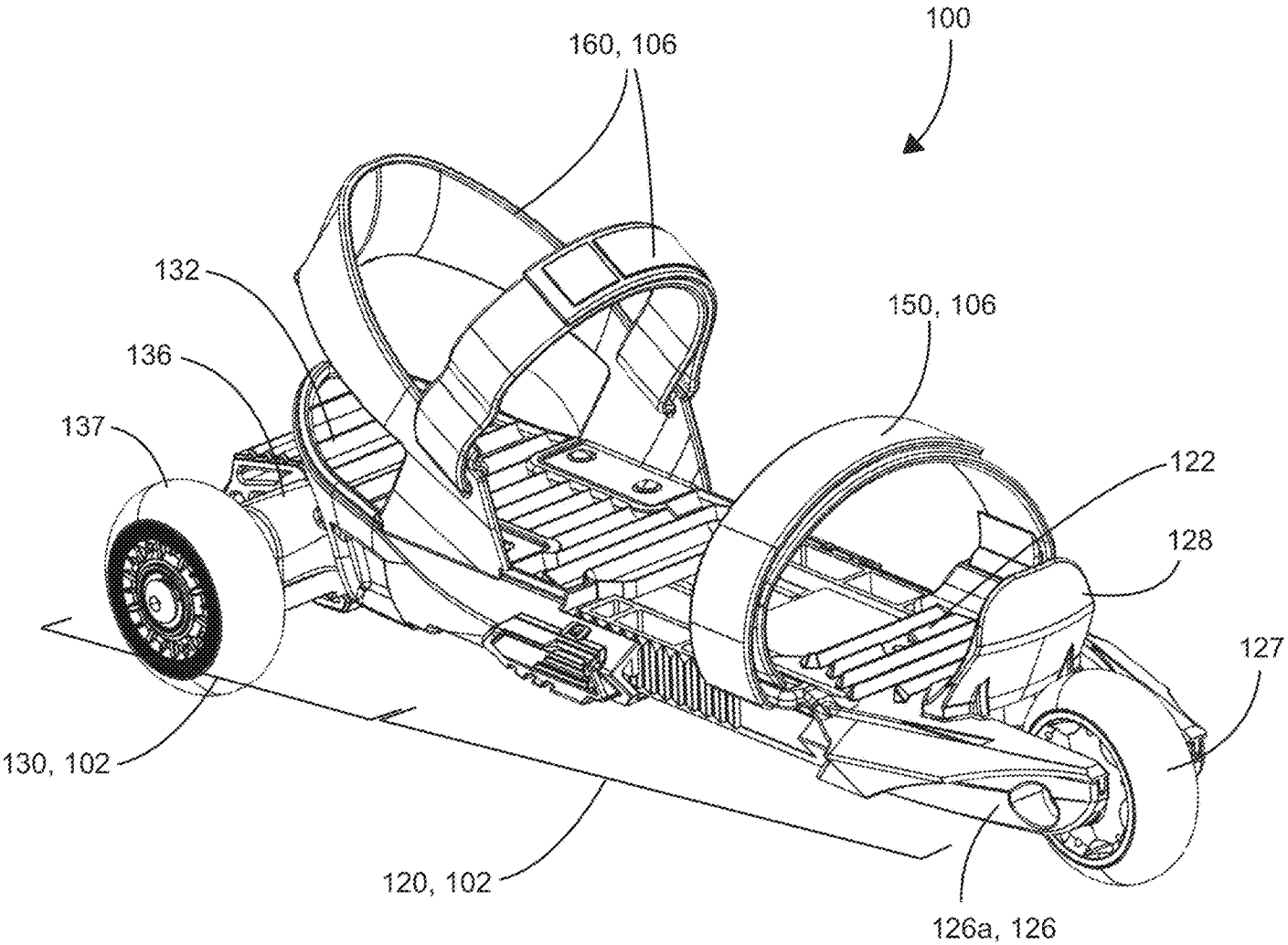
FIG. 4 shows a perspective view of the length-adjustable roller skate of FIG. 1A, where the front foot support structure is in a second position relative to the rear foot support structure.
Figure 6A:
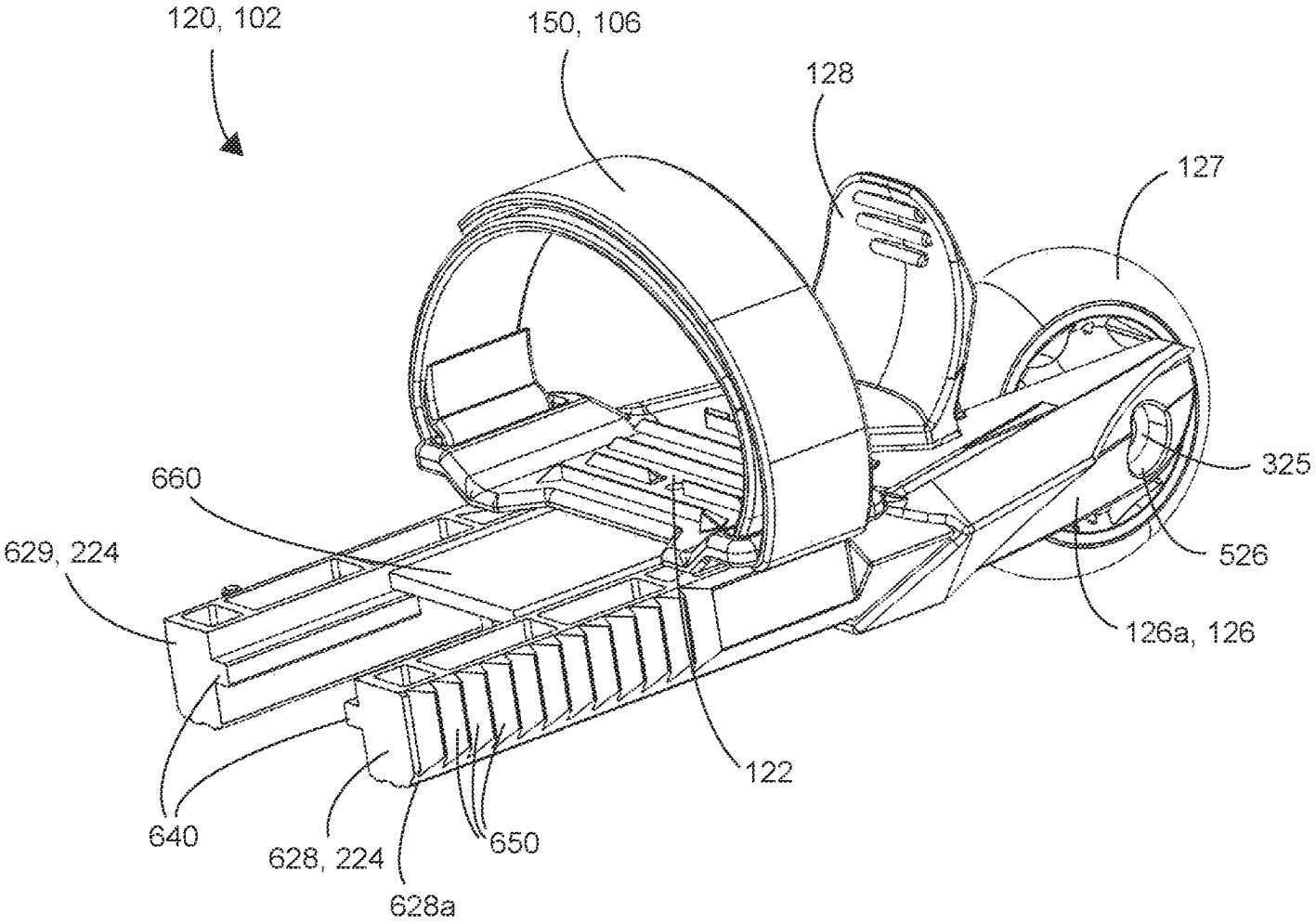
FIG. 6A shows a perspective view of the front foot support structure of the length-adjustable roller skate of FIG. 1A.
Figure 6B:
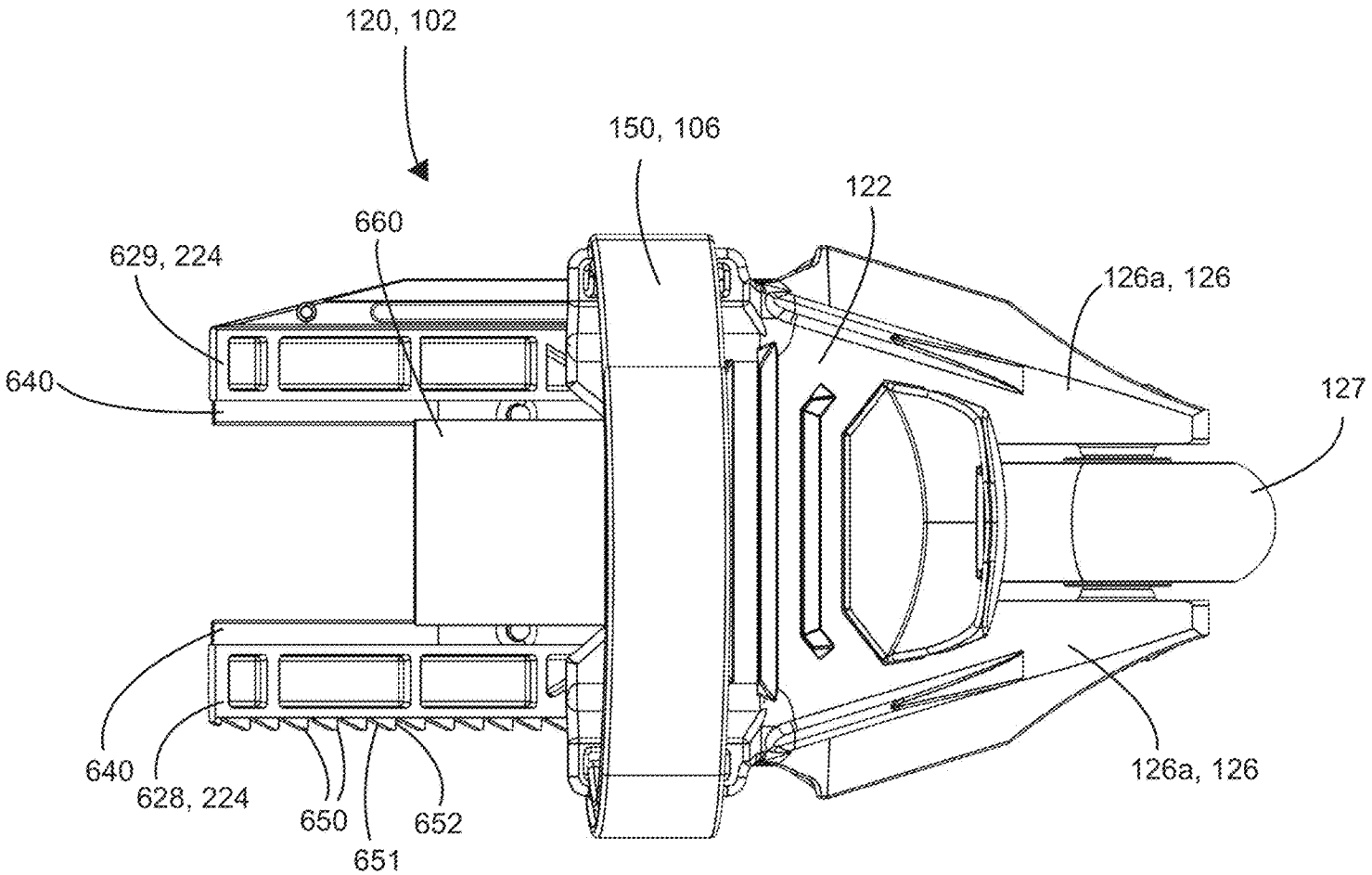
FIG. 6B shows a top view of the front foot support structure of the length-adjustable roller skate of FIG. 1A.

In an embodiment such as provided in FIGS. 2, 6A and 6B the first connector element 224 of the front foot support structure 120 includes first and second parallel bars 628, 629 that extend from a first end of the front foot support structure 120, substantially parallel to a long axis of the front foot support structure 120.

In the specific embodiment provided in FIGS. 2 and 6A and 6B, each of the first and second parallel bars 628, 629 have a substantially rectangular cross-section, and extend horizontally from a rearmost extent of the front foot support structure 120. The front foot support structure 120 also includes a front body engagement plate 660.

In an additional embodiment provided in FIGS. 2 and 6A and 6B, at least one of the first and second parallel bars includes a plurality of ratchet teeth 650 formed along a length thereof. In the specific embodiment provided in FIGS. 2 and 6A and 6B, the plurality of ratchet teeth 650 are formed along a vertical outer wall 628*a* of the first parallel bar 628 and extend along the entire length of the vertical outer wall 628*a*. The plurality of ratchet teeth 650 are oriented to extend vertically along a height of the first parallel bar 628.

Rear Foot Support Structure

Figure 7A:
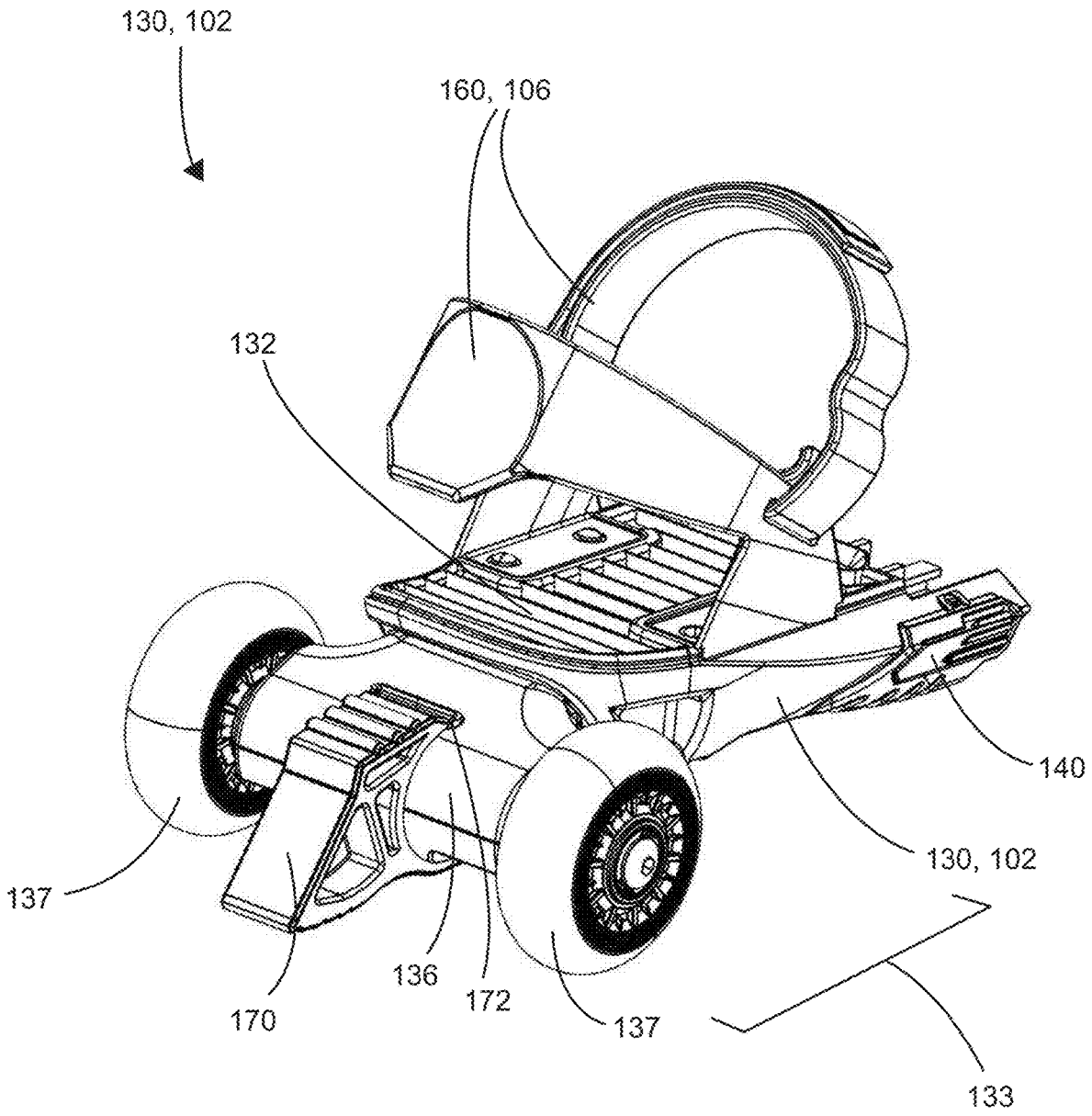
FIG. 7A shows a rear, perspective view of the rear foot support structure of the length-adjustable roller skate of FIG. 1A.
Figure 7B:
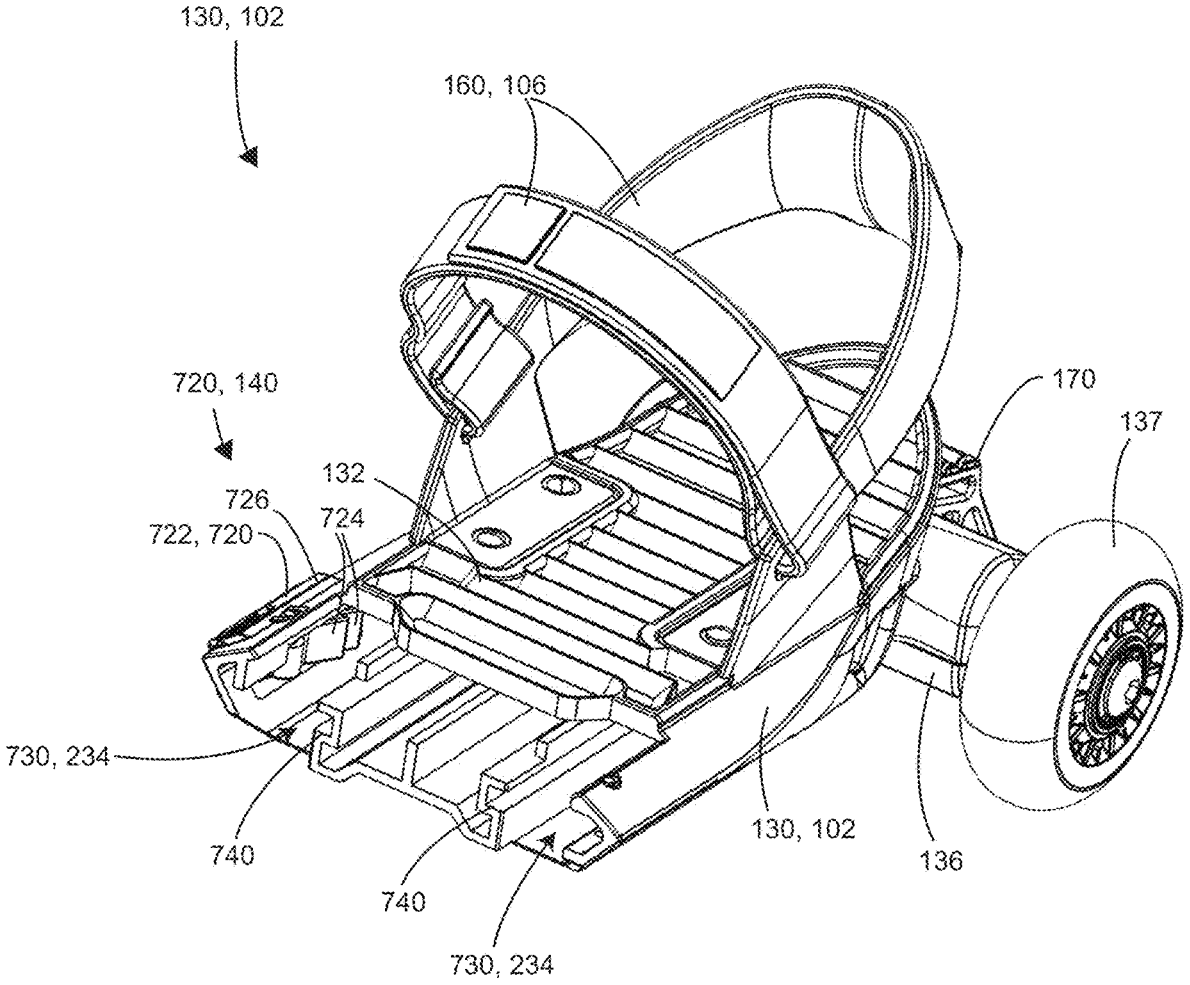
FIG. 7B shows a perspective view of the rear foot support structure of the length-adjustable roller skate of FIG. 1A.

Referring to FIGS. 7A and 7B, the rear foot support structure 130 includes the rear wheel assembly 133, rear sole surface 132 and second connector element 234.

In an embodiment, the rear wheel assembly 133 includes a rear wheel support member 136 and at least one rear wheel 137 that is rotatably mounted to the rear wheel support member 136.

In the specific embodiment provided in FIGS. 1A to 7B, the at least one rear wheel 137 is a pair of rear wheels 137, and the rear wheel support member 136 is a rear wheel truck 136*a* that extends back from a rearmost extent of the rear foot support structure 130. As provided in FIG. 3, the rear wheel truck 136*a* includes a lateral through-aperture 337, and the pair of rear wheels 137 are mounted on opposing ends of a rear axle assembly 333 that is rotatably mounted within the lateral through-aperture 337. In this embodiment, the rear axle assembly 333 includes a rear axle 334, and a pair of rear wheel bearings 335 that are mounted to opposing ends of the rear axle 334 via a pair of rear axle fasteners 336. The bearings 335*m* and opposing ends of the rear axle 334 are disposed in the lateral through-aperture 337 when the rear axle assembly 333 is mounted through the lateral through-aperture 337.

As provided in FIG. 1A, the rear sole surface 132 is positioned on a top surface of the rear foot support structure 130 and extends along a length of the rear foot support structure 130. Like the front sole surface 122, the rear sole surface 132 is structure to limit slippage or front-to-back movement of the footwear of the user while it is partially supported on the rear sole surface 132. In the specific embodiment provided in FIGS. 1A to 5, 7A and 7B, the rear sole surface 132 also includes a plurality of laterally extending ridges that project up from the rear sole surface 132.

In an additional embodiment provided in FIGS. 1A to 1C, 2, 7A and 7B, the rear foot support structure 130 includes a brake member 170 that is mounted thereon. The brake member 170 extends rearwards and downwards from the rear foot support structure 130 and includes a ground contact portion 170*a*. The brake member 170 is mounted on the rear foot support structure 130 such that when a user of the length-adjustable roller skate shifts their weight towards the rear of the length-adjustable roller skate and the skate begins to tilt at and angle from front-to-back, the ground contact portion 170*a* will contact the ground surface on which the user is using the length-adjustable roller skate so as to apply a braking force to the ground surface.

In the specific embodiment provided in FIGS. 1B, 7A and 7B, the brake member 170 is a releasably connectable brake member 170 that includes the ground contact portion 170*a* and a semi-circular connecting bracket 170*b*. The rear wheel truck 136*a* includes a pair of slots 172 disposed on top and bottom sides thereof. The semi-circular connecting bracket 170*b* of the brake member 170 is sized such that opposing ends of the semi-circular connecting bracket 170*b* can be releasably retained in the pair of slots 172 for releasably connecting the brake member 170 to the rear wheel truck 136*a*.

In an embodiment such as provided in FIGS. 2, 7A, 7B, 8A, and 8B, the second connector element 234 includes a pair of parallel channels 730 that extend from an outer surface of the rear foot support structure 130, along a length thereof. The pair of parallel channels 730 of the rear foot support structure 130 are shaped to slidably receive the first and second parallel bars 628, 629 therewithin for movably connecting the front and rear foot support structure 120, 130. In the specific embodiment provided in FIGS. 7A and 7B, the first and second parallel bars 628, 629 and pair of parallel channels 730 are relatively formed such that the front and rear foot support structures 120, 130 are slidably connected.

In an embodiment, the first and second parallel bars 628, 629 of the front foot support structure 120 and pair of parallel channels 730 of the rear foot support structure 130 are correspondingly structured to prevent rotation or twisting of the first and second parallel bars 628, 629 within the pair of parallel channels 730. In the embodiments provided in FIGS. 7A to 8B, each of the pair of parallel channels 730 in the rear foot support structure 130 is structured to include a groove 740, where the groove 740 of each parallel channel 730 is formed on an interior surface of the parallel channel 730 and extends along the length of the parallel channel 730. The first and second parallel bars 628, 629 are also structured such that each of the first and second parallel bars 628, 629 includes a tenon 640 that is formed on a side wall thereof, and that extends along a length thereof. The tenons 640 of the first and second parallel bars 628, 629 are sized to be received within the grooves 740 of the pair of parallel channels 730 as the first and second parallel bars 628, 629 are slidably inserted into the pair of parallel channels 730 so as to substantially prevent twisting of the first and second parallel bars 628, 629 within the pair of parallel channels 730.

As provided above, the adjustment actuator 140 is movably mounted to one of the front foot support structure 120 and the rear foot support structure 130 and is actuatable between the engaged and disengaged positions.

In an embodiment such as provided in FIGS. 7A to 8B, the rear foot support structure 130 includes an actuator mounting aperture 726 that extends from an outer surface of the rear foot support structure 130, to a channel of the pair of parallel channels 170. The actuator mounting aperture 726 is sized to receive the adjustment actuator 140 therein and is structured to permit the adjustment actuator 140 to actuate between the engaged and disengaged positions while remaining at least partially contained in the actuator mounting aperture 726.

Figure 8A:
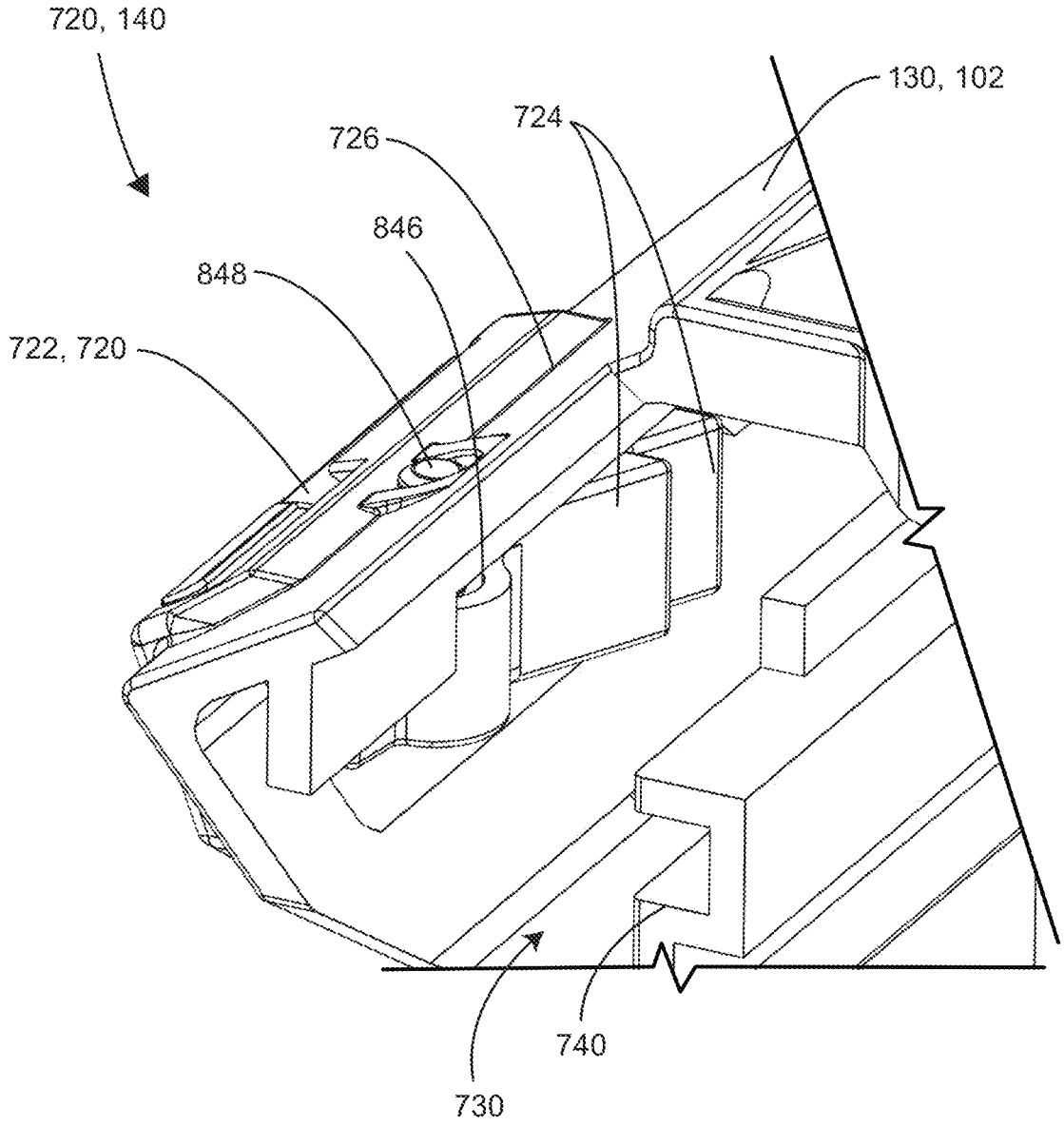
FIG. 8A shows a close-up view of the adjustment actuator on the rear foot support structure of FIG. 7A, where the adjustment actuator is in an unactuated position.
Figure 8B:
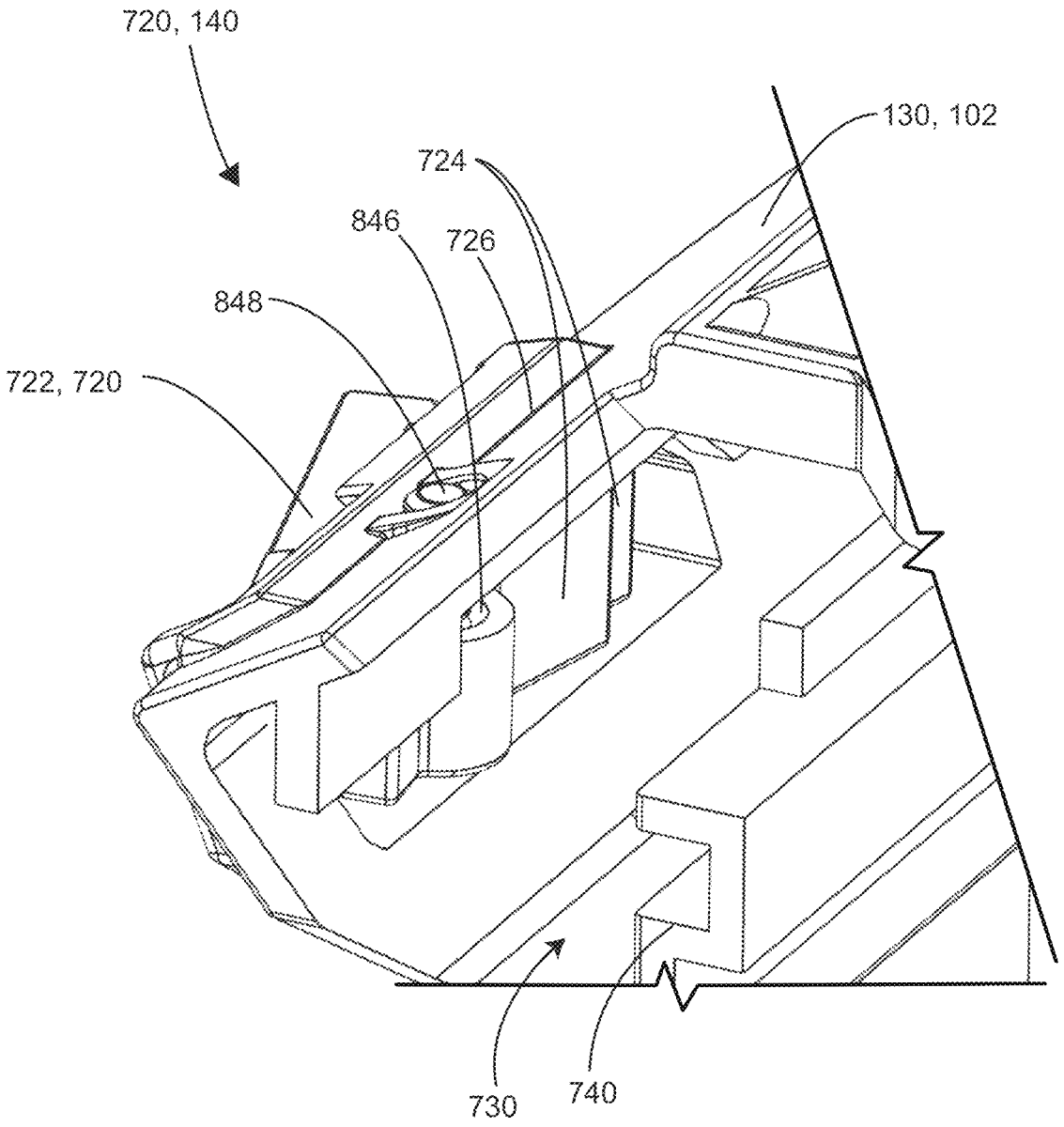
FIG. 8B shows a close-up view of the adjustment actuator on the rear foot support structure of FIG. 7A, where the adjustment actuator is in an actuated position.

Referring to FIGS. 8A and 8B, there is provided an embodiment of the adjustment actuator 140 in the engaged (FIG. 8A) and disengaged (FIG. 8B) positions. The adjustment actuator 140 is movably mounted in the actuator mounting aperture 726 and includes the at least one contact surface 722 and the at least one engagement surface 724. The at least one contact surface 722 is positioned on the adjustment actuator 140 such that when the adjustment actuator 140 is mounted in the actuator mounting aperture 726, the at least one contact surface 722 is exposed on an exterior of the length-adjustable roller-skate such that a user of the skate can contact the contact surface 722. The at least one engagement surface 724 is formed on the adjustment actuator 140 for releasably fixing the relative position of the front and rear foot support structures 120, 130 when the adjustment actuator 140 is in the engaged position.

In an additional embodiment, the length-adjustable roller skate includes a biasing member that is connected to the adjustment actuator 140 and to one of the front foot support structure 120 and rear foot support structure 130 for biasing the adjustment actuator 140 towards the engaged position.

In the embodiments where the front foot support structure 120 includes the first and second parallel bars 628, 629, and where the first parallel bar 628 includes the plurality of ratchet teeth 650, the adjustment actuator 140 will be positioned on the rear foot support structure 130 and will be movably mounted in the actuator mounting aperture 726 of the rear foot support structure 130. The adjustment actuator 140 will be movably mounted in the actuator mounting aperture 726 such that when the adjustment actuator 140 is in the engaged position, the at least one engagement surface 724 of the adjustment actuator 140 will engage at least one of the plurality of ratchet teeth 650 for releasably fixing a position of the front foot support structure 120 relative to the rear foot support structure 130.

In the specific embodiment provided in FIGS. 7A to 8B, the adjustment actuator 140 is a pivotable adjustment actuator 720. The actuator mounting aperture 726 extends horizontally through the rear foot support structure 130. The pivotable adjustment actuator 720 includes an exterior contact surface 722 and a pair of interior engagement surfaces 744 that are shaped to engage at least two of the plurality of ratchet teeth 650. The adjustment actuator 720 includes a mounting hole 846, and a rod 848 that is mounted through the mounting hole 846 and into a through-hole of the actuator mounting aperture 726 such that the pivotable adjustment actuator 720 is pivotably mounted in the actuator mounting aperture 726. The pivotable adjustment actuator 720 can pivot between the disengaged and engaged positions.

In an embodiment, the length-adjustable roller skate is structured such that when the adjustment actuator 140 is in the engaged position, the adjustment actuator 140 will only releasably fix the movement of the front foot support structure 120 and rear foot support structure 130 in one direction relative to each another.

In some embodiments, the movement of the front foot support structure 120 in one direction relative to each other is achieved by structuring the plurality of ratchet teeth 650 with angled surfaces.

In some additional embodiment, the movement of the front foot support structure 120 in one direction relative to each other is achieved by structuring the plurality of ratchet teeth 650 and the at least one engagement surface of the adjustment actuator 140 as angled surfaces.

In an embodiment, the front foot support structure 120, rear foot support structure 130 and plurality of ratchet teeth 650 are formed such that the front foot support structure 120 can be releasably fixed in one of at least four different positions relative to the rear foot support structure 130.

In an embodiment such as provided in FIGS. 6A and 6B, each of the plurality of ratchet teeth 650 include a first side 651 that is disposed at a first angle relative to a long axis of the first parallel bar 628 and a second side 652 that is disposed at a second angle relative to the long axis of the first parallel bar 628. The first angle of the first side 651 is sized such that when the adjustment actuator 140 is in the engaged position, the front foot support structure 120 is prevented from moving in one of the first and second directions relative to the rear foot support structure 130. The second angle of the second side 652 is sized such that when the adjustment actuator 140 is in the engaged position, the front foot support structure 120 is movable in the other of the first and second directions relative to the rear foot support structure 130.

In an additional embodiment, the length-adjustable roller skate is specifically structured such that when the adjustment actuator 140 is in the engaged position, the front foot support structure 120 can be moved towards the rear foot support structure 130 in the second direction relative to the rear foot support structure 130, but the front foot support structure 120 cannot be moved away from the rear foot support structure 130 in the first direction relative to the rear foot support structure 130 (i.e., the distance between the front sole surface 122 and the rear sole surface 132 can be decreased, but the distance between the front sole surface 122 and the rear sole surface 132 cannot be increased). In some embodiments, this functionality is achieved by specifically orienting the angled first and second sides 651, 652 of the plurality of ratchet teeth 650. In one such embodiment provided in FIGS. 6A and 6B, the second side 652 of each of the plurality of ratchet teeth 650 is formed on a rearward side of each of the plurality of ratchet teeth 650 such that when the adjustment actuator 140 is in the engaged position, the front foot support structure 120 cannot be moved in the first direction relative to the rear foot support structure 130, but can be moved in the second direction relative to the rear foot support structure 130. By providing a structure of the adjustment actuator 140 and plurality of ratchet teeth 650 that limits the movement of the front foot support structure 120 in the first direction relative to the rear foot support structure 130, while allowing movement of the front foot support structure 120 in the second direction relative to the rear foot support structure 130, an overall length of the support surface 104 is more easily adjusted by a user while the footwear of the user is supported on the support surface 104.

In adjusting the length of the length-adjustable roller skate, the user can first actuate the adjustment actuator 140 to the disengaged position and move the front foot support structure 120 in the first direction relative to the rear foot support structure 130 to increase the distance between the front and rear sole surfaces 122, 132. The user can move the front foot support structure 120 until there room for the footwear of the user to rest on the front and rear sole surfaces 122, 132 with a space between a toe of the footwear of the user and the toe support member 128. The adjustment actuator 140 can then be actuated back to the engaged position. With the adjustment actuator 140 in the engaged position, the user cannot move the front foot support structure 120 any further in the first direction. To adjust the length of the length-adjustable skate to more securely fit the footwear of the user, the user can then move the front foot support structure 120 in the second direction relative to the rear foot support structure 130 (thereby decreasing the distance between the front and rear sole surface 122, 132) until the toe support member 128 firmly abuts the toe of the footwear of the user. As provided above, the structure of the first and second sides 651, 652 of the plurality of ratchet teeth 650 enables the movement of the front foot support structure 120 in the second direction even when the adjustment actuator 140 is in the engaged position.

In an additional embodiment such as provided in FIGS. 8A and 8B, the at least one engagement surface 724 of the adjustment actuator 140 can be structured as a plurality of angled engagement surfaces, where an angle of each of the plurality of angled engagement surfaces corresponds to the second angle of the second side 652 of each of the plurality of ratchet teeth 650.

In an alternate embodiment, one of the pair of parallel channels 730 of the rear foot support structure 130 includes a plurality of ratchet teeth 650 formed along a length thereof. The adjustment actuator 140 is movably mounted on the front foot support structure 120, and the adjustment actuator 140 is positioned on the front foot support structure 120 such that when the adjustment actuator 140 is in the engaged position, the adjustment actuator 140 engages at least one of the plurality of ratchet teeth 650 of the rear foot support structure 130 for releasably fixing the front foot support structure 120 relative to the rear foot support structure 130.

Referring to FIGS. 1A to 4A, the length-adjustable roller skate is provided with distinct front and rear securing elements 150, 160 for securing the footwear of a user to the front and rear sole surfaces 122, 132, respectively. By providing separate front and rear securing elements 150, 160 on the front and rear foot support structures 120, 130 the length-adjustable roller skate can realize a high-degree of length-adjustability. Unlike a roller skate that is provided with a boot, the separate front and rear securing elements 150, 160 of the length-adjustable roller skate will secure the footwear of a user, while providing length-adjustability over both a large range and large number of distinct, relative positions of the front and rear sole surfaces 122, 132.

In an embodiment, the at least one front securing element 150 includes at least one front securing strap that is connected to the front foot support structure 120 and extends over the front sole surface 122 for releasably attaching the footwear of a user to the front sole surface 122. The at least one securing strap can be various known securing straps that can be separated and rejoined, such as a two-end Velcro™ strap (or any other suitable hook-and-loop fastener strap).

In the specific embodiment provided in FIGS. 2 to 4A, the at least one front securing strap is a single front securing strap. The front foot support structure 120 includes a pair of connecting flanges 252 that extend upwards from the front foot support structure 120, on laterally opposing sides of the front sole surface 122. Each of the pair of connecting flanges 252 includes a slot formed therethrough and the front securing strap is looped around the slot of each connecting flange, and the two ends of the front securing strap are secured together over the front sole surface 122.

In an additional embodiment, the at least one rear securing element 160 includes at least one rear securing straps that is connected to the rear foot support structure 130 and extends over the rear sole surface 132 for releasably attaching the footwear of a user to the rear sole surface 132. In the specific embodiment provided in FIGS. 2 to 4A, the at least one rear securing strap is a pair of rear securing straps that includes a main rear strap 260*a* and an ankle strap 260*b*. The main rear strap 260*a* include two strap halves and the ankle strap 260*b* is formed as a continuous strap. The rear foot support structure 130 includes a pair of rear connecting flanges 262 that extend upwards from laterally opposing sides of the rear sole surface 132. Each of the pair of rear connecting flanges 262 includes a slot formed therethrough. One of the two strap halves of the main rear strap 260*a* is looped around the slot of each connecting flange 262, and the two strap halves of the main rear strap 260*a* are secured together over the rear sole surface 132. The ankle support strap 260*b* is connected between the pair of rear connecting flanges 262 and extends at an angle towards the rear of the skate body 102.

Modular Roller Skate with Removable Rear Wheel Truck

Referring to FIGS. 9A to 15, a second embodiment of the multi-part roller skate 100 is provided, where the multi-part roller skate 100 is a modular roller skate including the skate body. In this embodiment, the skate body 102 includes a front wheel support structure and a rear wheel support structure. The skate body 102 of the modular roller skate also includes the support surface 104 in the form of a sole support surface, as well as the at least one of adjustable securing element 106 for releasably holding the footwear of a user against the support surface 104.

In some embodiments of the modular roller skate, the front wheel support structure of the skate body 102 is defined by the section of the skate body 102 to which the at least one front wheel 127 is rotatably connected, and the rear wheel support structure of the skate body 102 is defined by the section of the skate body 102 to which the at least one rear wheel 137 is rotatably connected.

In an embodiment, the front wheel support structure of the skate body 102 includes the front wheel assembly 123, and the front wheel assembly 123 includes a front wheel support 926 formed on the front wheel support structure of the skate body 102, and a single front wheel 127 that is rotatably mounted to the front wheel support 926. The rear wheel support structure is comprised of a removable rear wheel assembly 940 that includes a rear wheel support 943 and a pair of the rear wheels 137 which are rotatably mounted to the rear wheel support 943 and which are laterally spaced apart about the rear wheel support 943 for laterally stabilizing the skate body 102 in a lateral-vertical plane. The modular roller skate also includes an engagement structure 910 that is formed for releasably mounting the removable rear wheel assembly 940 to the skate body 102 such that a rotational axis of the pair of rear wheels 127 is parallel to the rotational axis of the single front wheel 127. In some embodiments, the engagement structure 910 includes a first mounting element 932 formed on the skate body 102 and a second mounting element 942 formed on the rear wheel assembly 940.

Figure 9A:
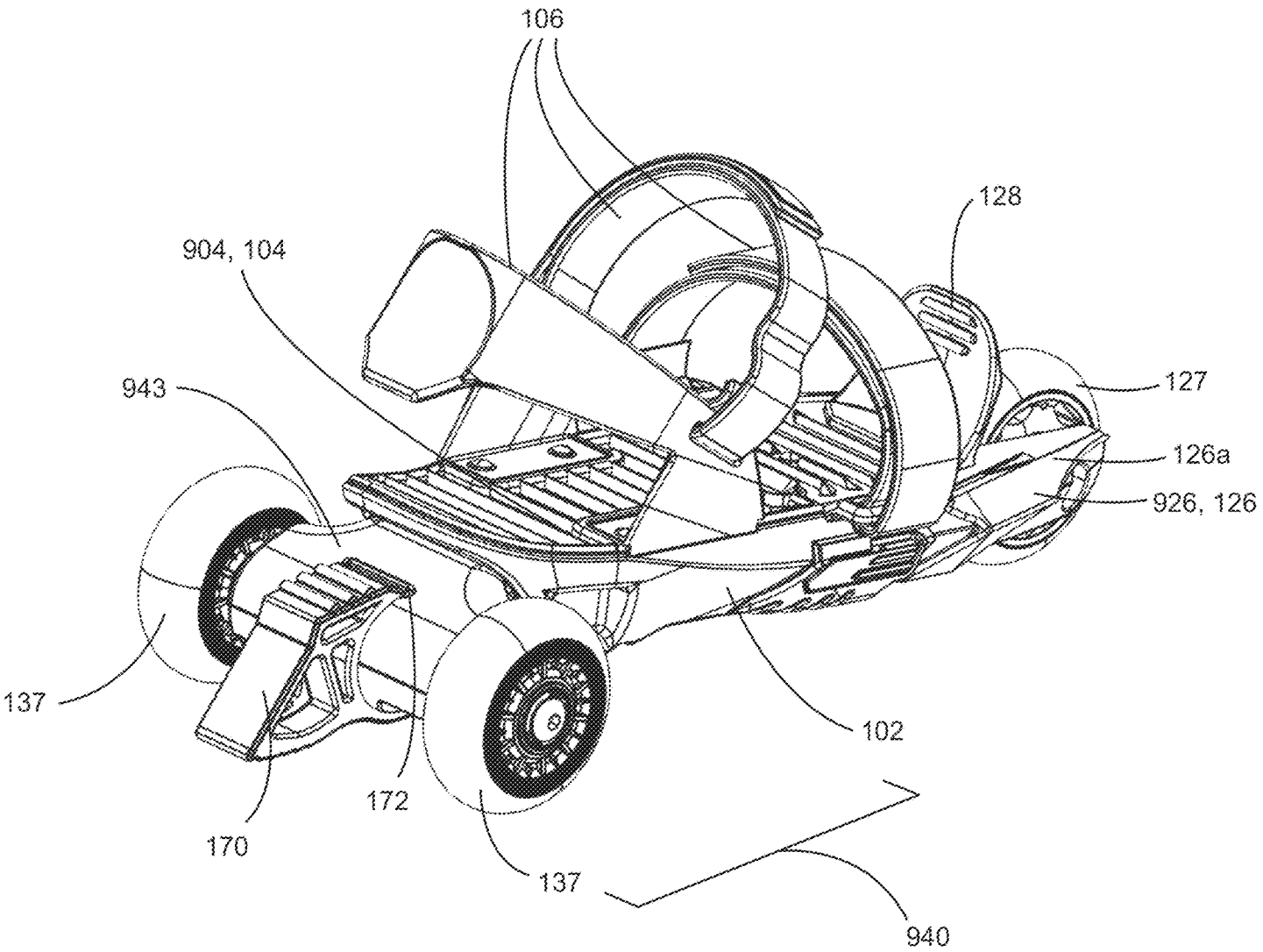
FIG. 9A shows an isometric view of a modular roller skate in accordance with an embodiment of the disclosure.
Figure 9B:
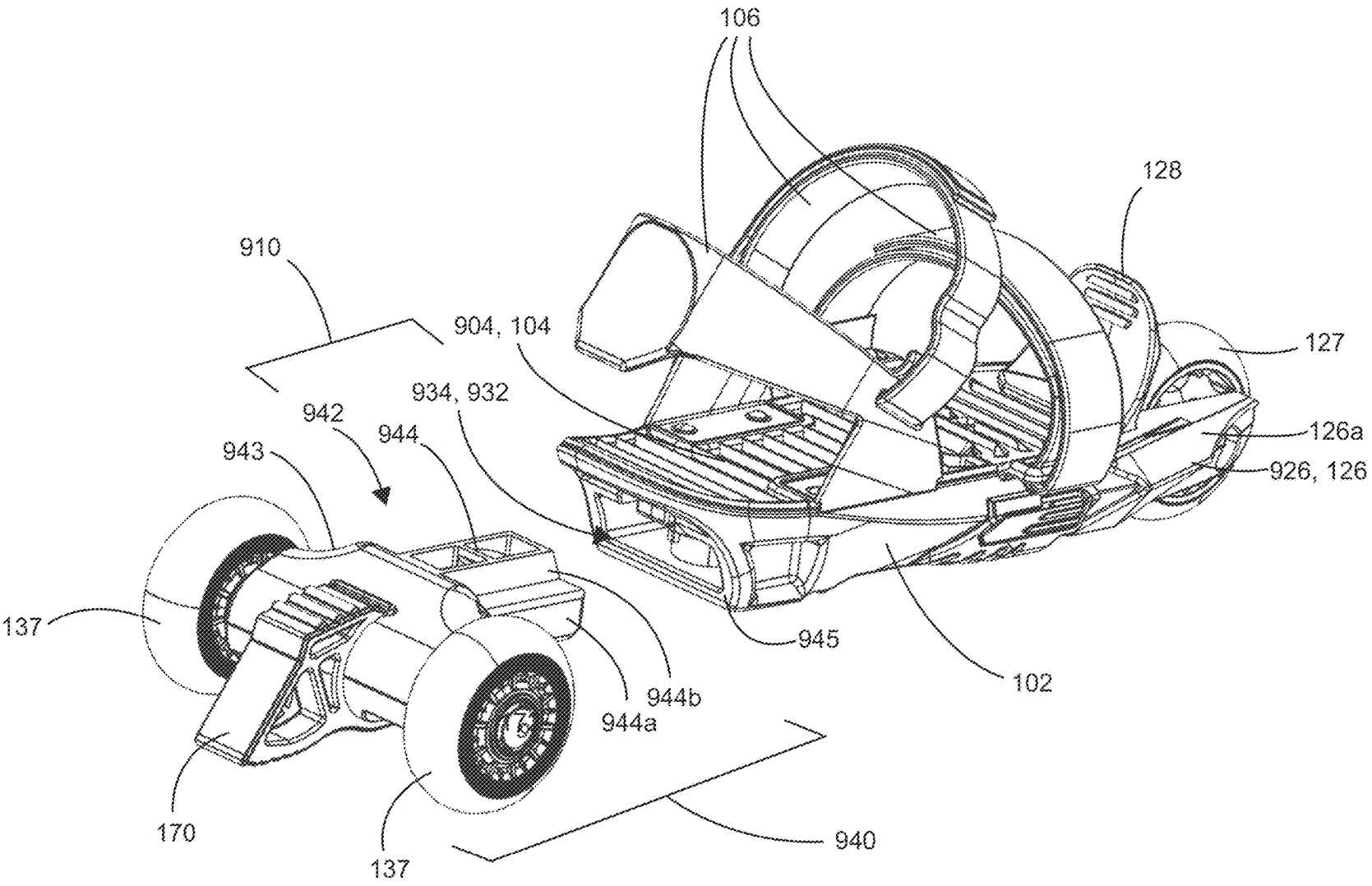
FIG. 9B shows a perspective view of the modular roller skate of FIG. 9A, where the removable rear wheel assembly is separate from the skate body.

In an embodiment such as provided in FIGS. 9A and 9B where the multi-part roller skate 100 is the modular roller skate, the front wheel assembly 123 of the modular roller skate can comprise one or more aspects of the front wheel assembly 123 from the front foot support structure 120 of the length-adjustable roller skate, including the front support frame 126 with the pair of frame arms 126*a*, but need not comprise the front securing elements 106 and the first connector element 224 of the front foot support structure 120. In the specific embodiment provided in FIGS. 9A and 9B, the front wheel support 926 is the front support frame 126 with the pair of frame arms 126, and the single front wheel 127 is rotatably mounted between the pair of frame arms 126*a*.

Figure 10:
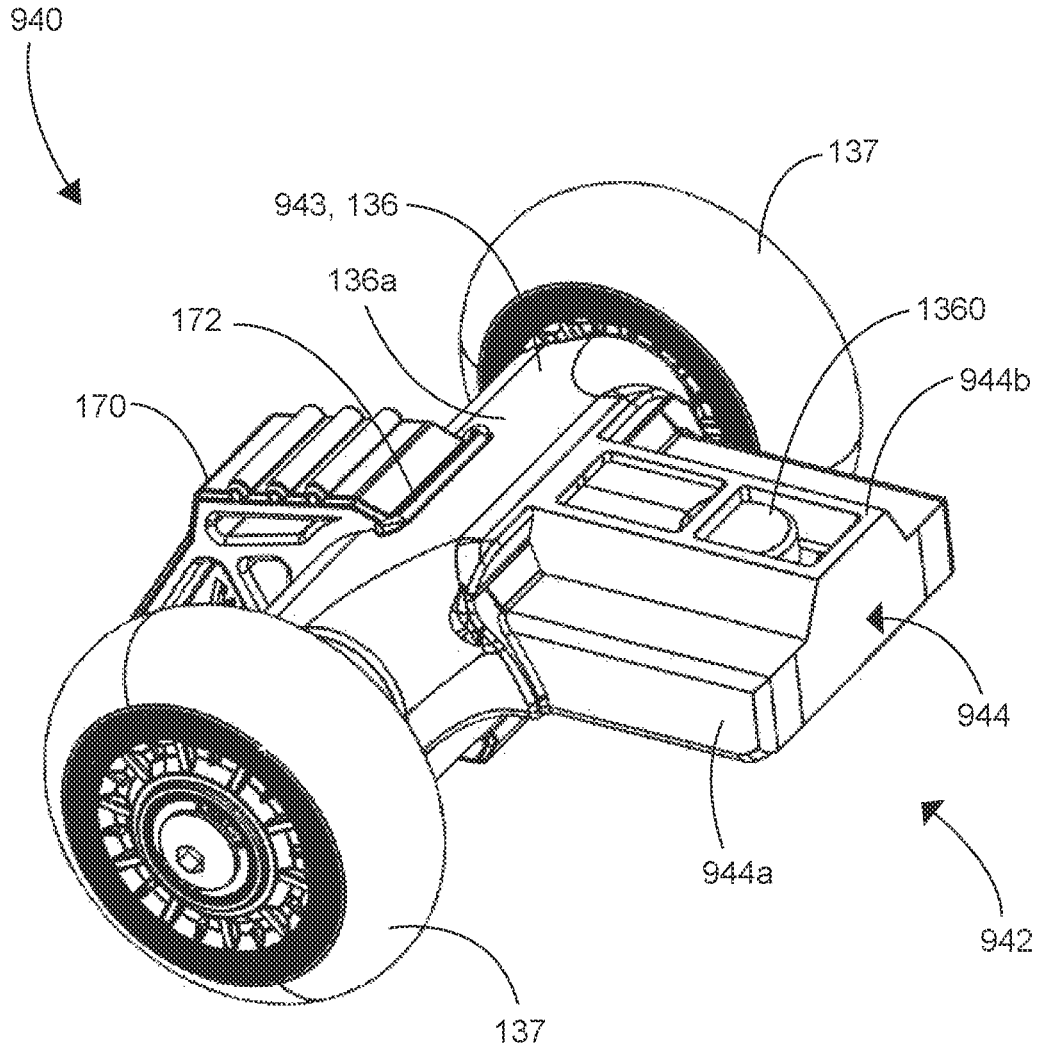
FIG. 10 shows a perspective view of the removable rear wheel assembly of the modular roller skate of FIG. 9A.

In an embodiment such as provided in FIGS. 9A, 9B, and 10 where the multi-part roller skate 100 is the modular roller skate, the removable rear wheel assembly 940 of the modular roller skate can comprise one or more aspects of the rear wheel assembly 133 of the rear foot support structure 130 of the length-adjustable roller skate, including the rear wheel truck 136*a* that includes the lateral through-aperture 337, and the rear axle assembly 333 to which the pair of rear wheels 137 are rotatably mounted.

In some embodiments, the modular roller skate is specifically configured with the pair of rear wheels 137 within the removable rear wheel assembly 940 to laterally stabilize the skate body 102 in the lateral-vertical plane. This stabilization may be useful due to the absence of ankle support in some embodiments of the at least one securing element 106 of the multi-part roller skate 100. In the embodiments where the at least one securing element 106 includes at least one securing strap, the at least one securing strap may not provide sufficient ankle support such that a user of the multi-part roller skate 100 can be sufficiently balanced when the removable rear wheel assembly 940 includes only one rear wheel 137. By providing a pair of rear wheels 137 that are laterally spaced-apart about the rear wheel support 943, the modular roller skate will laterally support the skate body 102, and thereby support the ankle of a user without requiring a boot-type structure of the skate body 102.

In an embodiment of engagement structure 910 provided in FIGS. 9A and 9B, the engagement structure 910 is formed to include a receiving cavity 934 that is formed in one of the skate body 102 and the removable rear wheel assembly 940 such that the receiving cavity 934 constitutes either the first or second mounting elements 932, 942. The receiving cavity 934 extends inwards from a first outer surface of the one of the skate body 102 and the removable rear wheel assembly 940. The engagement structure 910 also includes an engagement projection 944 that is formed in the other of the skate body 102 and the removable rear wheel assembly 940 such that the engagement projection 944 constitutes the other of the first and second mounting elements 932, 942. The engagement projection 944 extends out from the other of the skate body 102 and removable rear wheel assembly 940, and that is sized to be releasably received in the receiving cavity 934.

In the specific embodiment provided in FIG. 9B, the receiving cavity 934 of the engagement structure 910 is formed in a rear surface 945 of the skate body 102 as the first mounting element 932 and extends from the rear surface 945 towards a front of the skate body 102. The engagement projection 944 is formed on a front end of the removable rear wheel assembly 940 as the second mounting element 942 and extends forward from a front end of the removable rear wheel assembly 940. The engagement projection 944 has a polygonal-cross sectional shape that includes a lower section 944*a* with a substantially rectangular cross-section, and an upper section 944*b* with a trapezoidal cross section that defines a pair of slanted lateral sides. The receiving cavity 934 has a cross-sectional shape that corresponds to that of the engagement projection 944, including an upper cavity portion with a trapezoidal cross-section, and a lower cavity portion with a substantially rectangular cross-section.

Figure 11:
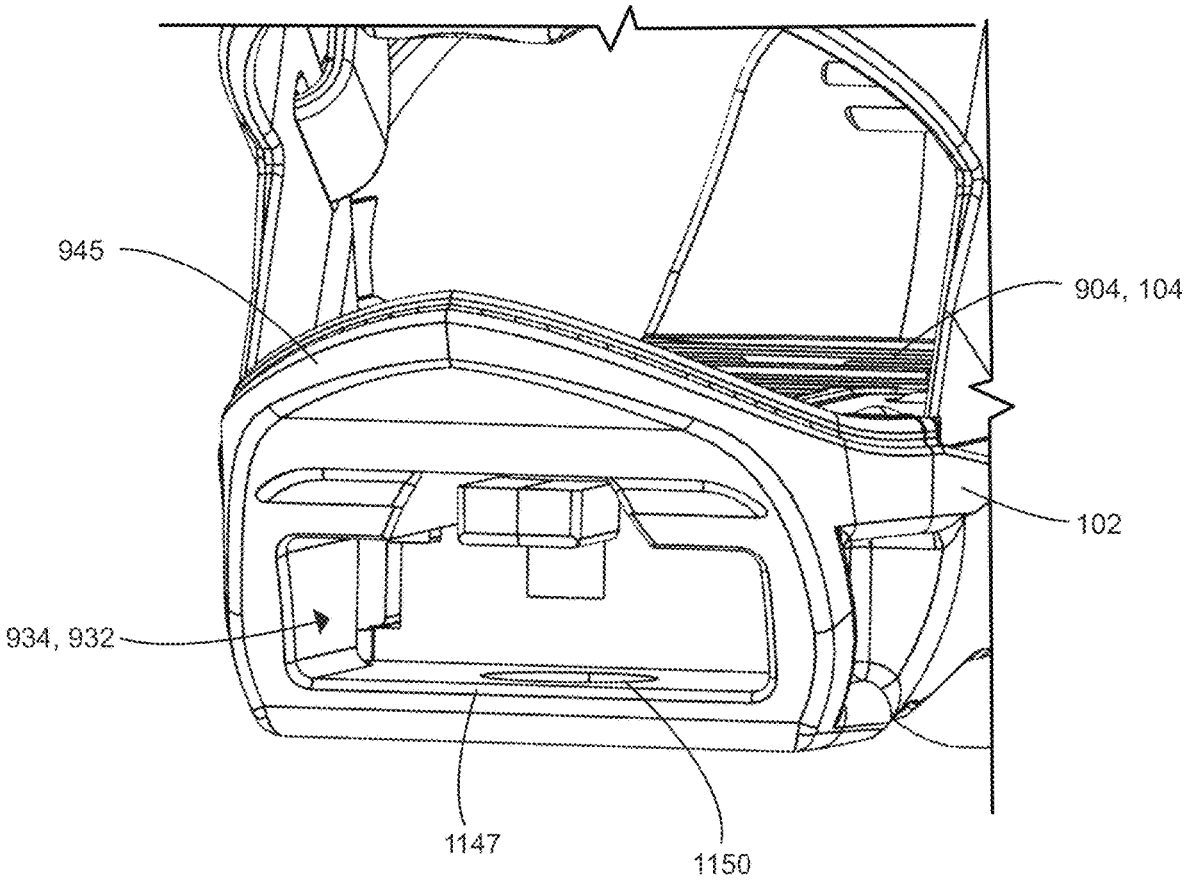
FIG. 11 shows a perspective view of the skate body and receiving cavity of the modular roller skate of FIG. 9A.

In an additional embodiment such as provided in FIG. 11, the receiving cavity 934 also includes a through-aperture 1150 that extends between the receiving cavity 934 and a second outer surface of the one of the skate body 102 and the removable rear wheel assembly 940. The through-aperture 1150 is provided for receiving a flange, button, snap-lock or a similar structure that extends out from a surface of the engagement projection 944 in order to releasably secure the engagement projection 944 within the receiving cavity 934, and thereby "lock" the removable rear wheel assembly 940 to the skate body 102.

In an embodiment provided in FIGS. 12A to 15, the engagement projection 944 includes an engagement button 1220 that is sized to be received in the through-aperture 1150 for securing the engagement projection 944 within the receiving cavity 934. In this embodiment, the engagement button 1220 is mounted on the engagement projection 944 and is movable between an unactuated (see FIG. 12A) and an actuated position (see FIG. 12B).

Figure 12A:
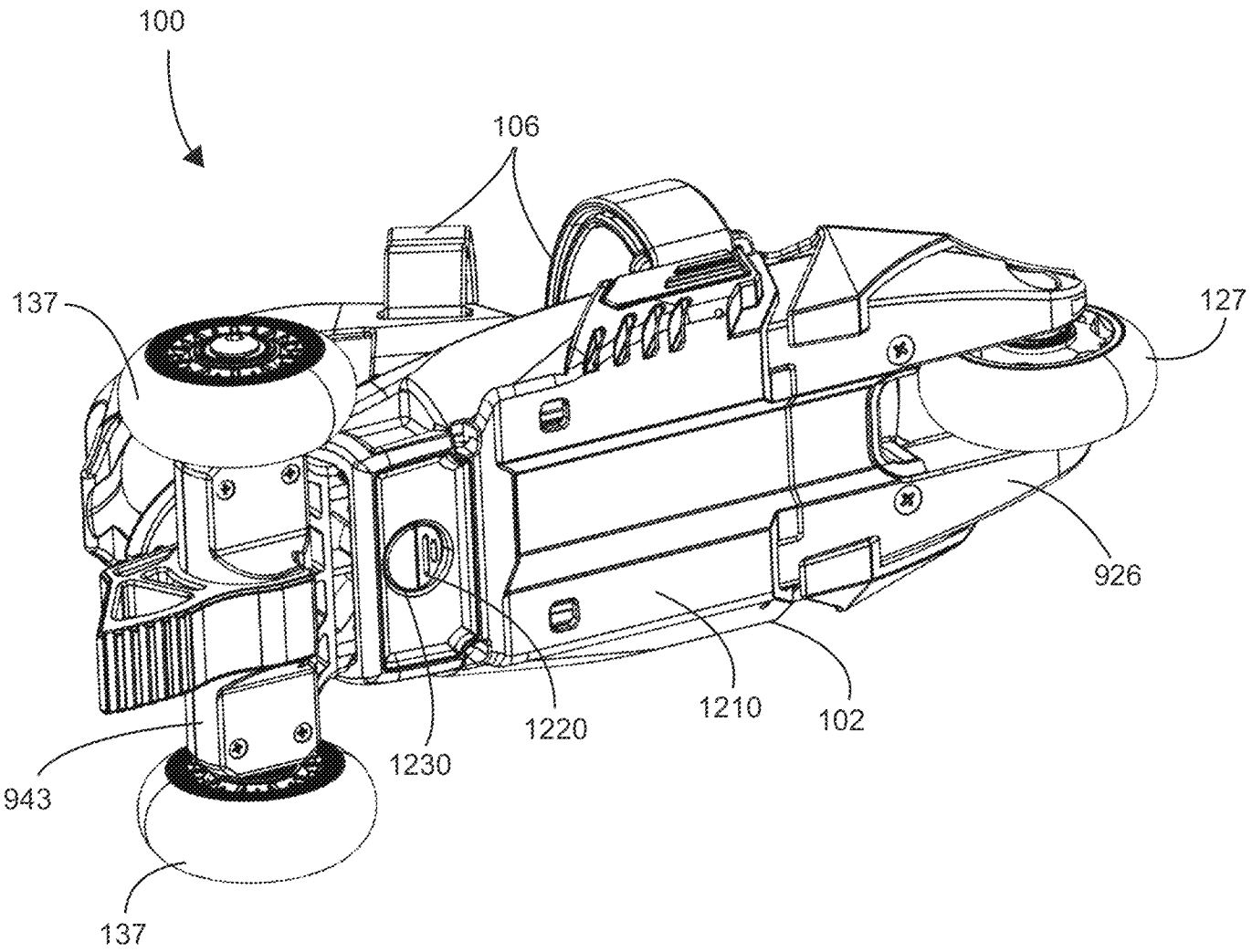
FIG. 12A shows a perspective view of a bottom side of the modular roller skate of FIG. 9A, where the engagement button is in an unactuated position.
Figure 12B:
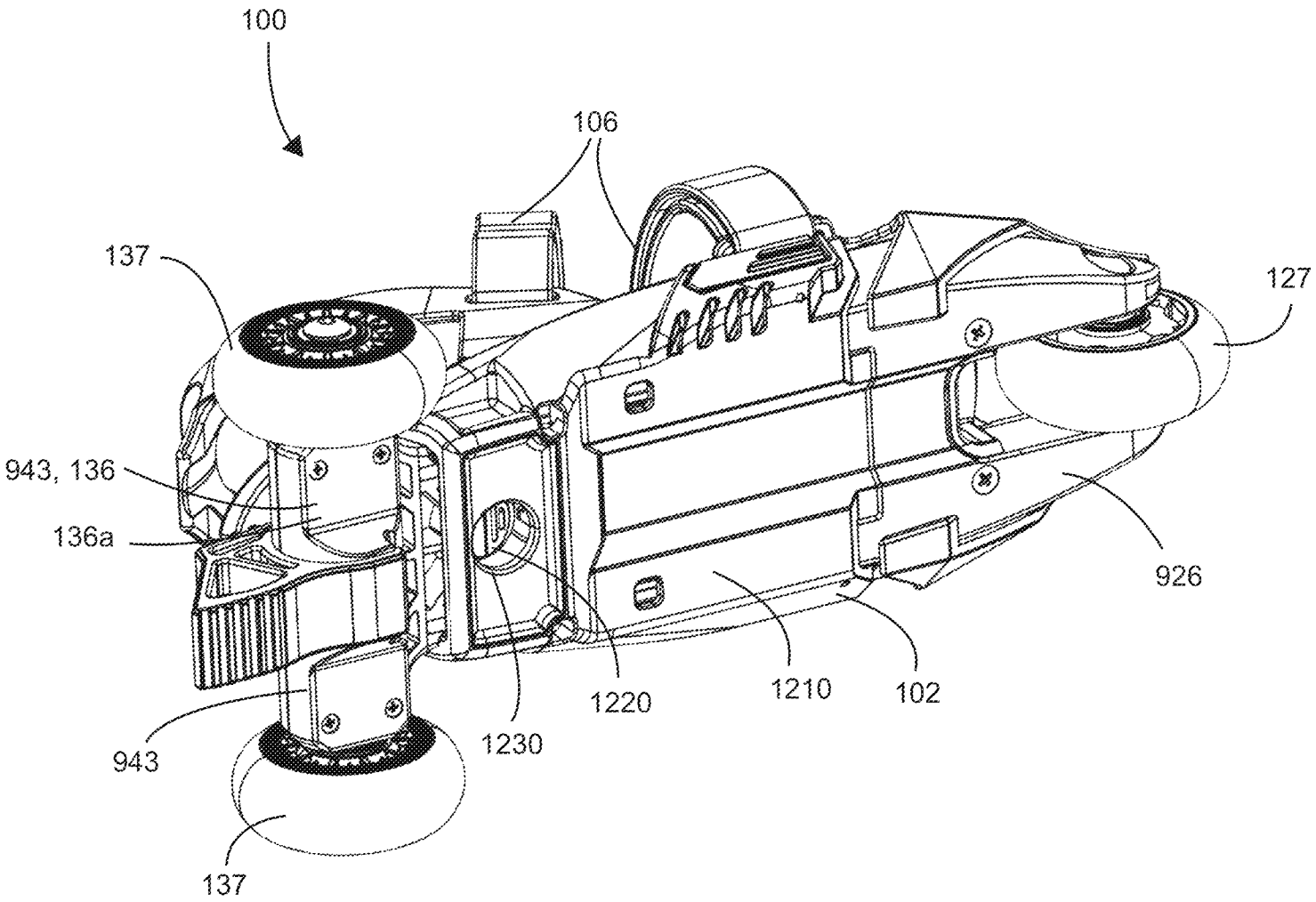
FIG. 12B shows a perspective view of a bottom side of the modular roller skate of FIG. 9A, where the engagement button is in an actuated position.

In the specific embodiment provided in FIGS. 12A and 12B, the unactuated position is defined by a position of the button 1220 where a top surface 1222 of the button 1220 is substantially flush with a bottom surface of the skate body 102, and the actuated position is defined by a position where the top surface 1222 of the button 1220 is recessed relative to the bottom surface of the skate body 102. As provided in FIG. 11, the through-aperture 1150 extends from the bottom surface of the skate body 102 to a bottom surface of the receiving cavity 934.

In an additional embodiment, the engagement button 1220 includes at least one internal biasing element for internally biasing the engagement button 1220 towards the unactuated position. The at least one internal biasing element is connected within the engagement button 1220 such that as the engagement projection 944 is inserted in the receiving cavity 934, the engagement button 1220 will be driven towards the actuated position. The connection of the internal biasing element within the engagement button 1220 is also formed such that as the engagement projection 944 is fully inserted in the receiving cavity 934 and the engagement button 1220 becomes aligned with the through-aperture 1150, the engagement button 1220 will be biased from the actuated to the unactuated position and at least partially extend into the through-aperture 1150 for releasably locking the engagement projection 944 with the receiving cavity 934.

In an additional embodiment such as provided in FIG. 12A to 15, the engagement projection 944 includes a receiving aperture 1230 formed on a surface of the engagement projection 944. The engagement button 1220 is movably retained within the receiving aperture 1230 for moving between the actuated and unactuated positions. The receiving aperture 1230 of the engagement projection 944 can also be formed to accommodate both the engagement button 1220 and the at least one biasing element of the engagement button 1220 such that the at least one biasing element can be connected between the receiving aperture 1230 and the engagement button 1220 for biasing the engagement button 1220 towards the unactuated position.

In the specific embodiment provided in FIGS. 12B, 13, 14A, 14B, and 15 the receiving aperture 1230 has a substantially circular cross-section and is formed on the bottom surface of the skate body 102, and the engagement button 1220 is formed with a circular cross-section and a generally cylindrical shape so as to be slidably moved within the receiving aperture 1230 of the engagement projection 944.

Figure 13A:
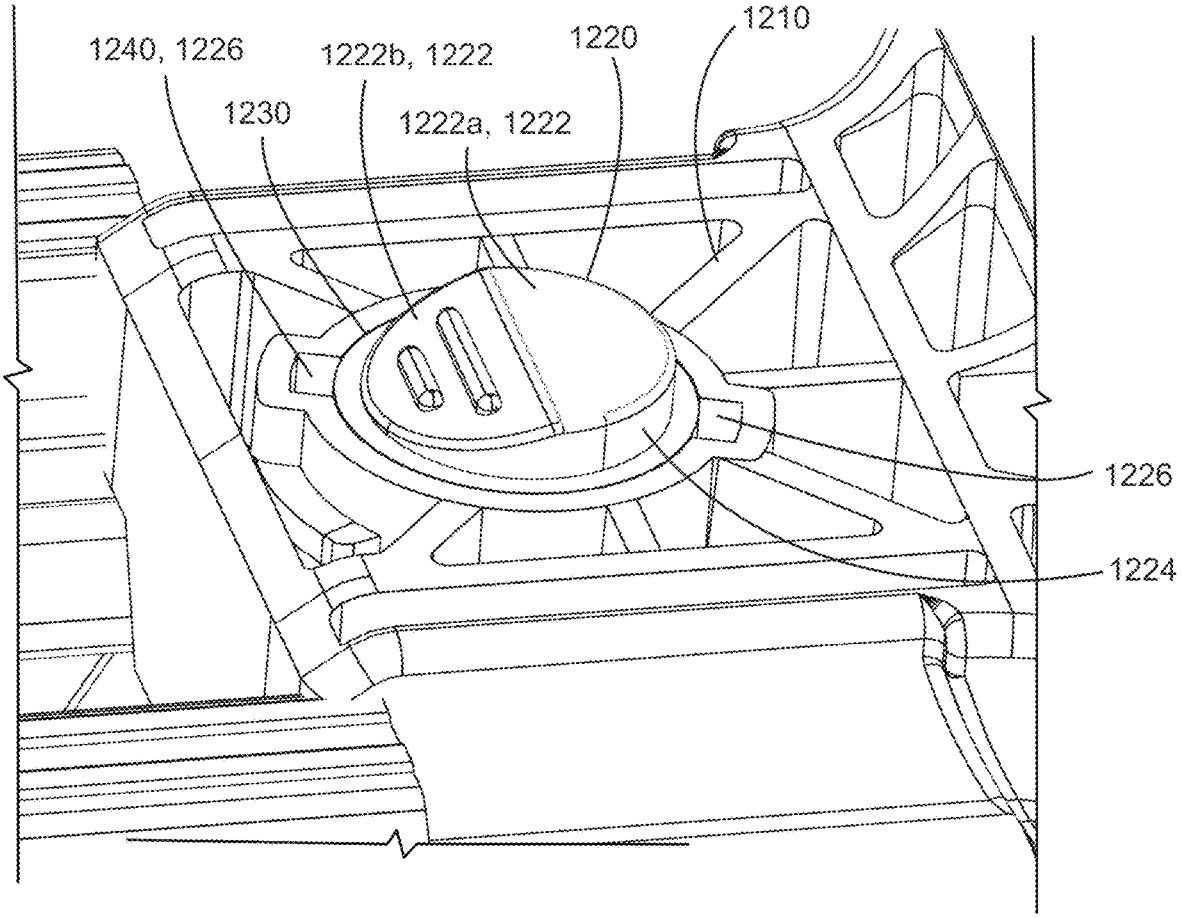
FIG. 13A is a perspective view of the engagement button mounted within the receiving aperture of the modular roller skate of FIG. 9A.
Figure 13B:
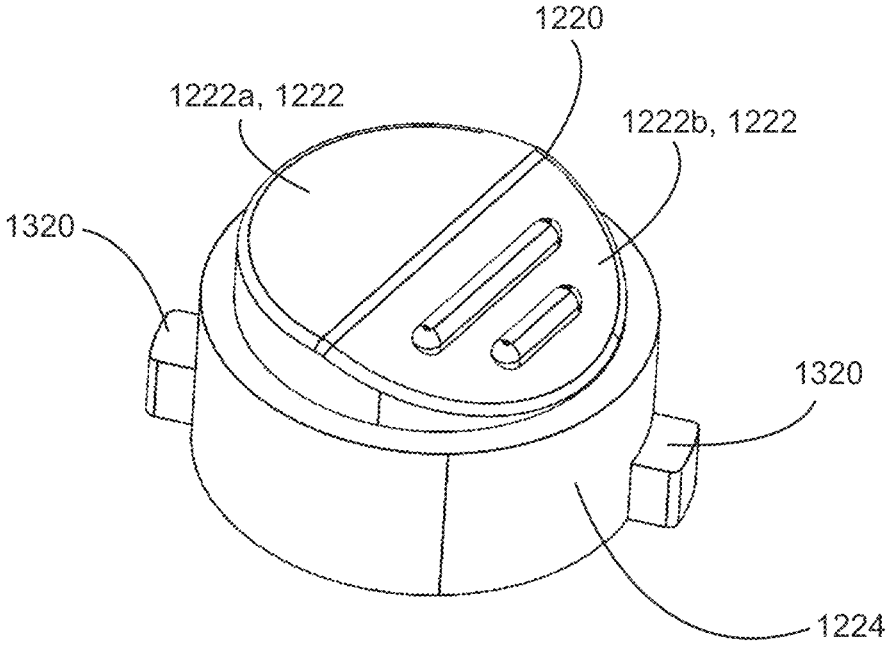
FIG. 13B is an isometric view of the engagement button from the modular roller skate of FIG. 9A.
Figure 15:
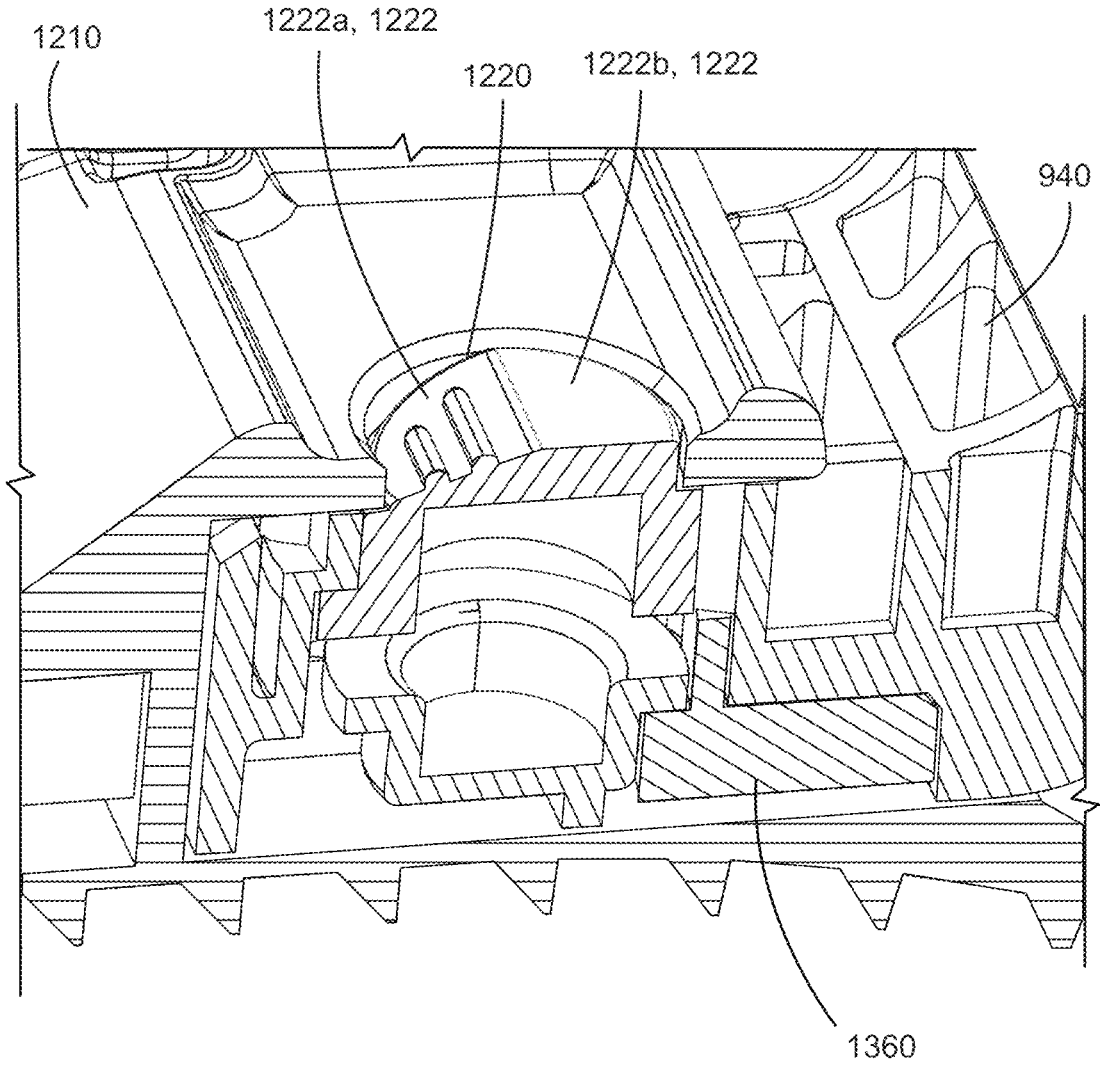
FIG. 15 is a section view of the engagement button and receiving aperture in the modular roller skate of FIG. 9A.

In an additional embodiment provided in FIGS. 13A, 13B and 15, the engagement button 1220 includes a top surface 1222 with two separate, semi-cylindrical halves. The two separate, semi-cylindrical halves include a first, semi-cylindrical section 1222*a* that is formed as a flat, semi-cylindrical face, and a second, semi-cylindrical section 1222*b* that is formed as an angled semi-cylindrical face that extends downwards at an acute angle relative to the first, semi-cylindrical section 1222*a* of the top surface 1222. The second, semi-cylindrical section 1222*b* is thereby formed as an angled surface that will abut a portion of the receiving cavity 934 when the engagement projection 944 is inserted into the receiving cavity 934 to drive the engagement button 1220 towards the actuated position. In the specific embodiment provided in FIGS. 13A, 13B and 15, the second, semi-cylindrical section 1222*b* also includes a plurality of contact ridges that facilitate more secured contact with the surface of the second, semi-cylindrical section of the top surface 1222.

In an additional embodiment, the engagement button 1220 is oriented on the engagement projection 944 such that when the engagement projection 944 is inserted into the receiving cavity 934, the semi-cylindrical second section 1222*b* of the top surface 1222 will abut an edge 1147 of the receiving cavity 934, where the abutting of semi-cylindrical second section 1222*b* against the edge 1147 will drive the engagement button 1220 towards the actuated position.

To provide a suitable degree of movement for the engagement button 1220 in moving between the unactuated and actuated positions, the engagement button 1220 may be slidably received within the receiving aperture 1230 of the engagement projection 944 such that the engagement button 1220 is unrestricted and free to move within the receiving aperture 1230. Said another way, the engagement button 1220 will not be restricted by any connection between the engagement button 1220 and the receiving aperture 1230 (other than in the embodiments where the at least one biasing element is connected between the engagement button 1220 and the receiving aperture 1230). In the embodiments where the engagement button 1220 is unrestricted and free to move within the receiving aperture 1230, it is possible that the engagement button 1220 may unintentionally self-rotate within the receiving aperture 1230, either through repeated contact between the engagement button 1220 and the edge 1147 of the receiving cavity 934, or through an unusual application of force to the engagement button 1220 by a user.

The self-rotation of the engagement button 1220 within the receiving aperture 1230 is generally unwanted and is particularly undesirable when the top surface 1222 of the engagement button 1220 is formed with the aforementioned first and second, semi-cylindrical halves 1222*a*, 1222*b*. When the top surface 1222 of the engagement button 1220 is configured with the second semi-cylindrical section 1222*b* that is formed at an angle for engaging the edge 1147 of the receiving cavity 934, any self-rotation of the engagement button 1220 within the receiving aperture 1230 may bring the second, semi-cylindrical section 1222*b* of the top surface 1222 out of proper alignment. When the second, semi-cylindrical section 1222*b* of the top surface 1222 is not in proper alignment, the second, semi-cylindrical section 1222*b* may not abut the edge 1147 of the receiving cavity 934 when the engagement projection 944 is inserted into the receiving cavity 934. Instead, a sidewall 1430 of the engagement button 1220 may abut the edge 1147 of the receiving cavity 934, which will result in the engagement button 1220 not being fully driven to the actuated position within the receiving aperture 1230. When the engagement button 1220 is not fully driven to the actuated position, the engagement projection 944 will be prevented from being fully inserted into the receiving cavity 934.

In an embodiment, the engagement button 1220, engagement projection 944 and receiving aperture 1230 are collectively formed so as to substantially prevent any self-rotation of the engagement button 1220 within the receiving aperture 1230 of the engagement projection 944.

In the embodiment provided in FIGS. 13B and 15, the engagement button 1220 is structured to include a pair of diametrically opposed tabs 1320 that extend radially outward from a radial wall of the engagement button 1220, and the receiving aperture 1230 is structured to include a pair of diametrically opposed slots 1226 that extend along a vertical length of the receiving aperture 1230 and are sized to slidably receive the pair of diametrically opposed tabs 1320 of the engagement button 1220.

Figure 14A:
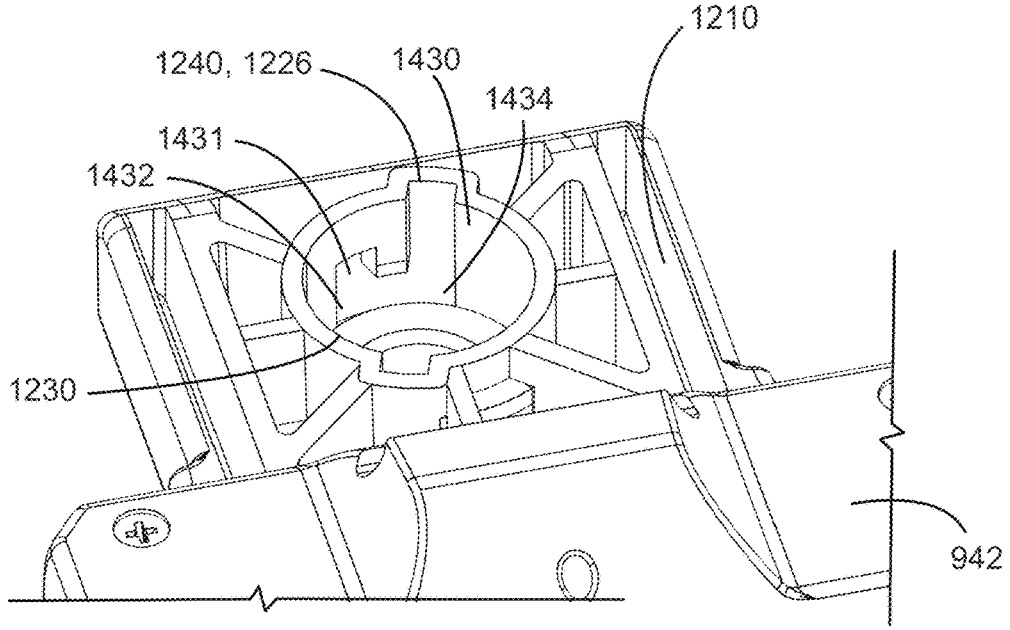
FIG. 14A is a first, perspective view of the receiving aperture in removable rear wheel assembly of the modular roller skate of FIG. 9A.
Figure 14B:
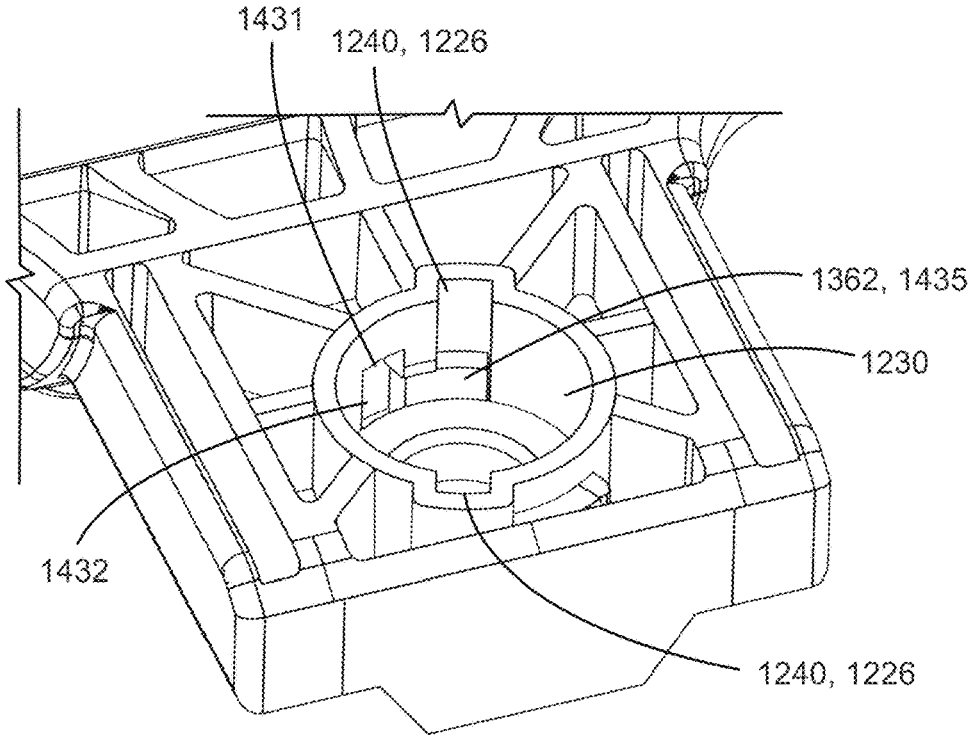
FIG. 14B is a second, perspective view of the receiving aperture in removable rear wheel assembly of the modular roller skate of FIG. 9A.

In the specific embodiment provided in FIGS. 14A and 14B, each of the pair of diametrically opposed slots 1226 is formed in a side wall of the receiving aperture 1230.

In an additional embodiment, the pair of diametrically opposed tabs 1320 and pair of diametrically opposed slots 1226 are configured to only prevent the rotation of the engagement button 1220 when the engagement button 1220 is in the unactuated position. As provided in FIGS. 14A and 14B, each of the pair of diametrically opposed slots 1226 includes an upper slot section 1431 and a lower slot section 1432. The pair of diametrically opposed slots 1226 are formed such that when the engagement button 1220 is in the unactuated position, the pair of diametrically opposed tabs 1320 of the engagement button 1220 are disposed in the lower slot section 1432, and when the engagement button 1220 is in the actuated position, the pair of diametrically opposed tabs 1320 are disposed in the upper slot section 1431. The upper slot sections 1431 of the pair of diametrically opposed slots 1226 includes at least one retaining wall 1435, where the at least one retaining wall 1435 is positioned to abut the pair of diametrically opposed tabs 1320 so as to prevent any rotation of the engagement button 1220 relative to the receiving aperture 1230.

In yet another embodiment, the pair of diametrically opposed slots 1226 are formed so as to facilitate easy insertion of the pair of diametrically opposed tabs 1320, while also providing secure retention of the pair of diametrically opposed tabs 1320. Referring to FIGS. 13A, 14A and 14B, several views of the bottom of the removable rear wheel assembly 940 are provided where a bottom-most housing portion 1210 of the removable rear wheel assembly 940 has been removed. In this embodiment, each of the pair of diametrically opposed slots 1226 is formed at a first angle relative to a longitudinal axis of the removable rear wheel assembly 940 (and therefore the skate body). Each slot of the pair of diametrically opposed slots 1226 also includes an insertion slot 2240 that is connected to the upper slot section 1431 of the slot. Each insertion slot 2240 extends from the upper slot section 1431 of the slot towards the bottom surface of the skate body and is shaped to receive one of pair of diametrically opposed tabs 1320 so as to permit the removal of the engagement button 1220 from the receiving aperture 1230.

As provided in FIG. 15, the bottom-most housing portion 1210 is positioned in place so as to extend over and cover each insertion slot 2240 of the pair of diametrically opposed slots 1226. The bottom-most housing portion can be installed in place once the engagement button 1220 has been inserted into the receiving aperture 1230 and the pair of diametrically opposed tabs 1320 are received in the pair of diametrically opposed slots 1226 so as to "close-off" the open end of each insertion slot 2240.

In the specific embodiment provided in FIGS. 14A and 14B, each insertion slot 2240 is formed at a second angle relative to the longitudinal axis of the skate body, where the second angle is in a direction opposite the first angle. Each insertion slot 2240 also includes a connection slot portion 1434 extending from the insertion slot 2240 to a top end of the upper slot section 1431. In this way, the engagement button 1220 can be inserted and retained within the receiving aperture 1230 by first inserting the engagement button 1220 into the receiving aperture 1230 such that the pair of diametrically opposed tabs 1320 are aligned with the insertion slots 2240. As the engagement button 1220 is advanced along the receiving aperture 1230, the pair of diametrically opposed tabs 1320 advance along the length of the insertion slots 2240 and reach a bottom of the insertion slot 2240. The engagement button 1220 can the be rotated within the receiving aperture 1230 such that each tab of the pair of diametrically opposed tabs 1320 moves along one of the connection slot portions 1434 and is received in the upper slot section 1431.

Figure 13C:
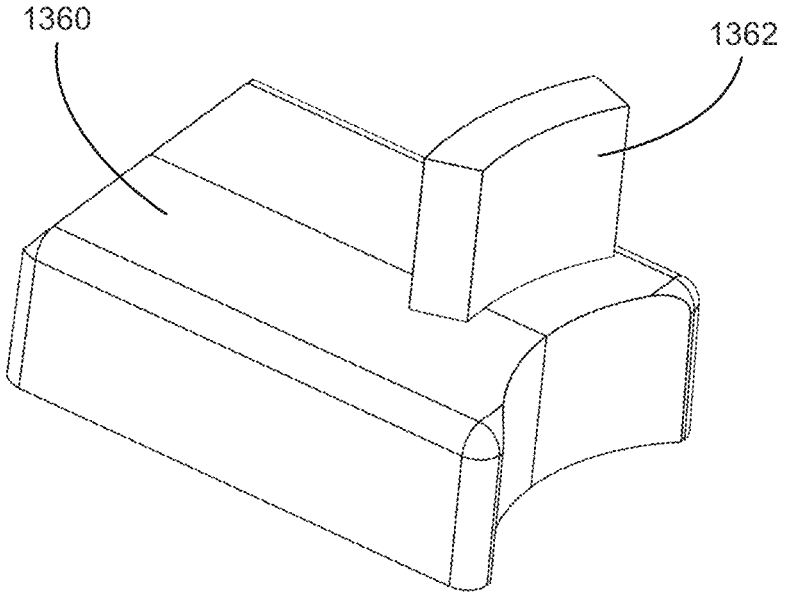
FIG. 13C is an isometric view of the retaining body from the modular roller skate of FIG. 9A.

In the specific embodiment provided in FIGS. 14A and 14B, the at least one retaining wall 1435 is formed as a flange 1362 of a separate retaining body 1360 (provided in more detail in FIG. 13C). The separate retaining body 1360 is mounted within the rear wheel truck 136*a* of the removable rear wheel assembly 940, and the separate retaining body 1360 is positioned relative to the receiving aperture 1230 such that the flange 1362 of the separate retaining body 1360 extends at least partially into the connection slot portion 1434 of one of the pair of diametrically opposed slots 1226, and thereby defines the at least one retaining wall 1435 of the upper slot section 1431 (see FIG. 14B).

In an additional embodiment where the multi-part roller skate 100 is the modular roller skate, the skate body 102 of the modular roller skate is a length-adjustable skate body that can include the front foot support structure 120 and the rear foot support structure 130 of the aforementioned length-adjustable roller skate. The skate body 102 of the modular roller skate can also include the at least one front securing element 150 and the at least one rear securing element 160 which are mounted on the front foot support structure 120 and rear foot support structure 130, respectively.

Modular Skate Kit with Roller Skate Mode and Ice Skate Mode

Referring to FIGS. 9A to 18B, there is provided another embodiment of the multi-part roller skate 100, where the multi-part roller skate 100 is formed as a modular skate kit. This modular skate kit is structured to interchangeably provide two modes of travel to a user, a roller skate mode and an ice skate mode. According to an embodiment, the modular skate kit is for providing a roller skate mode or an ice skate mode comprises the skate body 102 which includes the support surface 104 and the plurality of securing elements 106 for releasably attaching a footwear of a user to the support surface 104. The skate body 102 also includes the front wheel support structure that is formed for supporting the single front wheel 127, and the rear wheel support structure that is formed for supporting the rear wheels 137. The skate body 102 also includes a first mounting element 932.

In an additional embodiment, the front wheel assembly 123 is formed on the front wheel support structure of the skate body 102 and includes the single front wheel 127 that is rotatably supported thereon. The modular skate kit also comprises the rear wheel support structure in the form of the removable rear wheel assembly 940, where the removable rear wheel assembly 940 includes the rear wheel support 943, the pair of rear wheels 137 that are rotatably mounted on the rear wheel support 943, and the second mounting element 942 that is formed to be connected to the first mounting element 932 for releasably mounting the rear wheel support 943 to the skate body 102, and a removable, rear ice skate support 1630 that includes at least one rear ice skate blade 1632 connected to a first end 1630*a* thereof, and a third mounting element 1742 formed on an opposing end thereof. The third mounting element 1742 of the rear ice skate support is formed to be releasably connected to the first mounting element 932 for releasably mounting the rear ice skate support 1630 to the skate body 102.

The modular skate kit further comprises a front ice skate support 1620 that comprises at least one front ice skate blade 1622 and at least one support frame 1624 that is releasably mountable to the front wheel support structure of the skate body 102 for mounting the front ice skate support 1620 to the front wheel support structure of the skate body 102. The first mounting element 932 is formed to interchangeably connect to one of the second mounting element 942 of the rear wheel support 943 and the third mounting element 1742 of the rear ice skate support 1630 so as to provide one of the roller skate mode and ice skate mode of travel to the modular skate kit. In the ice skate mode of travel, the front ice skate support 1620 is adapted to be connected to the skate body 102 when the rear ice skate support is mounted to the skate body 102 such that the rear ice skate support 1630 and front ice skate support 1620 can collectively support the skate body 102.

Figure 16:
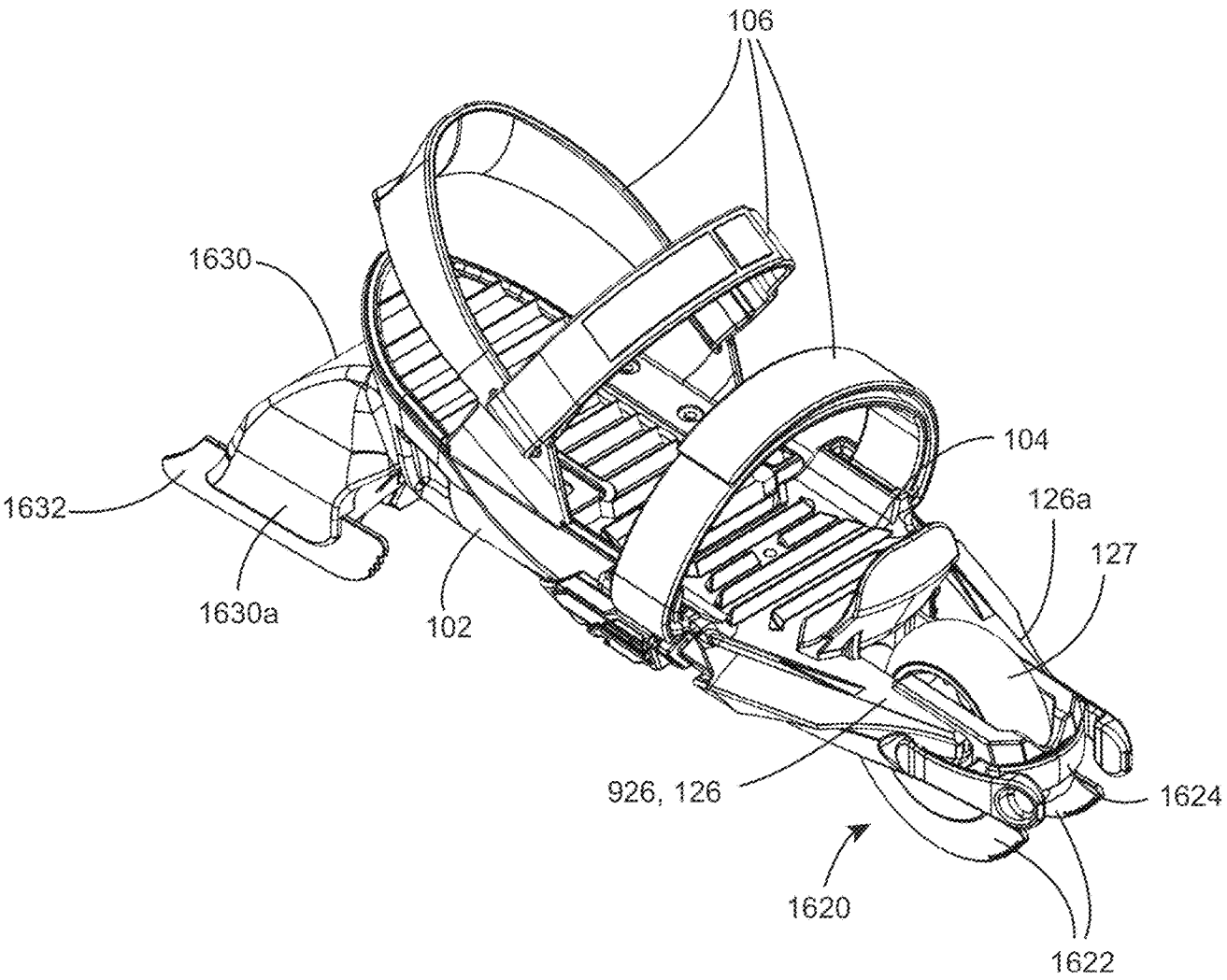
FIG. 16 shows an isometric view of a modular ice skate of a modular skate kit in accordance with an embodiment of the disclosure.

In an embodiment such as provided in FIGS. 16, the front wheel assembly 123 of the modular skate kit can comprise one or more aspects of the front wheel assembly 123 from the front foot support structure 120 of the length-adjustable roller skate, including the front support frame 126 with the pair of frame arms 126*a*, and the at least one front wheel 127.

In an embodiment such as provided in FIG. 12B where the multi-part roller skate 100 is the modular skate kit, the removable rear wheel assembly 940 of the modular skate kit can comprise one or more aspects of the rear wheel assembly 133 of the rear foot support structure 130, including the rear wheel truck 136*a* that includes the lateral through-aperture 337, and the rear axle assembly 333 on which the pair of rear wheels 137 are rotatably mounted. In the specific embodiment provided in FIG. 12B, the rear wheel support 943 includes the rear wheel truck 136*a* that comprises the lateral through-aperture 337 and the rear axle assembly 333.

In an embodiment where removable rear wheel assembly 940 of the modular skate kit is formed to include aspects of the rear wheel assembly 133 of the rear foot support structure 130, the first mounting element 932 of the skate body 102 can be formed as one of the receiving cavity 934 and the engagement projection 944, and can include at least some of the aforementioned elements of the receiving cavity 934 or engagement projection 944, including the through-aperture 1150, engagement button 1220 and receiving aperture 1230. Likewise, the second mounting element 942 of the removable rear wheel assembly 940 can include the other of the receiving cavity 934 and the engagement projection 944 such that the removable rear wheel assembly 940 can be mounted to the skate body 102, and the third mounting element 1742 of the rear ice skate support 1630 can also include the other of the receiving cavity 934 and the engagement projection 944 such that the rear ice skate support 1630 can be mounted to the skate body 102. Each of the second mounting element 942 and third mounting element 1742 can also include at least some of the aforementioned elements of the other of the receiving cavity 934 and engagement projection 944, including the through-aperture 1150, engagement button 1220 and receiving aperture 1230.

In the specific embodiment provided in FIGS. 9B, 10, 18A and 18B the first mounting element 932 of the skate body 102 includes the receiving cavity 934, where the receiving cavity 934 extends inwards from a surface on the rear wheel support structure of the skate body 102. The receiving cavity 934 also includes the through-aperture 1150 extending from the receiving cavity 934 to a surface of the skate body 102. The second and third mounting elements 942, 1742 each include the engagement projection 944 such that each of the removable rear wheel assembly 940 and removable rear ice skate support 1630 each include the engagement projection 944. The engagement projections 944 of each of the removable rear wheel assembly 940 and rear ice skate support 1630 each include the engagement button 1220 mounted within the receiving aperture 1930 on the engagement projection. Said another way, the engagement projection 944 of each of the second and third mounting elements 942, 1742 includes the engagement button 1220 that is sized to be received in the receiving aperture 1230 and that is movable between the unactuated and the actuated position. In some embodiments, the engagement button 1220 includes the aforementioned at least one internal biasing element for internally biasing the engagement button towards the unactuated position to facilitate the "locking" of the engagement projection 944 (of either the rear wheel assembly 940 or rear ice skate support 1630) within the receiving cavity 934.

As with the modular roller skate, the engagement button 1220 on the engagement projection(s) 944 of the modular skate kit includes the receiving aperture 1230 formed on a surface thereof, where the engagement button 1220 is movably retained within the receiving aperture 1230 for moving between the actuated and unactuated positions. The biasing member is connected between the receiving aperture 1230 and the engagement button 1220 for biasing the engagement button 1220 towards the unactuated position.

Figure 17A:
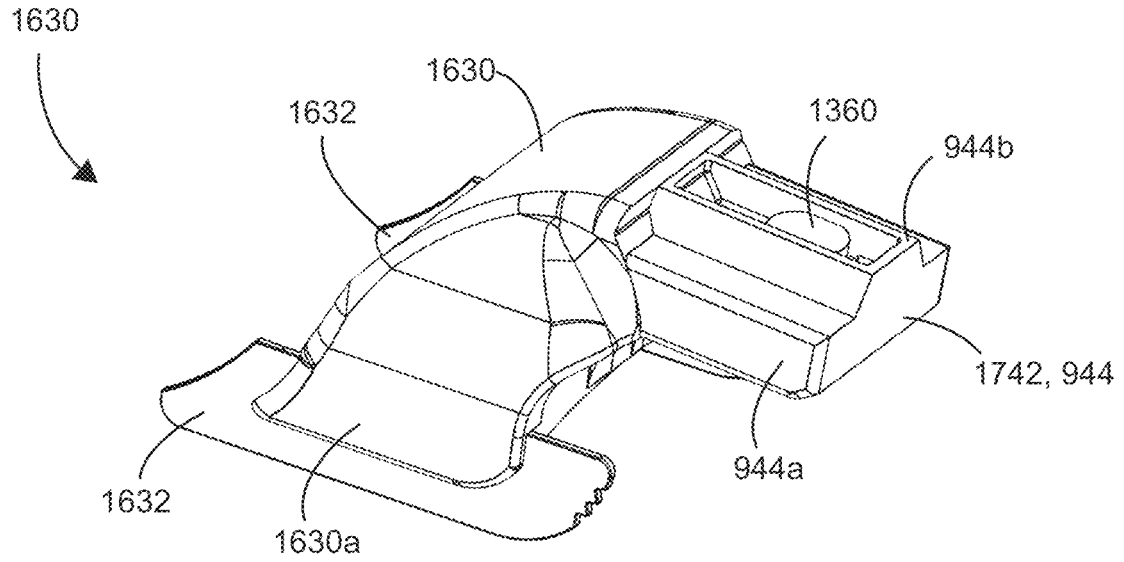
FIG. 17A shows a perspective view of a rear ice skate support of the modular ice skate of FIG. 16.
Figure 17B:
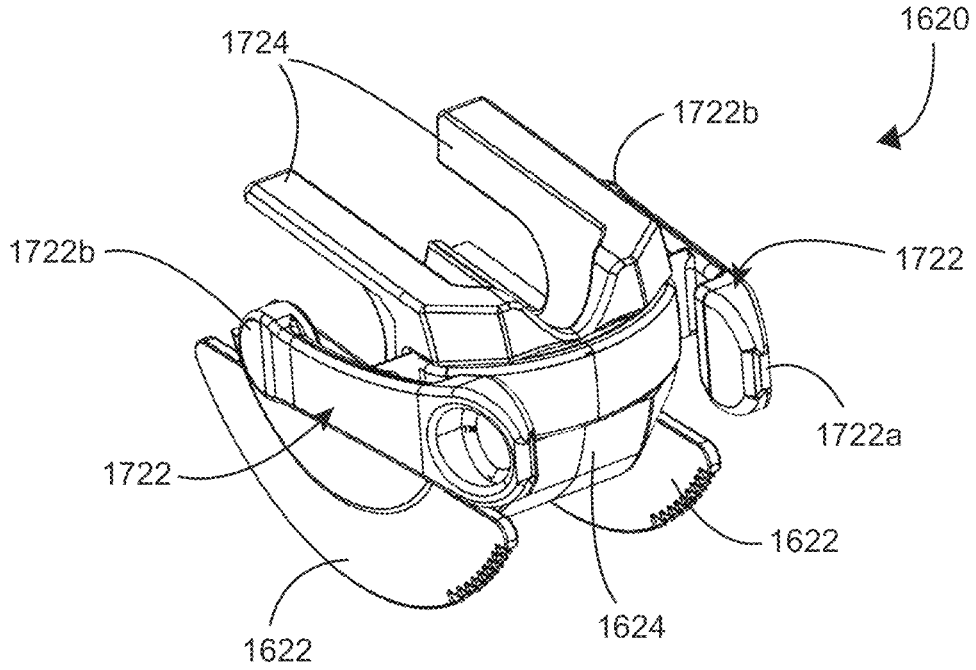
FIG. 17B shows a perspective view of a front ice skate support of the modular ice skate of FIG. 16.

Referring to FIG. 17B, the front ice skate support 1620 of the modular skate kit is provided to include the at least one front ice skate blade 1622 and the support frame 1624 that is releasably mountable to the front wheel support structure of the skate body 102 for mounting the front ice skate support 1620 to the front wheel support structure of the skate body 102.

In an additional embodiment, the support frame 1624 of the front ice skate support includes an upper portion that is structure to be releasably connected to the front wheel support structure of the skate body 102, and a lower portion that is formed as a solid body to which the at least one front ice skate blade is mounted.

In an embodiment such as provided in FIG. 16 where the front wheel assembly 123 of the skate body 102 of the modular skate kit includes the pair of frame arms 126*a*, the frame arm mounting aperture of each of the pair of frame arms 126*a* extends through the width of the frame arm 126*a* so as to define the bores 526 on a laterally outer portion of the frame arm mounting aperture of each of the frame arms 126*a*. Said another way, the front wheel assembly includes bores 526 that are formed in the skate body 102 on either side of the at least one front wheel 927. In this embodiment, the upper portion of the support frame 1624 of the support frame includes a pair of projections 1722 that are formed to be releasably connected into the bores 526 on either side of the at least one front wheel 927.

In the specific embodiment provided in FIGS. 16 and 17B, the upper portion of the support frame 1624 includes the pair of projections 1722 which extend horizontally out from the upper portion of the support frame 1624, and a pair of bracing members 1724 that also extend out from the upper portion of the support frame 1624. Each of the pair of projections 1722 is pivotably mounted to the upper portion of the support frame 1624 and includes an engagement end 1722*b* and a contact end 1722*a*. As the front ice skate support 1620 is being mounted to the front wheel support structure of the skate body 102, a user can press each contact end 1722*a* inwards to deflect the engagement ends 1722*b* outwards. As the front-ice skate support 1620 is brought against the front wheel support structure of the skate body 102, the engagement ends 1722*b* of each projection 1722 become horizontally aligned with the pair of bores 526 and the user can release the contact end 1722*a* of each projection 1722. The projections 1722 will deflect such that each engagement end 1722*b* is received in one of the pair of bores 526. The pair of bracing members 1724 are sized such that when the pair of projections 1722 are engaged with the pair of bores 526, the bracing members 1724 will contact a top surface of each of the pair of frame arms 126*a* for further supporting the front ice skate support 1620 on the skate body 102.

Figure 18B:
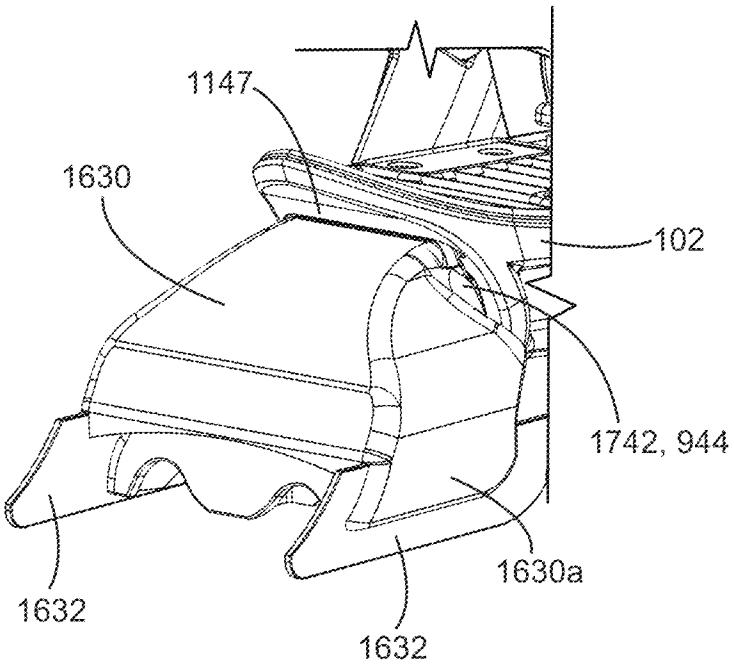
FIG. 18B shows a perspective view of the rear ice skate support of the modular ice skate of FIG. 16, where the rear ice support is mounted to the skate body.
Figure 18A:
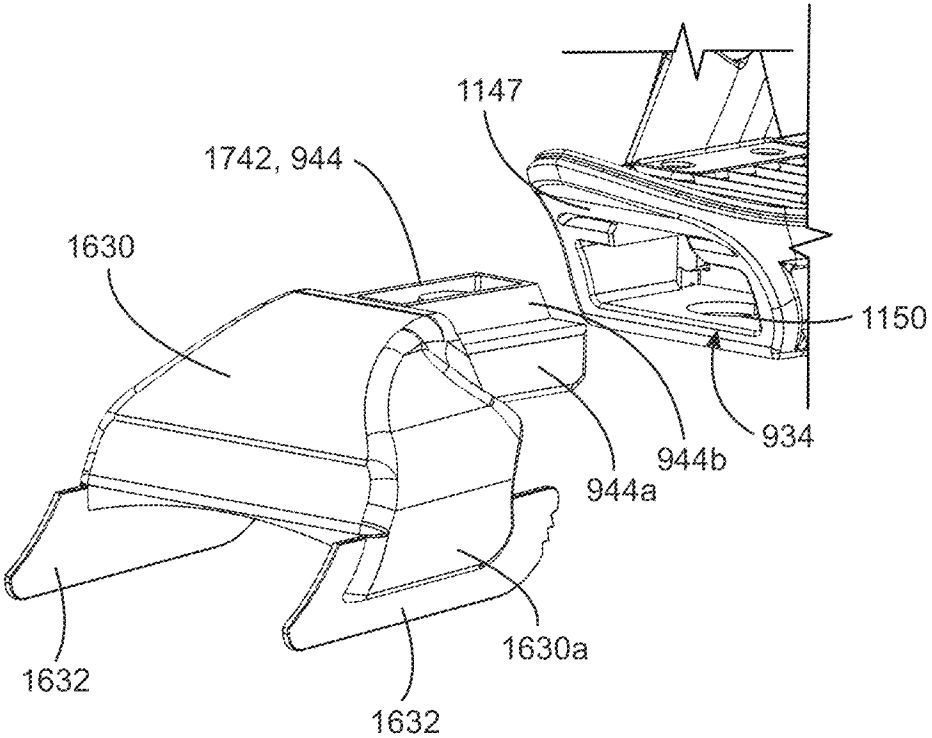
FIG. 18A shows a perspective view of a rear ice skate support of the modular ice skate of FIG. 16, where the rear ice support is separate from the skate body.

Referring to FIGS. 17A, 18A and 18B, an embodiment of the rear ice skate support 1630 is provided where the rear ice skate support 1630 includes a rear ice skate support body. The rear ice skate support body includes the at least one rear ice skate blade 1632 connected to one end thereof, and the third mounting element 1742 formed on the opposing end thereof.

In the specific embodiment provided in FIGS. 17, 18A and 18B, the third mounting element 1742 is the engagement projection 944 including the lower section 944*a* and the upper section 944*b*. The engagement projection 944 extends from an upper end of the rear ice skate support 1630, and the at least one rear ice skate blade 1632 is a pair of ice skate blades that are mounted through a bottom side of the rear ice skate support 1630.

In an additional embodiment where the multi-part roller skate 100 is the modular skate kit, the skate body 102 of the modular skate kit is a length-adjustable skate body 102 that can include the front foot support structure 120 and the rear foot support structure 130 of the aforementioned length-adjustable roller skate. The skate body 102 of the modular roller skate can also include the at least one front securing element 150 and the at least one rear securing element 160 which are mounted on the front foot support structure 120 and rear foot support structure 130, respectively.

Modular Skate System

Referring to FIGS. 9A to 15, and 19 to 25B there is provided yet another embodiment of the multi-part roller skate 100, where the multi-part roller skate 100 is formed as a modular skate system. This modular skate system is structured to interchangeably provide at least two modes of travel to a user, a roller skate mode and a non-rolling mode. According to an embodiment, the modular skate system provides both a rolling and non-rolling manner of travel and comprises the skate body 102 including the support surface 104 in the form of the sole support surface 904, the plurality of securing elements 106 for releasably attaching the footwear of a user to the sole support surface 904, the front wheel assembly 123 that is formed on the front wheel support structure of the skate body 102 and includes the front wheel support 926, the single front wheel 127, and the first mounting element 932. In this embodiment, the first mounting element 932 is formed to interchangeably connect to one of the removable rear wheel assembly 940 and a rear support member 1910.

The removable rear wheel assembly 940 includes the rear wheel support 943, the pair of rear wheels 137 that are rotatably mounted on the rear wheel support 943, and the second mounting element 942. In this embodiment, the second mounting element 942 is formed to be releasably connected to the first mounting element 932 for releasably mounting the removable rear wheel assembly 940 to the skate body 102 such that a rotational axis of the pair of rear wheels 137 is parallel to a rotational axis of the at least one front wheel 927.

In the same embodiment, the rear support member 1910 includes a first end 1910*a* and a second end 1910*b* that includes a fourth mounting element 2042. The fourth mounting element 2042 is formed to be releasably connected to the first mounting element 932 for releasably mounting the rear support member 1910 to the skate body 102. Lastly, the modular skate system includes a secondary travel assembly 2110 that is structured for supporting the skate body 102 and for providing the above-described non-rolling manner of travel to the modular skate system. The secondary travel assembly 2110 includes both a front connector 2120 and a rear connector 2130. The front connector 2120 is releasably connectable to the single front wheel 127 for pivotably mounting the skate body 102 on the secondary travel assembly 2110. The rear connector 2130 includes at least one engagement surface 2132 that is formed for separably supporting the rear support member 1910. The at least one engagement surface 2132 is also formed to inhibit lateral movement of the rear support member 1910 when the second end 1910*b* of the rear support member 1910 is supported on the at least one engagement surface 2132.

In some embodiments of the modular skate system, the at least one engagement surface 2132 of the rear connector 2130 is positioned along the secondary travel assembly 2110 for separably supporting the first end 1910*a* of the rear support member 1910 such that when the front wheel support structure of the skate body 102 is pivotably mounted to the front connector 2120, the first end 1910*a* of the rear support member 1910 can be lifted from the at least one engagement surface 2132 by pivoting the skate body 102 relative to the secondary travel assembly 2110.

In the structure of the modular skate system provided in FIGS. 21 to 25B, the secondary travel assembly 2110 can be configured as either an elongated supporting element having a shape of a ski (see FIGS. 21, 22 23 and 25A), or a support element having the shape of a snowshoe (see FIGS. 24A, 24B, 24C and 25B). In both of these configurations.

In some embodiments of the secondary travel assembly 2110, the proper functioning of the modular skate system during use requires that the user be able to lift their heel of the rear of the support during consecutive motions of the user's leg. In this way, the heel of the footwear of the user that must be able to move upwards relative to the secondary travel assembly 2110, while the toe of the footwear of the user must remain connected to the secondary travel assembly 2110 and should be able to pivot with respect to the secondary travel assembly 2110 as the heel of the footwear is lifted relative to the secondary travel assembly 2110. In the modular skate system provided in FIGS. 21 to 25B, this heel lifting functionality is achieved via the front connector 2120 of the secondary travel assembly 2110 that pivotably connects to the at least front wheel 927, and the rear connector 2130 that includes the engagement surface 2132 on which the rear support member 1910 is separably supported. In use, the front wheel 927 of the skate system will remain pivotably connected via the front connector 2120, while the rear support member 1910 can be separate from the engagement surface 2132 to lift the heel of the footwear of the user relative to the secondary travel assembly 2110.

Figure 19:
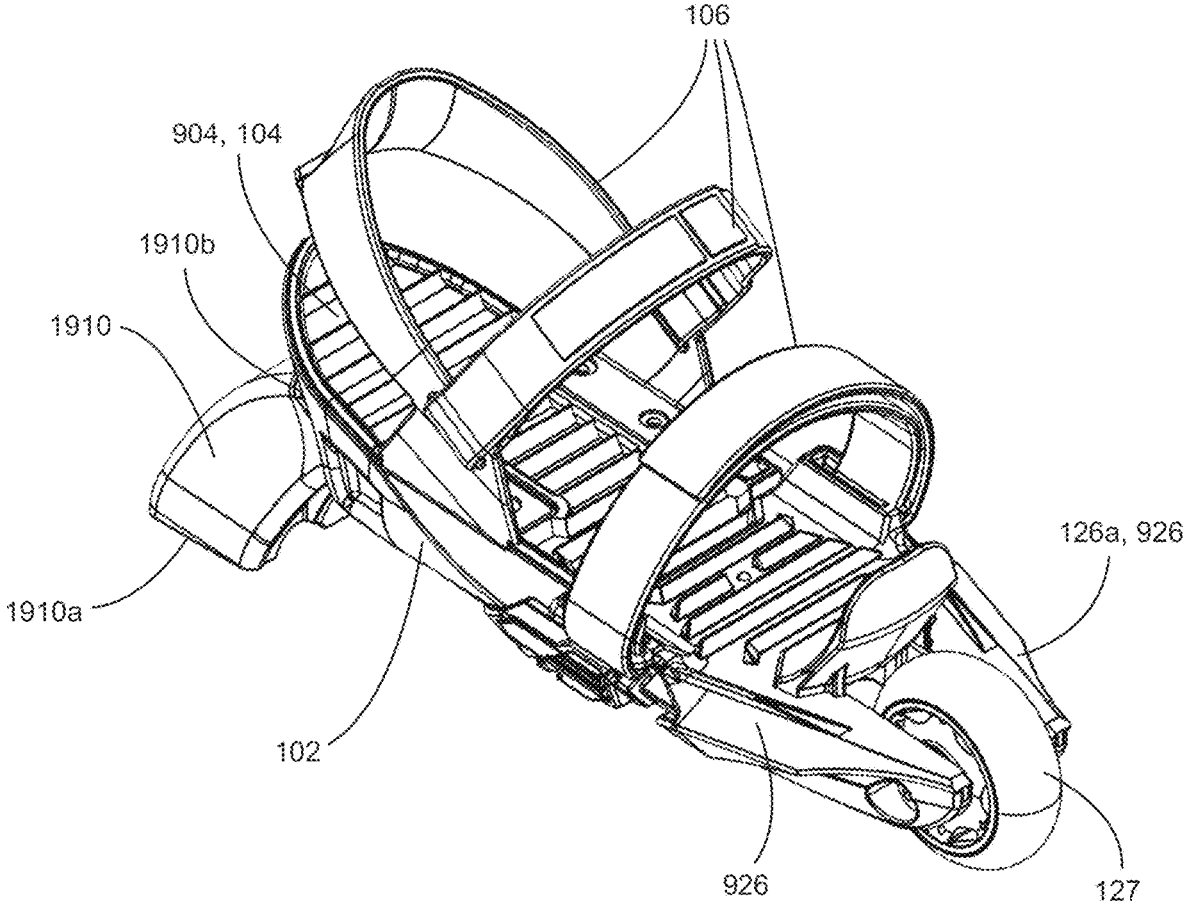
FIG. 19 shows an isometric view of a modular modular skate system in accordance with an embodiment of the disclosure.

In an embodiment such as provided in FIG. 19, a front wheel assembly 123 of the modular skate system is permanently formed on the skate body and can comprise one or more aspects of the front wheel assembly 123 from the front body 120 portion of the length-adjustable roller skate, including the front wheel support frame 126 with the pair of frame arms 126*a*. In the specific embodiment provided in FIG. 19, the front wheel support frame 126 includes the single front wheel 127 that is rotatably mounted between the pair of frame arms 126*a*.

In some embodiments of the front wheel assembly 123, each of the pair of frame arms 126*a* includes the frame arm mounting aperture for mounting the front axle assembly 323. The frame arm mounting aperture of each of the pair of frame arms 126*a* extends through the width of the frame arm 126*a* so as to define the bores 526 in each of the pair of frame arms 126*a*, on either side of the at least one front wheel 927.

In an embodiment such as provided in FIGS. 9A, 9B and 10 where the multi-part roller skate 100 is the modular skate system, the removable rear wheel assembly 940 of the modular skate system can comprise one or more aspects of the rear wheel assembly 133 of the rear foot support structure 130 of the length-adjustable roller skate, including the rear wheel support member 136 that includes the lateral through-aperture 337, and the rear axle assembly 333 on which the pair of rear wheels 137 are rotatably mounted.

Figure 20B:
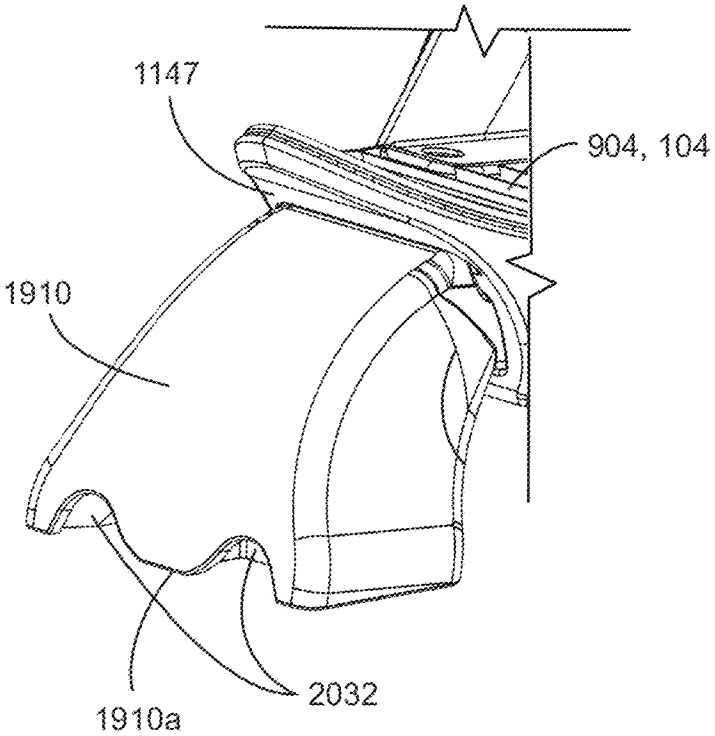
FIG. 20B shows a perspective view of the rear support member of the modular skate system of FIG. 19, where the rear support member is mounted to the skate body.
Figure 20A:
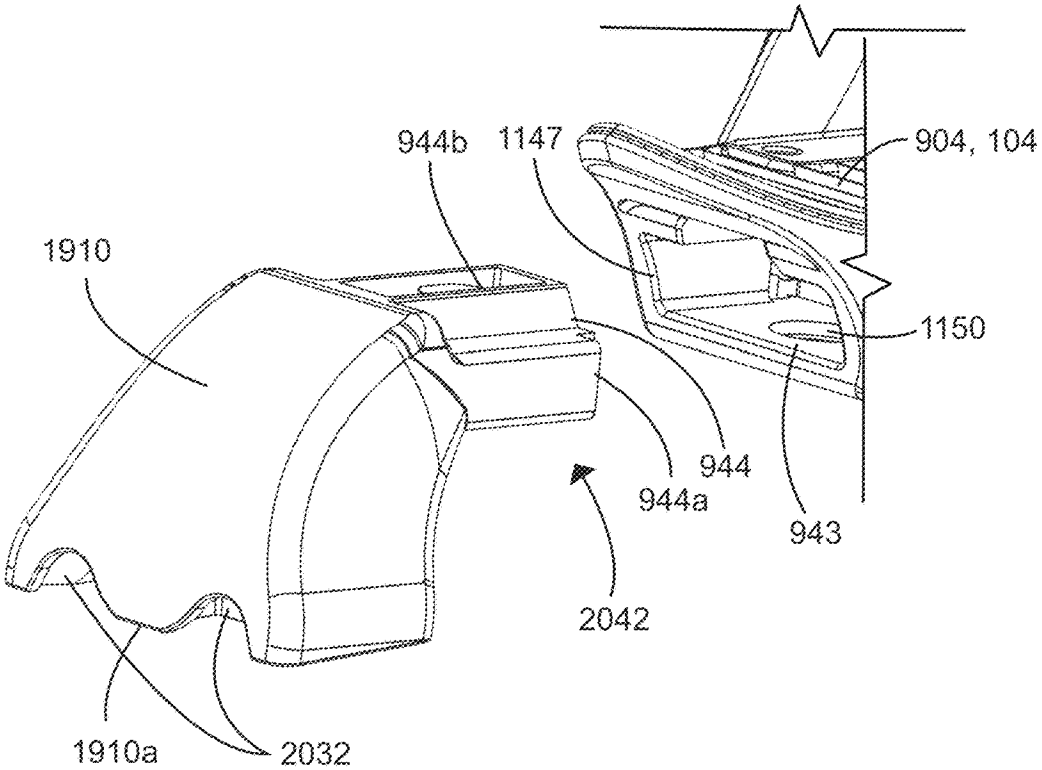
FIG. 20A shows a perspective view of a rear support member of the modular skate system of FIG. 19, where the rear support member is separate from the skate body.

Referring to FIGS. 19, 20A and 20B, an embodiment of the rear support member 1910 of the modular skate system is provided. As provided above, the rear support member 1910 includes the first end 1910*a* and the second end 1910*b* that includes the fourth mounting element 2042 that is connectable to the first mounting element 932 of the skate body 102. The first end 1910*a* of the rear support member 1910 is shaped to correspond to a shape of the at least one engagement surface 2132 of the secondary travel assembly 2110 such that the rear support member 1910 is vertically and laterally supported on the at least one engagement surface 2132. The specifics of the structure of the at least one engagement surface 2132 are provided below with reference to FIGS. 21 to 25B.

In the specific embodiment provided in FIGS. 19 to 25 the rear support member 1910 has a generally curvilinear form. The first end 1910*a* of the rear support member 1910 includes a pair of semi-cylindrical channels 2032 that are formed on an end surface of the first end 1910*a* of the rear support member 1910. The pair of semi-cylindrical channels 2032 are oriented on the end surface such that when the rear support member 1910 is connected to the skate body 102, the pair of semi-cylindrical channels 2032 will extend substantially parallel to the length of the secondary travel assembly 2110. Upper edges of the pair of semi-cylindrical channels 2032 on the end surface of the rear support member 1910 are also rounded so as to facilitate a more smooth and secure engagement between the pair of semi-cylindrical channels 2032 on the first end 1910*a* of the rear support member 1910 and the at least one engagement surface 2132 of the secondary travel assembly 2110.

In an embodiment where removable rear wheel assembly 940 of the modular skate kit is formed to include aspects of the rear wheel assembly 133 of the rear foot support structure 130 of the length-adjustable skate, the first mounting element 932 of the skate body 102 can be formed as one of the receiving cavity 934 and the engagement projection 944, and can include at least some of the aforementioned elements of the receiving cavity 934 or engagement projection 944, including the through-aperture 1150, engagement button 1220 and receiving aperture 1230. Likewise, the second mounting element 942 of the removable rear wheel assembly can include the other of the receiving cavity 934 and the engagement projection 944 such that the removable rear wheel assembly 940 can be mounted to the skate body 102, and the fourth mounting element 2042 of the rear support member 1910 also includes the other of the receiving cavity 934 and the engagement projection 944 such that the removable rear support 940 can be connected to the first mounting element 932 of the skate body 102. The engagement projection 944 is sized to be releasably received in the receiving cavity 934. Each of the second mounting element 942 and fourth mounting element 2042 can also include at least some of the aforementioned elements of the other of the receiving cavity 934 and engagement projection 944, including the through-aperture 1150, engagement button 1220 and receiving aperture 1230.

In one such embodiment, the first mounting element 932 includes the receiving cavity 934, the second mounting element 942 includes the engagement projection 944 in the form of a first engagement projection 944 that extends from the removable rear wheel support 940 and is formed to be releasably secured within the receiving cavity 934 such that a rotational axis of the pair of rear wheels 137 is parallel to the rotational axis of the single front wheel 127, and the fourth mounting element 2042 includes the engagement projection 944 in the form of a second engagement projection 944 that extends from the second end of the rear support members and is formed to be releasably secured within the receiving cavity 934.

In the specific embodiment provided in FIGS. 20A and 20B, the first mounting element 932 of the skate body 102 includes the receiving cavity 934, where the receiving cavity 934 extends inwards from a surface on the rear wheel support structure of the skate body 102. The second and fourth mounting elements 942, 2042 each include the engagement projection 944 such that each of the removable rear wheel assembly 940 and rear support member 1910 include the engagement projection 944. The receiving cavity 934 also includes the through-aperture 1150 extending from the receiving cavity 934 to a surface of the skate body 102, and the engagement projection 944*s* of each of the removable rear wheel assembly 940 and rear support member 1910 each include the engagement button 1220 mounted within the receiving aperture 1230 on the engagement projection 944.

Secondary Travel Assembly

Figure 25A:
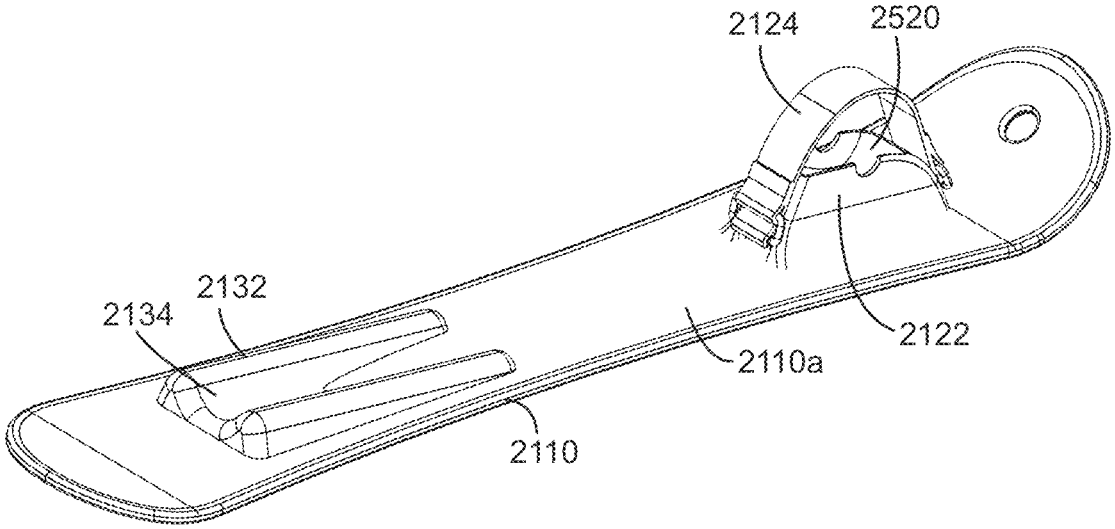
FIG. 25A shows a perspective view of the secondary travel assembly from the modular skate system of FIG. 19, where the secondary travel assembly is formed as a ski.
Figure 25B:
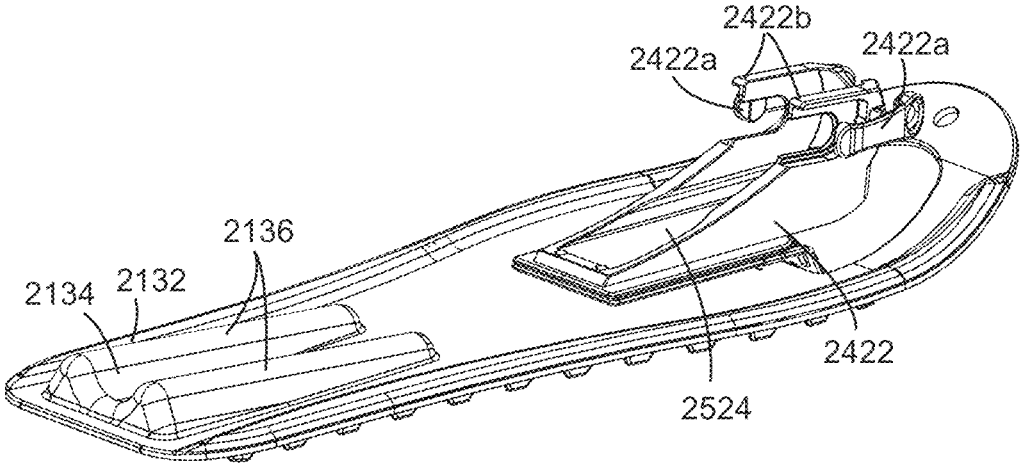
FIG. 25B shows a perspective view of the secondary travel assembly from the modular skate system of FIG. 19, where the secondary travel assembly is formed as a snowshoe.

Referring to FIGS. 25A and 25B, two embodiments of the secondary travel assembly 2110 are provided. The secondary travel assembly 2110 has an elongated. The secondary travel assembly 2110 incudes the aforementioned front connector 2120 and rear connector 2130 and is configured to pivotably support the skate body 102 via the front wheel assembly 123 and the rear support member 1910. The secondary travel assembly 2110 also includes a top surface 2110*a* and a substantially planar bottom surface (not provided) that facilitates the travel of the secondary travel assembly 2110 when in either of the ski or snowshoe type configurations. The front and rear connectors 2120, 2130 are both connected on the top surface 2110*a* of the secondary travel assembly 2110.

In the first embodiment of the secondary travel assembly 2110 provided in FIGS. 21 to 23 and 25A, the secondary travel assembly 2110 is configured as the elongated supporting element having the shape of a ski, while in the second embodiment provided in FIGS. 24A to 24C and 25B, the secondary travel assembly 2110 is configured as the snowshoe. In this embodiment, the secondary travel assembly 2110 also includes a front through-opening formed through a front portion of the secondary travel assembly 2110 that is positioned immediately in front of the front connector 2120.

Figure 21:
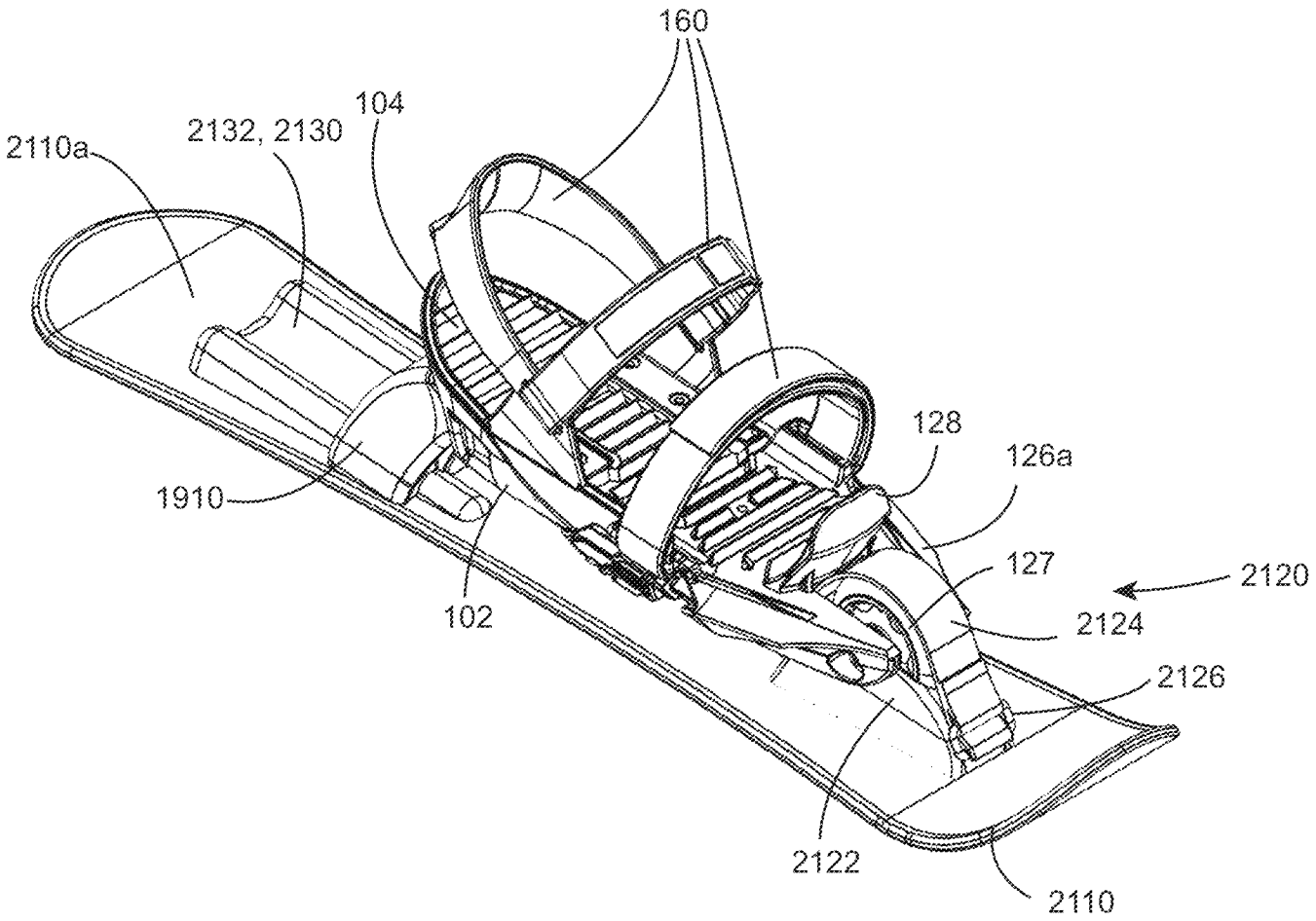
FIG. 21 shows a perspective view of an embodiment of the modular skate system of FIG. 19, where the skate body is mounted on a secondary travel assembly.
Figure 22:
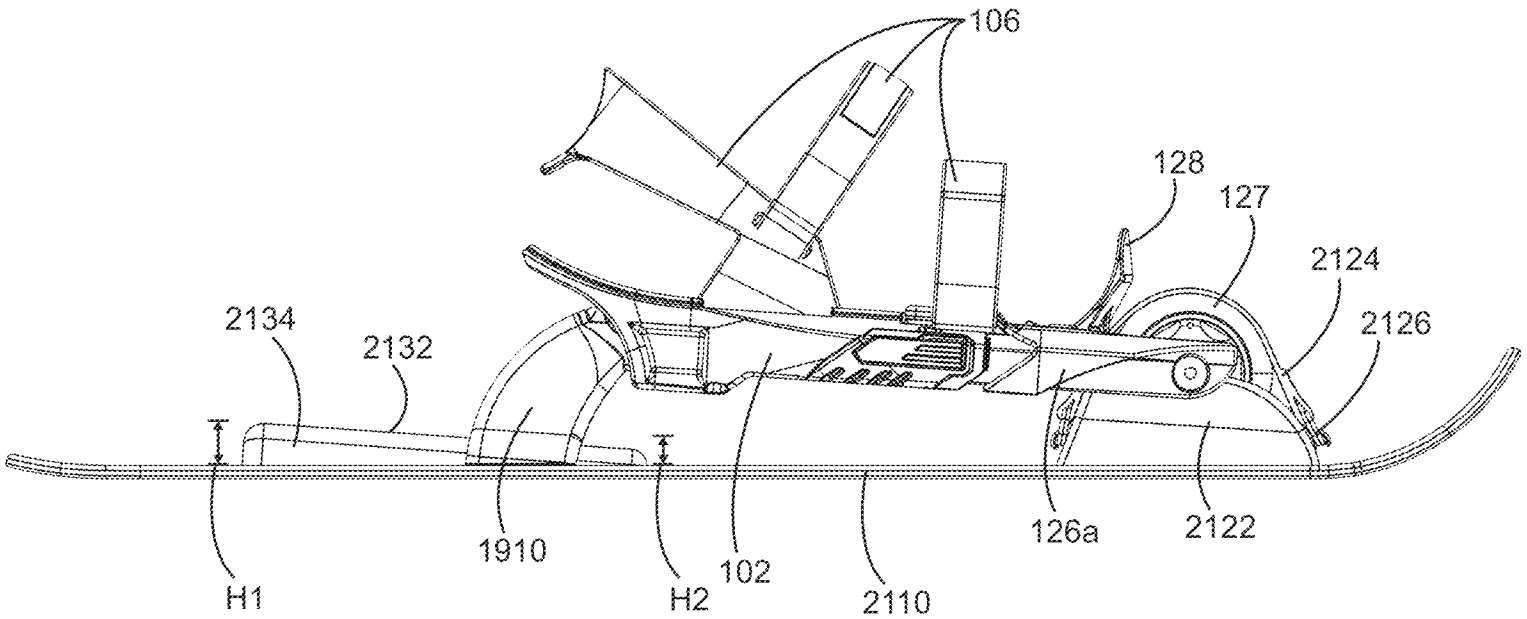
FIG. 22 shows a side view of an embodiment of the modular skate system of FIG. 19, where the skate body is mounted on a secondary travel assembly.

In an embodiment such as provided in FIGS. 21, 22 and 25A, the front connector 2120 is formed for pivotably mounting the skate body 102 to the secondary travel assembly 2110 such that the skate body 102 can pivot about a rotational axis of the front wheel 927, relative to the secondary travel assembly 2110.

In one such embodiment, the front connector 2120 of the secondary travel assembly 2110 includes a front connector body 2122 with at least one wheel receiving channel 2520 formed therein for receiving the front wheel 927, as well as at least one wheel securing strap 2224 for releasably fixing the front wheel 927 within the at least one wheel receiving channel 2520.

In the specific embodiment provided in FIGS. 21, 22, the front connector body 2122 is an arc-shaped body that extends up from the top surface 2110*a* of the secondary travel assembly 2110. The at least one wheel receiving channel 2520 is a single slot that extends along a length of the arc-shaped body and is sized to receive a portion of a bottom section of the single front wheel 127. The at least one wheel securing strap 2224 is a single strap that is releasably attached to opposing ends on top of the arc-shaped body via a pair of fasteners. When the single front wheel 127 is seated in the single slot, the wheel securing strap 2224 is pulled taught over the single front wheel 127 and is secured in place via the pair of fasteners.

In an alternate embodiment provided in FIGS. 23, 24A, 24B, 24C and 25B, the front connector 2120 of the secondary travel assembly 2110 is formed to include a front connector flange 2422. The front connector flange 2422 is mounted on the secondary travel assembly 2110 and includes a wheel mounting slot 2424 for receiving the at least one front wheel 127.

Figure 24A:
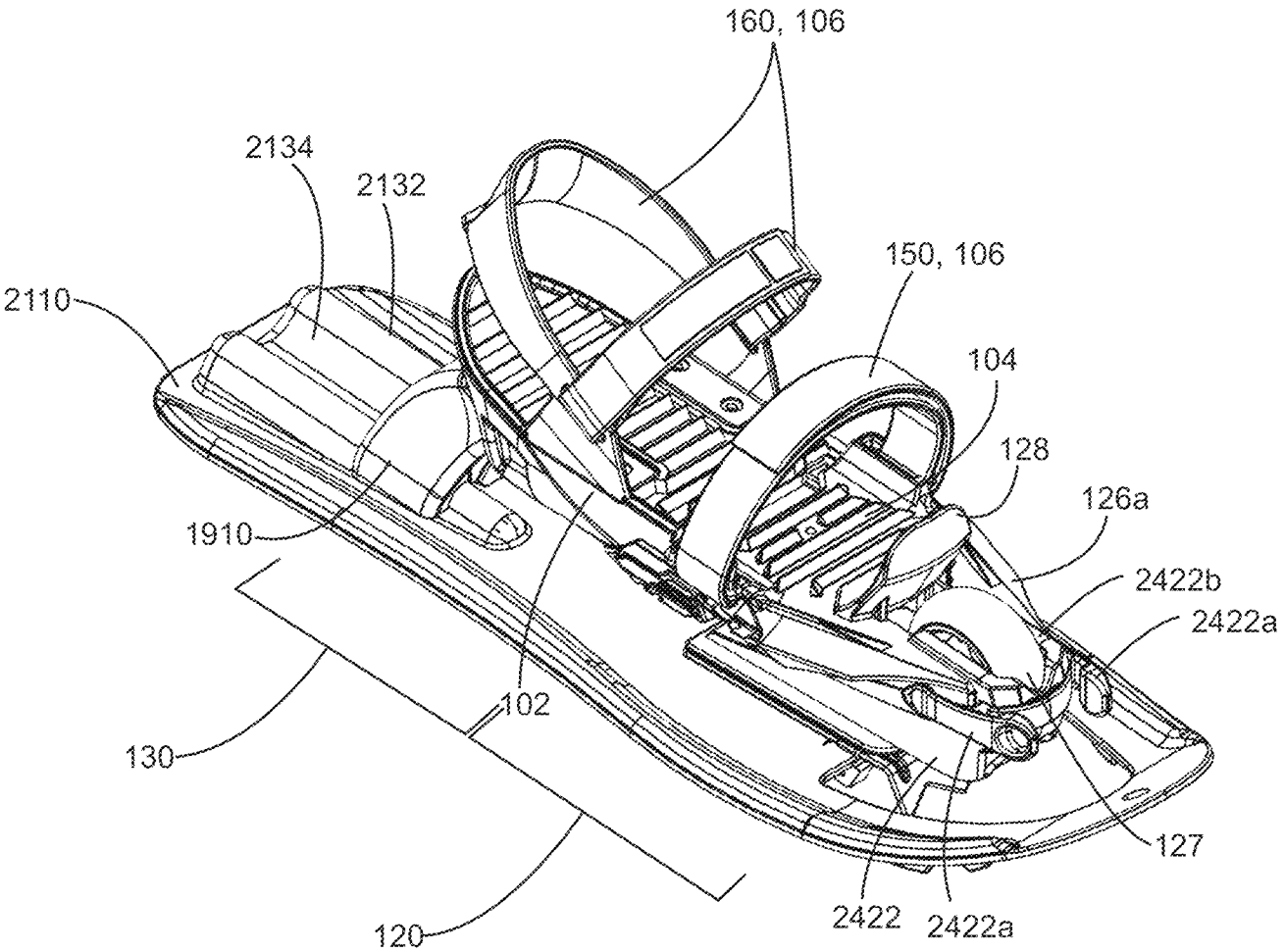
FIG. 24A shows a perspective view of an additional embodiment of the modular skate system of FIG. 19, where the secondary travel assembly is formed as a snowshoe.
Figure 24B:
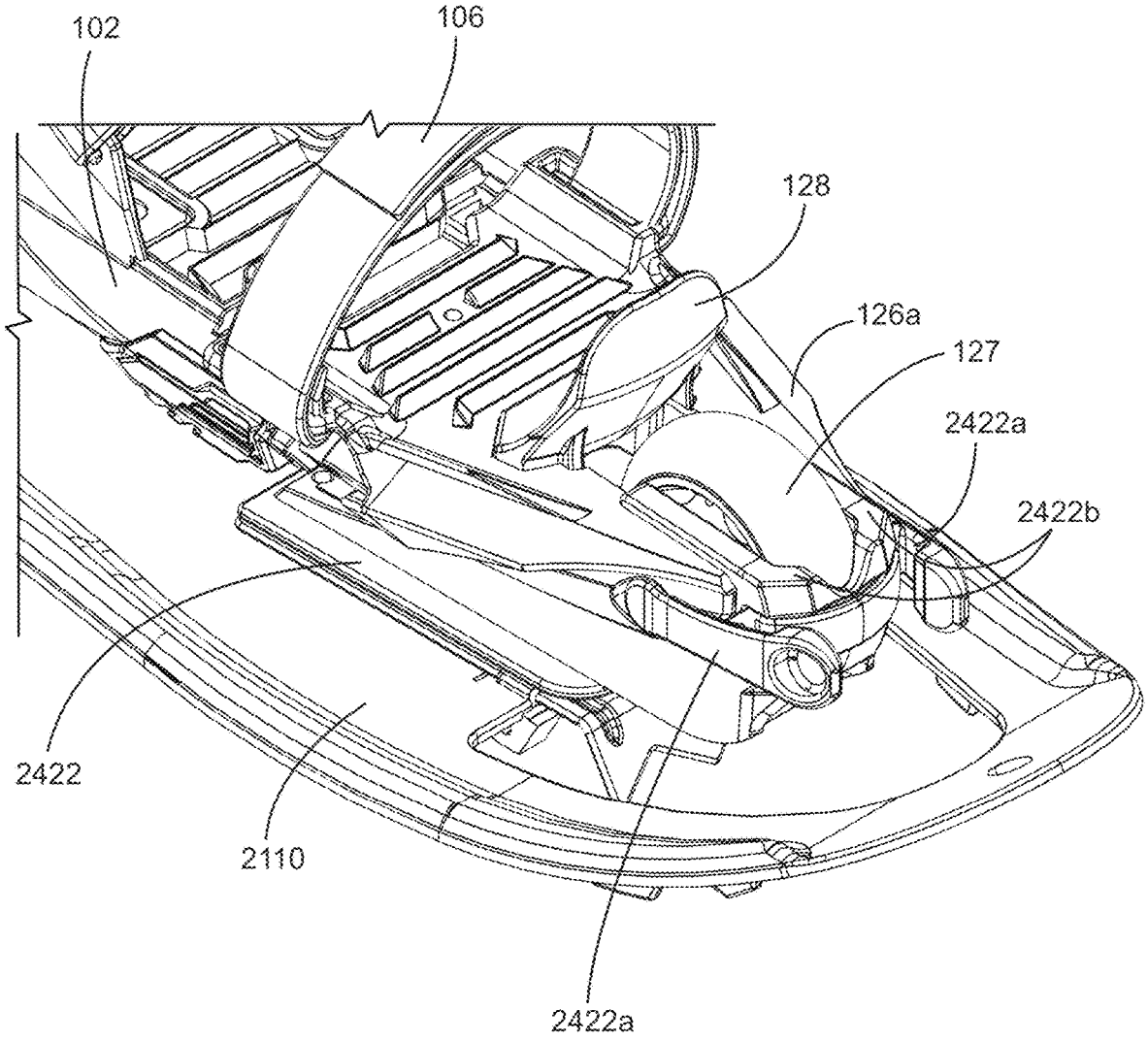
FIG. 24B shows a close-up view of the front connector of the secondary travel assembly from the modular skate system of FIG. 24A.
Figure 24C:
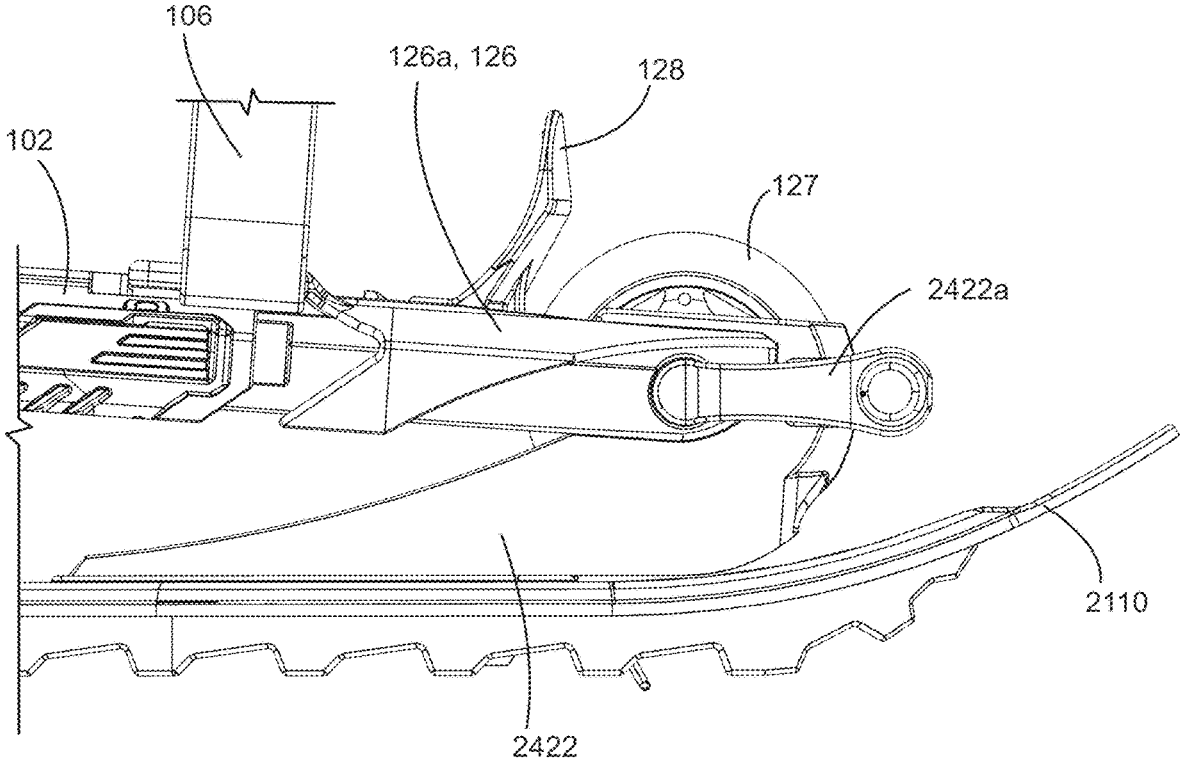
FIG. 24C shows a side view of the front connector of the secondary travel assembly from the modular skate system of FIG. 24A.

In the specific embodiment provided in FIG. 24A, the front connector flange 2422 includes a supporting flange portion that extends towards the rear of the secondary travel assembly 2110, and a contact flange portion that extends downwards, at least partially into the through-opening formed in the secondary travel assembly 2110. In this embodiment, the contact flange portion will engage the ground through the through-opening as a user takes a step while wearing the snowshoe configuration of the secondary travel assembly 2110.

In an additional embodiment where the front connector 2120 includes the front connector flange 2422, the front connector flange 2422 further includes means for pivotably mounting the skate body 102 to the front connector flange 2422. In the specific embodiment provided in FIGS. 24A to 24C the front connector flange 2422 includes a pair of front connector projections 2422*a* which extend horizontally out from the front connector flange 2422, and a pair of connector bracing members 2422*b* that also extend out from the front connector flange 2422. Each of the pair of front connector projections 2422*a* is pivotably mounted to the front connector flange 2422 and include at least an engagement end that is similar to the engagement end 1722*a* of the front ice skate support 1620. As the front wheel 927 is mounted in the wheel mounting slot 2424 of the front connector flange 2422, a user can press each projection 2422*a* inwards to deflect the engagement ends outwards, as the front wheel 927 is brought against the front connector flange 2422 and the engagement ends of each projection 2422*a* become horizontally aligned with the bores 526, the user can release the projections 2422*a* and the projections 2422*a* will deflect such that the each engagement end is received in one of the pair of front wheel bores 526.

As provided above, the rear connector 2130 of the secondary travel assembly 2110 includes the at least one engagement surface 2132 for supporting the first end 1910*a* of the rear support member 1910. In an embodiment such as provided in FIGS. 21 to 25B, the secondary travel assembly 2110 includes a support body 2234 that extends upwards the top surface 2110*a* of the secondary travel assembly 2110. The at least one engagement surface 2132 of the rear connector 2130 is formed on the support body 2234 such that the at least one engagement surface 2132 is raised above the top surface 2110*a* of the secondary travel assembly 2110.

In an additional embodiment, the shape of the at least one engagement surface 2132 corresponds to the shape of the pair of semi-cylindrical channels 2032 formed in the first end of the rear support member 1910. In this embodiment, the at least one engagement surface 2132 includes a pair of ridges 2136 formed thereon. Each of the pair of ridges 2136 is sized to be received within one of the pair of semi-cylindrical channels 2032 of the rear support member 1910 when the rear support member 1910 is supported on the at least one engagement surface 2132. Each ridge 2136 is also sized so as fit within the one of the pair of semi-cylindrical channels 2032 so as to laterally restrain the first end 1910*a* of the rear support member 1910 along the secondary travel assembly 2110. In this way, the rear support member 1910 will be separable from the at least one engagement surface 2132 while still being supported by the at least one engagement surface 2132 such that unwanted lateral motion of the rear support member 1910 is prevented.

In yet another additional embodiment such as provided in FIGS. 21, 23, 24A and 24C, the pair of ridges 2136 of the at least one engagement surface 2132 of the support body 2234 are formed as a pair of parallel, partial cylinder members that extend along a longitudinal axis of the secondary travel assembly 2110. A shape of the pair of parallel, partial cylinder members is complementary to a shape of the pair of semi-cylindrical channels 2032 in the first end 1910*a* of the rear support member 1910 such that the first end 1910*a* of the rear support member 1910 can be slidably engaged upon the pair of partial cylinder members for preventing lateral movement of the rear support member 1910 thereon.

In an additional embodiment provided in FIG. 22, the at least one engagement surface 2132 is formed as a tapering engagement surface such that a height (H1) of the at least one engagement surface 2132 above the top surface 2110*a* of the secondary travel assembly 2110 is greater at a rearmost extent of the at least one engagement surface 2132 compared to a height (H2) of the at least one engagement surface 2132 above the top surface 2110*a* at a foremost extent of the engagement surface 2132.

Figure 23:
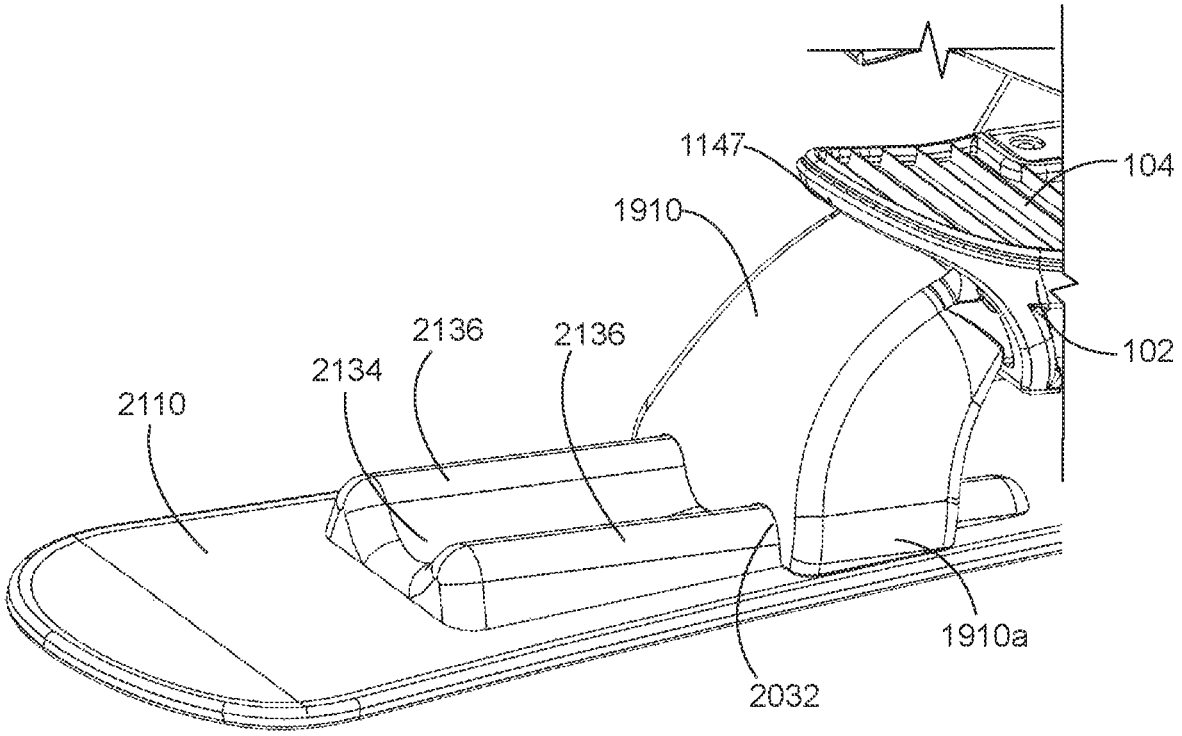
FIG. 23 shows a close-up view of the at least one engagement surface of the secondary travel assembly from the modular skate system of FIG. 19.

In the specific embodiment provided in FIG. 23, each of the pair of semi-cylindrical channels 2032 of the first end 1910*a* of the rear support member 1910 have a slight back-to-front taper such that a depth of each channel 2032 at a front side of the rear support member 1910 is less than a depth of each channel 2032 at a rear side of the rear support member 1910. The pair of partial cylinder members of the ridges 2136 of the at least one engagement surface 2132 have a shape that corresponds to the tapering shape of the pair of semi-cylindrical channels 2032, where each cylinder member of the pair of partial cylinder members is formed as a tapering cylinder member such that a height of each partial cylinder member at a frontmost extent of the partial cylinder members is less than a height of each partial cylinder member at a rearmost extent of the partial cylinder members.

Length-Adjustable Modular Skate System

In a second embodiment of the modular skate system, the modular skate system is configured as a length-adjustable modular skate system. In some of these embodiments, the length-adjustable modular skate system includes at least some of the elements of the length-adjustable roller skate, including the skate body 102 formed as the front foot support structure 120 and rear foot support structure 130, the adjustment actuator 140 and the first and second connector elements 224, 234 of the front foot support structure and rear foot support structure 120, 130, respectively, that facilitate relative movement of the front and rear foot support structures 120, 130.

In an embodiment, the length-adjustable modular skate system provides both a rolling and non-rolling manner of travel and comprises the front foot support structure 120 including the front sole surface 122, the front wheel assembly 123 and the first connector element 224, as well as the rear foot support structure 130 including the rear sole surface 132, and the second connector element 234 that is shaped to releasably connect to the first connector element 224 for movably connecting the front foot support structure 120 and the rear foot support structure 130. In this embodiment, the rear foot support structure 130 also includes the first mounting element 932, where the first mounting element 932 is formed to interchangeably connect to one of the rear wheel assembly 940 and the rear support member 1910. As provided above, the rear wheel assembly 940 includes the rear wheel support 943, the pair of rear wheels 137 that are rotatably mounted on the rear wheel support 943, and the second mounting element 942 that is formed to be releasably connected to the first mounting element 932 for releasably mounting the rear wheel support 943 to the rear foot support structure 130. The rear support member 1910 includes a second end with the fourth mounting element 2042, where the fourth mounting element 2042 is releasably connectable to the first mounting element 932 for releasably mounting the rear support member 1910 to the skate body 102.

Lastly, the length-adjustable modular skate system includes the secondary travel assembly 2110 that is structured for supporting the skate body 102 and providing a non-rolling manner of travel to the multi-functional skate. The secondary travel assembly 2110 includes the front connector 2120 and the rear connector 2130. In this embodiment, the front connector 2120 is releasably connectable to the front body portion 120 of the skate body 102 for mounting the front foot support structure 120 on the secondary travel assembly 2110, and the rear connector 2130 includes at least one engagement surface 2132. The at least one engagement surface 2132 is formed for slidably supporting the first end 1910*a* of the rear support member 1910 such that when rear foot support structure 130 is moved relative to the front foot support structure 120 via the first connector element and second connector element 224, 224, the first end 1910*a* of the rear support member 1910 will move along the at least on engagement surface 2132 for supporting the rear foot support structure 130 on the secondary travel assembly 2110.

In this length-extendable embodiment of the modular skate system, the modular skate system may include secondary travel assembly 2110 with the front and rear connectors 2120, 2130, and the rear support member 1910, but optionally, the front connector 2120 of the modular skate system need not be a pivotable connection for the front wheel 927, and the rear support member 1910 need not be separable from the at least one engagement surface 2132 of the rear connector 2130. In this way, the modular skate system can also provide a length extendable skate mounted on the secondary travel assembly 2110, where the length-extendable skate is not pivotable relative to the secondary travel assembly 2110 so as to separate the heel of the footwear of the user from the secondary travel assembly 2110.

In an alternate embodiment, the length-extendable skate system is structured such that the front connector 2120 is pivotably connected to the front wheel 927, and the rear support member 1910 is separable from the at least one engagement surface 2132 such that the heel of the footwear of the user can be pivoted up from the secondary travel assembly 2110.

In some embodiments where the at least one engagement surface 2132 is formed as a tapering engagement surface. The tapering engagement surface is formed so as to constrain the length-extendable motion of the rear foot support structure 130 relative to the front foot support structure 120.

The above-described embodiments are intended to be examples of the present disclosure and alterations and modifications may be affected thereto, by those of skill in the art, without departing from the scope of the disclosure that is defined solely by the claims appended hereto.

REFERENCE NUMERALS

100 multi-part roller skate
102 skate body
104 support surface
106 securing element
120 front foot support structure
122 front sole surface
123 front wheel assembly
126 front wheel support frame
126*a* frame arms
127 front wheel
128 toe support member
130 rear foot support structure
132 rear sole surface
133 rear wheel assembly
136 rear wheel support member
136*a* rear wheel truck
137 rear wheels
140 adjustment actuator
150 front securing element
160 rear securing element
170 brake member
170*a* ground contact portion
170*b* semi-circular connecting bracket
172 slots
224 first connector element
234 second connector element
252 front connecting flanges
260*a* main rear strap
260*b* ankle strap
262 rear connecting flanges
323 front axle assembly
324 front axle
325 front wheel bearings
326 front axle fasteners
333 rear axle assembly
334 rear axle
335 rear wheel bearings
336 rear axle fasteners
337 lateral through-aperture
526 bore
628 first parallel bar
628*a* vertical outer wall of first parallel bar
629 second parallel bar
640 tenon
650 plurality of ratchet teeth
651 first side
652 second side
660 front body engagement plate
720 pivotable adjustment actuator
722 contact surface
724 engagement surface
726 actuator mounting aperture
730 parallel channels
740 groove
846 mounting hole
848 rod
904 sole support surface
910 engagement structure
926 front wheel support
932 first mounting element
934 receiving cavity
940 removable rear wheel assembly
942 second mounting element
943 rear wheel support
944 engagement projection
944*a* lower section
944*b* upper section
945 rear surface of the skate body
1147 edge of the receiving cavity
1150 through-aperture
1210 bottom-most housing portion
1220 engagement button
1222 top surface of engagement button
1222*a* first, semi-cylindrical section of top surface
1222*b* second, semi-cylindrical section of top surface
1224 radial wall
1226 diametrically opposed slots
1230 receiving aperture
1240 insertion slot
1320 diametrically opposed tabs
1360 separate retaining body
1362 flange of retaining body
1430 sidewall of receiving aperture
1431 upper slot section
1432 lower slot section
1434 connection slot portion
1435 retaining wall
1620 front ice skate support
1622 front ice skate blade

1624 support frame
1630 rear ice skate support
1630*a* first end
1632 rear ice skate blade
1722 projections of support frame
1722*a* contact end of projection
1722*b* engagement end of projection
1724 bracing members
1742 third mounting element
1910 rear support member
1910*a* first end
1910*b* second end
2032 semi-cylindrical channels
2042 fourth mounting element
2110 secondary travel assembly
2110*a* top surface
2120 front connector
2122 front connector body
2124 wheel securing strap
2126 fasteners
2130 rear connector
2132 engagement surface
2134 support body
2136 ridges
2422 front connector flange
2422*a* front connector projections
2422*b* connector bracing members
2520 wheel receiving channel
2524 wheel mounting slot

What is claimed is:

1. A length-adjustable roller skate, comprising:

a front foot support structure including a front sole surface, a front wheel assembly and a first connector element;

a rear foot support structure including a rear sole surface, a rear wheel assembly, and a second connector element that is shaped to releasably connect to the first connector element for movably connecting the front foot support structure and the rear foot support structure, the first connector element and second connector element movably connecting the front and rear foot support structures such that a distance between the front sole surface and the rear sole surface can be increased by moving the front foot support structure in a first direction relative to the rear foot support structure and such that a distance between the front sole surface and the rear sole surface can be decreased by moving the front foot support structure in a second direction relative to the rear foot support structure, the second direction being opposite the first direction;

an adjustment actuator that is movably mounted to one of the front foot support structure and the rear foot support structure for moving between a disengaged position and an engaged position where the adjustment actuator releasably fixes a relative position of the front foot support structure and rear foot support structure;

at least one adjustable front securing element that is connected to the front foot support structure; and at least one rear securing element that is connected to the rear foot support structure and is separate from the front securing element, the at least one front and rear securing elements being formed for collectively, releasably holding a footwear of a user against a support surface that is at least in part defined by the front sole surface and the rear sole surface;

wherein one of the first connector element and the second connector element includes first and second parallel bars;

wherein the other of the first connector element and the second connector element includes first and second parallel channels that are shaped for receiving the first and second parallel bars;

wherein at least one of the first and second parallel bars includes a plurality of ratchet teeth formed along a length thereof; and wherein the adjustment actuator is structured for engaging at least one of the plurality of ratchet teeth.

2. The length-adjustable roller skate of claim 1, wherein the first and second parallel bars extend from a first end of the front foot support structure, substantially parallel to a long axis of the front foot support structure; wherein the pair of parallel channels extend from an outer surface of the rear foot support structure along a length thereof; and wherein the pair of parallel channels are shaped to slidably receive the first and second parallel bars therewithin for movably connecting the front and rear foot support structures.

3. The length-adjustable roller skate of claim 2, wherein the adjustment actuator is movably mounted on the rear foot support structure.

4. The length-adjustable roller skate of claim 3, wherein each of the plurality of ratchet teeth include a first side that is disposed at a first angle relative a long axis of the first parallel bar and a second side that is disposed at a second angle relative to the long axis of the first engagement bar; wherein the first angle of the first side is sized such that when the adjustment actuator is in the engaged position, the front foot support structure is prevented from moving in the first direction relative to the rear foot support structure; and wherein the second angle of the second side is sized such that when the adjustment actuator is in the engaged position, the front foot support structure is movable in the second direction relative to the rear foot support structure.

5. The length-adjustable roller skate of claim 4, wherein the second side of each of the plurality of ratchet teeth is formed on a rearward side of each of the plurality of teeth.

6. The length-adjustable roller skate of claim 2, wherein each channel of the pair of parallel channels of the length-adjustable roller skate includes a groove that is formed on an interior surface of the channel and that extends along the length of the channel, wherein the first and second bars each include a tenon that is formed on a side wall thereof and that extends along a length thereof, and wherein the tenons of the first and second parallel bars are sized to be received within the grooves of the pair of parallel channels as the first and second parallel bars are slidably inserted into the pair of parallel channels.

7. The length-adjustable roller skate of claim 1, wherein the at least one front securing element includes a plurality of front securing straps that are connected to the front foot support structure and extend over the front sole surface for releasably attaching the footwear of a user to the front sole surface, and wherein the at least one rear securing element includes a plurality of rear securing straps that are connected to the rear foot support structure and extend over the rear sole surface for releasably attaching the footwear of a user to the rear sole surface.

8. The length-adjustable roller skate of claim 1, further comprising a biasing member that is connected to the adjustment actuator and to the one of the front foot support structure and rear foot support structure for biasing the adjustment actuator towards the engaged position.

9. A modular roller skate, comprising:

a skate body including a sole support surface and at least one of adjustable securing element for releasably holding a footwear of a user against the sole support surface;

a permanent front wheel assembly including a front wheel support formed on a front wheel support structure of the skate body, and a front wheel that is rotatably mounted to the front wheel support;

a removable rear wheel assembly including a rear wheel support, and a pair of rear wheels that are rotatably mounted to the rear wheel support, and which are laterally spaced apart rear wheel support for laterally stabilizing the skate body in a lateral-vertical plane; and an engagement structure that is formed for releasably mounting the removable rear wheel assembly to the skate body such that a rotational axis of the pair of rear wheels is parallel to the rotational axis of the at least one front wheel, wherein the engagement structure includes:

a receiving cavity that is formed in one of the skate body and the removable rear wheel assembly and that extends inwards from a first outer surface of the one of the skate body and the removable rear wheel assembly;

a through-aperture that extends between the receiving cavity and a second outer surface of the one of the skate body and the removable rear wheel assembly; and an engagement projection that is formed in the other of the skate body and the removable rear wheel assembly and that extends out from the other of the skate body and removable rear wheel assembly is sized to be releasably received in the receiving cavity.

10. The modular roller skate of claim 9, wherein the engagement projection includes an engagement button that is sized to be received in the through-aperture, and that is movable between an unactuated and an actuated position, wherein the engagement button includes at least one internal biasing element for internally biasing the engagement button towards the unactuated position, and wherein the at least one internal biasing element is connected within the engagement button such as the engagement projection is inserted in the receiving cavity, the engagement button will be driven towards the actuated position, and such that as the engagement projection is fully inserted in the receiving cavity and the engagement button becomes aligned with the through-aperture, the engagement button will move from the actuated to the unactuated position for releasably locking the engagement projection with the receiving cavity.

11. The modular roller skate of claim 10, wherein the engagement button has a generally cylindrical form, and wherein a top surface of the engagement button includes a first portion that is formed as a flat, semi-cylindrical face, and a second portion that is formed as an angled semi-cylindrical face that extends down at an acute angle relative to the first portion of the top surface.

12. The modular roller skate of claim 10, wherein the engagement projection includes a receiving aperture formed on a surface thereof, and wherein the engagement button is movably retained within the receiving aperture for moving between the actuated and unactuated positions.

13. The modular roller skate of claim 9, wherein the skate body is a multi-part skate body that includes a front foot support structure and a rear foot support structure.

14. A modular skate system for selectably providing both a rolling and non- rolling manner of travel, the modular skate system comprising:

a skate body including a sole support surface, a plurality of securing elements for releasably attaching the footwear of a user to the sole support surface, a front wheel assembly that is formed on a front wheel support structure of the skate body and includes at least one front wheel, and a first mounting element, the first mounting element being formed to interchangeably connect to one of a rear wheel assembly and a rear support member, the rear wheel assembly including a rear support body, a pair of rear wheels that are rotatably mounted on the rear support body, and a second mounting element that is formed to be releasably connected to the first mounting element for releasably mounting the rear wheel support to the skate body such that a rotational axis of the pair of rear wheels is parallel to a rotational axis of the at least one front wheel, and the rear support member including a first end and a second end that includes a third mounting element, the third mounting element being formed to be releasably connected to the first connector element for releasably mounting the rear support member to the skate body, so as to form a rolling manner of travel; and a secondary travel assembly that is structured for supporting the skate body and providing a non-rolling manner of travel to the multi-functional skate, the secondary travel assembly including:

a front connector that is releasably connectable to the at least one front wheel of the skate body for pivotably mounting the skate body on the secondary travel assembly; and a rear connector that includes at least one engagement surface for separably supporting the rear support member, the at least one engagement surface being formed to inhibit lateral movement of the rear support member when the second end of the rear support member is supported on the at least one engagement surface, so as to form a non- rolling manner of travel.

15. The modular skate system of claim 14, wherein the at least one engagement surface is positioned for separably supporting the first end of the rear support member such that when the front wheel support structure of the skate body is pivotably mounted to the front connector, the first end of the rear support member can be separated from the at least one engagement surface by pivoting the skate body relative to the secondary travel assembly.

16. The modular skate system of claim 14, wherein the front connector is formed for pivotably mounting the skate body to the secondary travel assembly such that the skate body can pivot about a rotational axis of the at least one front wheel, relative to the secondary travel assembly.

17. The modular skate system of claim 14, wherein the first mounting element includes a receiving cavity, wherein the second mounting element includes a first engagement projection that extends from the rear wheel support and is formed to be releasably secured within the receiving cavity such that a rotational axis of the pair of rear wheels is parallel to the rotational axis of the at least one front wheel, and wherein the third mounting element includes a second engagement projection that extends from the second end of the rear support members is and formed to be releasably secured within the receiving cavity.

18. The modular skate system of claim 14, wherein the secondary travel assembly includes a support body that extends upwards the top surface of the secondary travel assembly, and wherein the engagement surface is formed on the support body.

19. The modular skate system of claim 18, wherein at least one engagement surface of the support body includes a pair of parallel, partial cylinder members that extend along a longitudinal axis of the secondary travel assembly, and wherein each of the partial cylinder members of the support body is formed as a tapering cylinder member such that a height of each partial cylinder member at a frontmost extent of the partial cylinder members is less than a height of each partial cylinder member at a rearmost extent of the partial cylinder members.

20. The modular skate system of claim 18, wherein the second end of the rear support member includes a pair of parallel channels with a shape that is complementary to a shape of the pair of partial cylinder members such that the first end of the rear support member can be slidably engaged upon the pair of partial cylinder members for preventing lateral movement of the rear support member thereon.

21. A method of using a modular skate system, comprising:

providing a skate body including a sole support surface a plurality of securing elements for releasably attaching a footwear of a user to the sole support surface, a front wheel assembly and a rear wheel assembly;

providing a secondary travel assembly that is structured for supporting the skate body and providing a non-rolling travel structure to the skate body;

wearing the skate body without the secondary travel assembly as a roller skate, and travelling on a support surface by rolling at least one front wheel from the front wheel assembly and at least one rear wheel from the rear wheel assembly on the support surface;

mounting the secondary travel assembly to the skate body such that the non-rolling travel structure extends below the front wheel assembly; and wearing the skate body with the secondary travel assembly mounted thereto to form a non-rolling travel device, and travelling along the support surface by engaging the support surface with the secondary travel assembly.

22. A method as claimed in claim 21, wherein the non-rolling travel device is an ice skate.

23. A method as claimed in claim 22, wherein the rear wheel assembly is removable from a receiving cavity in the skate body and wherein a rear ice skate support, including at least one rear ice skate blade, is insertable into the receiving cavity in the skate body to mount the rear ice skate support to the skate body.

24. A method as claimed in claim 21, wherein non-rolling travel device is a ski, and wherein the rear wheel assembly is removable from a receiving cavity in the skate body and wherein a rear support member, which is engageable with an engagement surface on the ski to laterally support the rear support member against lateral movement, is insertable into the receiving cavity in the skate body to mount the rear support member to the skate body.

* * * * *